US007794908B2

(12) United States Patent
Kaya et al.

(10) Patent No.: US 7,794,908 B2
(45) Date of Patent: Sep. 14, 2010

(54) TONER

(75) Inventors: Takaaki Kaya, Suntou-gun (JP); Shigeto Tamura, Suntou-gun (JP); Ryoichi Fujita, Chofu (JP); Makoto Kambayashi, Suntou-gun (JP); Takeshi Ikeda, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/395,792

(22) Filed: Mar. 2, 2009

(65) Prior Publication Data

US 2009/0170021 A1 Jul. 2, 2009

Related U.S. Application Data

(63) Continuation of application No. PCT/JP2008/068443, filed on Oct. 10, 2008.

(30) Foreign Application Priority Data

Oct. 15, 2007 (JP) ..... 2007-267662

(51) Int. Cl.
*G03G 9/00* (2006.01)

(52) U.S. Cl. ..... 430/110.2; 430/109.1; 430/109.4; 430/109.5; 430/137.11; 430/137.12; 430/111.4; 430/111.41; 430/106.1

(58) Field of Classification Search ..... 430/110.2, 430/109.1, 109.4, 109.5, 137.11, 137.12, 430/111.4, 111.41, 106.1
See application file for complete search history.

(56) References Cited

U.S. PATENT DOCUMENTS

| | | | | |
|---|---|---|---|---|
| 5,399,455 | A | 3/1995 | Mikami et al. | 430/138 |
| 5,443,936 | A * | 8/1995 | Yasuda et al. | 430/124.31 |
| 2005/0191575 | A1 | 9/2005 | Sugiura et al. | 430/110.3 |
| 2006/0166122 | A1 * | 7/2006 | Patel et al. | 430/110.2 |
| 2006/0210904 | A1 | 9/2006 | Ninomiya et al. | 430/110.2 |

(Continued)

FOREIGN PATENT DOCUMENTS

| | | |
|---|---|---|
| JP | 61-120161 | 6/1986 |

(Continued)

OTHER PUBLICATIONS

Notification of Transmittal of Copies of Translation of the International Preliminary Report on Patentability, mailed May 20, 2010 (10 pages).

*Primary Examiner*—Mark A Chapman
(74) *Attorney, Agent, or Firm*—Fitzpatrick, Cella, Harper & Scinto

(57) ABSTRACT

Provided is magnetic toner including capsule type toner particles each having a surface layer (B) on a surface of a toner base particle (A) containing at least a binder resin (a) mainly formed of a polyester, a magnetic substance, and a wax, in which, the surface layer (B) includes a resin (b), and the resin (b) includes a resin selected from the group consisting of a polyester resin (b1), a vinyl resin (b2), and a urethane resin (b3); a glass transition temperature Tg(a) of the binder resin (a) and a glass transition temperature Tg(b) of the resin (b) satisfy a relationship of Tg(a)<Tg(b); a magnetization (σt) in an external magnetic field of 79.6 kA/m of the magnetic toner is 12 $Am^2/kg$ or more and 30 $Am^2/kg$ or less; and an average circularity of the toner is 0.960 or more and 1.000 or less.

22 Claims, 4 Drawing Sheets

(a)

(b)

U.S. PATENT DOCUMENTS

| | | | | |
|---|---|---|---|---|
| 2007/0015851 | A1 | 1/2007 | Akutagawa et al. | 523/201 |
| 2007/0218393 | A1 | 9/2007 | Nozaki et al. | 430/110.2 |
| 2007/0275318 | A1 | 11/2007 | Sugiura et al. | 430/137.1 |

FOREIGN PATENT DOCUMENTS

| | | |
|---|---|---|
| JP | 62-150262 | 7/1987 |
| JP | 07-253685 | 10/1995 |
| JP | 08-248680 | 9/1996 |
| JP | 08-286423 | 11/1996 |
| JP | 2000-234011 | 8/2000 |
| JP | 2002-284881 | 10/2002 |
| JP | 2003-043737 | 2/2003 |
| JP | 2003-195560 | 7/2003 |
| JP | 2003-295512 | 10/2003 |
| JP | 2003-330217 | 11/2003 |
| JP | 2004-226572 | 8/2004 |
| JP | 2004-271919 | 9/2004 |
| JP | 2006-154026 | 6/2006 |
| JP | 2006-195079 | 7/2006 |
| JP | 2006-276062 | 10/2006 |
| JP | 2007-183341 | 7/2007 |

* cited by examiner (a)

(b)

(THE EFFLUX STARTING TEMPERATURE (Tfb) WAS DEFINED AS SOFTENING POINT (Tm) OF RESIN.)

TONER

CROSS-REFERENCE TO RELATED APPLICATIONS

This application is a continuation of International Application No. PCT/JP2008/068443, filed Oct. 10, 2008.

BACKGROUND OF THE INVENTION

1. Field of the Invention

The present invention relates to a toner for use in a recording method employing an electrophotographic method, an electrostatic recording method, a toner jet system recording method, or the like, and more specifically, to a toner for use in a copying machine, a printer, or a facsimile, which forms a toner image on an electrostatic latent image bearing member in advance, transfers the toner image onto a transfer material to form a toner image, and fixes the transferred image under heat and pressure to provide a fixed image.

2. Description of the Related Art

In recent years, energy saving has been considered to be a big technical problem also in electrophotographic devices, and drastic reduction of calorie applied to fixing apparatuses has been mentioned as the energy saving in electrophotographic device. Accordingly, needs for so-called "low-temperature fixability" in a toner, in which fixing with lower energy is possible, have been increasing.

Conventionally, a technique involving increasing sharp melt property of a binder resin has been known as an effective method to enable the fixing at lower temperature. In this point, polyester resins have excellent characteristics.

In JP 2006-293273 A, there is proposed a capsule toner having a ratio of a storage elastic modulus of toner at 60° C. to a storage elastic modulus of toner at 80° C. (G' (60)/G' (80)) of 10 or more and 40 or less. However, when used in a high-speed device, the capsule toner shows low sharp melt property and insufficient low-temperature fixability in some cases.

On the other hand, as another viewpoint of high-quality image, reduction in the particle diameter and sharpening of the grain size distribution of toner have been proceeded for the purpose of attaining high resolution and high definition, and in addition, a spherical toner has started to be suitably used for the purpose of improving transfer efficiency and flowability. As a method of preparing efficiently spherical toner particles with small particle diameters, a wet method has started to be employed.

As a wet method capable of using a sharp-melting polyester resin, proposed is a "solution suspension" method of producing spherical toner particles, which includes dissolving a resin component in an organic solvent which is immiscible with water and dispersing the resultant solution into an aqueous phase to thereby form an oil droplet (JP 08-248680 A). According to the technique, a spherical toner with a small particle can be easily obtained, which uses polyester excellent in the low-temperature fixability as a binder resin.

Further, as the toner particle produced by the solution suspension method using the above-mentioned polyester as a binder resin, a capsule type toner particle is also proposed for the purpose of attaining additional low-temperature fixability.

JP 05-297622 A proposes the following method:

a polyester resin, a low-molecular weight compound having an isocyanate group, and another component are dissolved and dispersed into ethyl acetate to prepare an oil phase, and droplets are then prepared in water; then, the compound having an isocyanate group is subjected to an interfacial polymerization at a droplet interface, whereby a capsule toner particle having polyurethane or polyurea as an outermost shell are prepared.

In addition, JP 2004-226572 A and JP 2004-271919 A propose the following method: a toner base particle is prepared by a solution suspension method in the presence of resin fine particles formed of any one of a vinyl-based resin, a polyurethane resin, an epoxy resin, and a polyester resin, or those resins in combination, whereby toner particles having a toner base particle surface covered with the above-mentioned resin fine particles are prepared.

JP 3455523 B proposes toner particles obtained by a solution suspension method using a urethane-modified polyester resin fine particle as a dispersant.

WO 2005/073287 proposes a core-shell type toner particles formed of a shell layer (P) including one or more film-like layers each formed of a polyurethane resin (a), and a core layer (Q) including one layer formed of a resin (b).

The core-shell type toner particles having a constitution in which a core part has low viscosity and poor heat-resistant storage stability of the core part is compensated with heat-resistant storage stability of a shell part. In this case, a substance being relatively hard against heat is used as the shell part, and hence it is necessary to highly cross-link the substance and increase a molecular weight of the substance. As a result, there is a tendency to inhibit the low-temperature fixability.

On the other hand, monochrome printers have been apt to be reduced in size in view of personal uses and setting areas thereof in offices. Therefore, a one-component development system is preferably used owing to merit of reducing size of the device. The one-component development system includes: a magnetic one-component development system in which magnetic particles are incorporated in toner and a developer is carried and transferred by the magnetic action; and a nonmagnetic one-component development method in which a developer is carried on a developer carrying bearing member (developing sleeve) by a triboelectric charge action of the developer without using magnetic particles. The magnetic one-component development system does not use a colorant such as carbon black and can use the magnetic particle also as a colorant.

As the magnetic toner used in the magnetic one-component development system, various kinds of toners are proposed. For example, there are proposed a dry-type toner obtained by melting and kneading a magnetic powder in a binder resin and pulverizing the resultant, and, in JP 2003-043737 A, a toner obtained by a polymerization method involving dispersing a magnetic powder in a styrene-based resin as a result of a suspension polymerization is proposed. In addition, in JP 08-286423 A, a toner obtained by a solution suspension method using a polyester is proposed.

However, various problems are apt to occur in the magnetic toner using the solution suspension method. One of the reasons why the problems occur lies in that, when dispersion of the magnetic substance is insufficient, a large amount of the detached magnetic substance is apt to generate, resulting in deteriorating resistance of the toner. As a result, a toner charge quantity is reduced, and development defect, transfer defect, and the like are apt to be generated, and contamination of agents is easily caused. In addition, when an addition amount of a release agent is increased, the release agent is apt to appear on the toner particle surface, and an image quality is easily impaired due to flowability defect.

In addition, as means for improving an image quality in the electrophotographic processes such as developing and transfer, there are also studies on improving a developing performance and a transfer performance by controlling an adhesive force of toner.

However, most studies relate to an adhesive force between toner and a latent image-bearing member or members accompanied in a developing or transfer process. There are few studies discussing an adhesive force of the toner itself. For example, in JP 2006-195079 A and JP 2006-276062 A, an adhesive force between toner and carrier particles is proposed, but studies for improving the developing performance and the transfer performance due to the adhesive force of the toner in the case of using a magnetic toner have been insufficient.

SUMMARY OF THE INVENTION

The present invention is achieved in view of the above-mentioned problems. An object of the present invention is to provide a magnetic toner having high offset resistance and excellent charging performance while the magnetic toner is a capsule type magnetic toner having excellent low-temperature fixability. Another object of the present invention is to obtain a high-quality image showing definite black characters, lines, and dots. Still another object of the present invention is to provide a spherical magnetic toner having a small particle diameter and a sharp grain size distribution.

The magnetic toner of the present invention (hereinafter, may be simply referred to as toner) includes capsule type toner particles each having a surface layer (B) on a surface of a toner base particle (A) containing at least a binder resin (a) mainly formed of a polyester, a magnetic substance, and a wax, in which:

the surface layer (B) includes a resin (b), and the resin (b) includes a resin selected from the group consisting of a polyester resin (b1), a vinyl resin (b2), and a urethane resin (b3);

a glass transition temperature Tg(a) of the binder resin (a) and a glass transition temperature Tg(b) of the resin (b) satisfy a relationship represented by the following formula (1), $$Tg(a)<Tg(b) \quad (1);$$

a magnetization (σt) in an external magnetic field of 79.6 kA/m of the magnetic toner is 12 $Am^2/kg$ or more and 30 $Am^2/kg$ or less; and an average circularity of the magnetic toner is 0.960 or more and 1.000 or less.

According to the present invention, the toner has a capsule type structure. By imparting functions such as low-viscosity property, releasing performance, and coloring to the toner base particle (A) and imparting functions concerning heat-resistant storage stability and developing performance to the surface layer (B), a toner satisfying both thermal characteristics of toner such as the low-temperature fixability and the heat-resistant storage stability and electrical characteristics of toner such as the developing performance and the transfer performance can be obtained.

In particular, by using the binder resin (a) mainly formed of a polyester for the toner base particle (A), dispersibility of the magnetic substance and the wax can be controlled while the sharp melt property of the toner can be improved.

In addition, the toner has the capsule type structure by the surface layer (B), and hence exposure area of the magnetic substance can be decreased on surface and a toner having excellent charging performance can be provided. As a result, problems involved in a black toner such as toner scattering and fogging can be solved.

Further, a preferred embodiment of the present invention enables controlling the shape and surface properties of toner. Therefore, a toner having excellent electrophotographic characteristics such as the charging performance, developing performance, transfer performance, and cleaning performance, and fixing performance can be provided.

DESCRIPTION OF SYMBOLS

Figure 1:
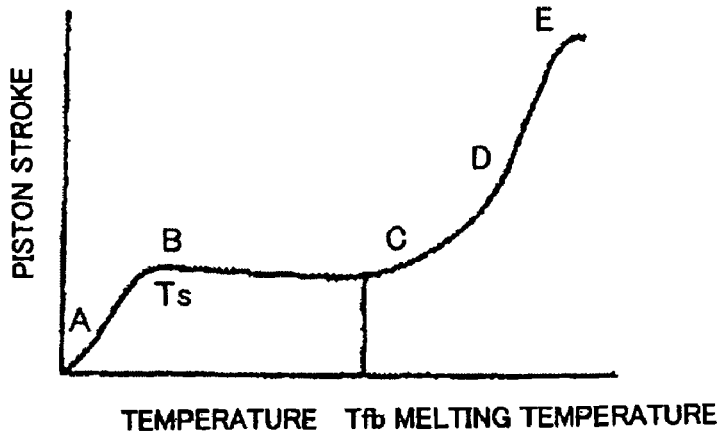
FIG. 1 are flow curve diagrams based on data by a flow tester.
Figure 1:
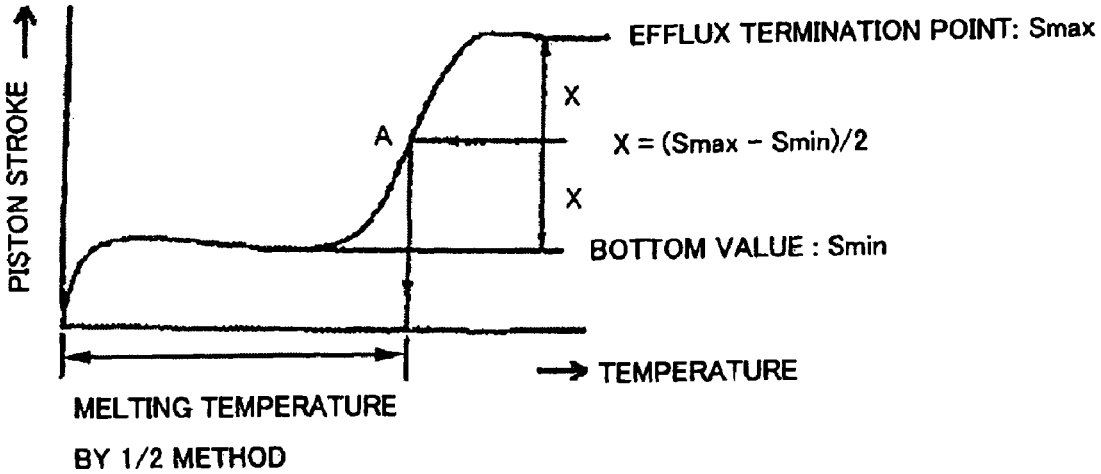

1 aspirator (part contacting to measurement container 2 is at least formed of insulator)
2 measurement container made of metal
3 500-mesh screen
4 lid made of metal
5 vacuum gauge
6 air flow-controlling valve
7 aspiration port
8 condenser
9 electrometer
11 lower electrode
12 upper electrode
13 insulant
14 ampere meter
15 volt meter
16 constant-voltage device
17 carrier
18 guide ring
d sample thickness
E resistance measurement cell

DETAILED DESCRIPTION OF THE PREFERRED EMBODIMENTS

A magnetic toner of the present invention includes capsule type toner particles each having a surface layer (B) on a surface of a toner base particle (A) containing at least a binder resin (a) mainly formed of a polyester, a magnetic substance, and a wax, in which:

the surface layer (B) includes a resin (b), and the resin (b) includes a resin selected from the group consisting of a polyester resin (b1), a vinyl resin (b2), and a urethane resin (b3);

a glass transition temperature Tg (a) of the binder resin (a) and a glass transition temperature Tg(b) of the resin (b) satisfy a relationship represented by the following formula (1), $$Tg(a)<Tg(b) \quad (1);$$

a magnetization (σt) in an external magnetic field of 79.6 kA/m of the magnetic toner is 12 $Am^2/kg$ or more and 30 $Am^2/kg$ or less; and an average circularity of the magnetic toner is 0.960 or more and 1.000 or less.

The magnetic toner of the present invention has a capsule type structure (capsule structure) and includes the surface layer (B) on the surface of the toner base particle (A) containing at least the binder resin (a) mainly formed of a polyester, the magnetic substance, and the wax.

In the case where the magnetic toner does not have the capsule structure, toner containing a wax, for example, easily aggregates due to separation of the wax on the surface, with the result that defect in stirring in a developing zone and clogging in a cleaner are apt to occur. In addition, the magnetic toner appears on the toner surface, and hence a resistance value of the toner surface decreases and a charge quantity is apt to reduce. The reduction of charge quantity are easily occurred not only the change of the toner charge quantity in the developing zone but also change of the toner charge quantity by injecting the charge to a photosensitive member and by separating discharge upon transfer.

In order to reduce those influences, the content of the surface layer (B) is preferably 2.0 parts by mass or more and 15.0 parts by mass or less with respect to 100 parts by mass of the toner base particle (A). In the case where the content is less than 2.0 parts by mass, the toner can not be capsulated sufficiently, whereby the above-mentioned problems are apt to occur. In the case where the content is more than 15.0 parts by mass, properties of the surface layer (B) is reflected strongly on fixing and it is difficult to exhibit characteristics of the toner base particle (A) having sharp melt property. The content of the surface layer (B) is preferably 2.5 parts by mass or more and 12.0 parts by mass or less and more preferably 3.0 parts by mass or more and 10.0 parts by mass or less.

However, while heat-resistant storage stability of the capsule type toner is improved, fixing thereof is easily inhibited and it is difficult to obtain sufficient low-temperature fixability because the toner base particle has relatively high viscous surface layer. Therefore, it is necessary for the surface layer (B) to satisfy the heat-resistant storage stability and to keep the viscosity as low as possible.

The surface layer (B) used in the present invention includes the resin (b), and the resin (b) includes a resin selected from the group consisting of the polyester resin (b1), the vinyl resin (b2), and the urethane resin (b3).

In addition, in the magnetic toner of the present invention, the glass transition temperature Tg(a) of the binder resin (a) mainly formed of a polyester and the glass transition temperature Tg(b) of the resin (b) satisfy a relationship represented by the following formula (1).

$$Tg(a)<Tg(b) \quad (1)$$

That is, by setting Tg(b) to be larger than Tg(a), a toner capable of retaining heat resistance can be achieved while the thermal characteristic of the toner i.e., low viscosity at low temperatures is realized.

Here, Tg(a) is preferably 35° C. or higher and 65° C. or lower, and more preferably 40° C. or higher and 60° C. or lower. Preferred range of Tg(b) is described below.

In measurement of dynamic viscoelasticity of the toner when the temperature of the toner is increased at a constant rate, change of the loss elastic modulus according to change of temperature is observed, with the result that followings are observed. That is, when a temperature showing the maximum value of the loss elastic modulus of the toner is represented by Tt (° C.), the toner is maintained in a glass form in a temperature region lower than the temperature Tt (° C.) and undergoes a phase transition at the temperature Tt (° C.) Alternatively, at temperatures higher than the temperature Tt (° C.), the viscosity decreases with temperature increase. At temperatures lower than the temperature Tt (° C.), it is preferred that the toner be hardly deformed and the toner exhibits favorable heat-resistant storage stability. On the other hand, at a temperature range higher than the temperature Tt (° C.), the viscosity preferably decreases promptly, and the toner exhibits excellent low-temperature fixability.

In the magnetic toner of the present invention, when a temperature showing the maximum value of the loss elastic modulus of the toner is represented by Tt (° C.), the temperature Tt (° C.) preferably satisfies the following formula: 40° C.≦Tt≦60° C., and more preferably the following formula: 45° C.≦Tt≦55° C. When the temperature Tt (° C.) falls within the range, material design for satisfying both the heat-resistant storage stability and low temperature-fixability can be performed. The temperature Tt (° C.) can be controlled to the above range by appropriately selecting a main component of the toner particles, that is, the binder resin (a) mainly formed of a polyester.

Further, when loss elastic moduli at temperatures of (Tt+5) (° C.) and (Tt+25) (° C.) are represented by G"t(Tt+5) and G"t(Tt+25), respectively, G"t(Tt+5)/G"t(Tt+25) is preferably larger than 40. G"t(Tt+5)/G"t(Tt+25) shows the sharp melt property of the toner in a temperature range higher than the temperature Tt (° C.). That is, G"t(Tt+5)/G"t(Tt+25) larger than 40 means that the toner has high sharp melt property, which is preferred because the toner has high sensitivity to heat and becomes advantageous for low-temperature fixability. Further, G"t(Tt+5)/G"t(Tt+25) is preferably 50 or more, and more preferably 60 or more. In addition, the value is preferably less than 200. When the value is 200 or more, viscosity change depending on temperature is too large, and hence the toner is apt to be inferior in one of the low-temperature fixability and the high-temperature offset resistance.

For setting the G"t (Tt+5)/G"t (Tt+25) to be larger than 40, the following method can be exemplified.

For example, there is a method including forming the binder resin (a) mainly formed of a polyester from the resin (a1) and the resin (a2) having different softening points from each other, and setting the softening point of the resin (a1) to be 100° C. or lower, and the softening point of the resin (a2) to be 120° C. or higher. More preferably, the softening point of the resin (a1) is 90° C. or lower and the softening point of the resin (a2) is 130° C. or higher.

Further, in a molecular weight distribution of tetrahydrofuran (THF)-soluble matter measured by gel permeation chromatography (GPC), the weight average molecular weight of the resin (a1) is preferably 2,000 or more and 20,000 or less (more preferably 3,000 or more and 15,000 or less), and the weight average molecular weight of the resin (a2) is preferably 30,000 or more and 150,000 or less (more preferably 50,000 or more and 120,000 or less). Further, the ratio of the weight average molecular weight (Mw) to the number average molecular weight (Mn) of the resin (a1) (Mw/Mn) is preferably 1.0 or more and 8.0 or less (more preferably 1.2 or more and 6.0 or less).

The resin (a1) accounts for preferably 50 mass % or more and 90 mass % or less (more preferably 55 mass % or more and 85 mass % or less) of the binder resin (a) mainly formed of a polyester.

In addition, when a temperature showing the maximum value of the loss elastic modulus of the resin (b) is represented by Tb(° C.), (Tb−Tt) is preferably 5° C. or more and 20° C. or less and more preferably 5° C. or more, and 15° C. or less. When (Tb−Tt) satisfies the above range, the heat-resistant storage stability can be additionally improved.

Further, when loss elastic moduli of the resin (b) at temperatures of (Tb+5) (° C.) and (Tb+25) (° C.) are represented by G"b(Tb+5) and G"b(Tb+25), respectively, G"b(Tb+5)/G"b(Tb+25) is preferably larger than 10 (more preferably 20 or more). In this case, more favorable sharp melt property can be obtained.

For adjusting the G"b(Tb+5)/G"b(Tb+25), it is possible to use such a condition that a polymerization product is easily uniformed upon preparing the resin (b), for example, to use an ester exchange reaction or an anhydride for producing an ester bond. For producing a urethane bond, the above-mentioned range can be satisfied by using a raw material having a uniform composition as diol or diisocyanate.

The toner particles include a tetrahydrofuran (TFH)-insoluble matter excluding the magnetic substance of preferably 3 mass % or more and 10 mass % or less and more preferably 4 mass % or more and 8 mass % or less. When the THF-insoluble matter excluding the magnetic substance falls within the above-mentioned range, more favorable offset resistance can be obtained.

In addition, the magnetic toner of the present invention has the storage elastic modulus at 120° C. (G't(120)) of preferably $5.0\times10^2$ Pa or more and $5.0\times10^4$ Pa or less (more preferably $8.0\times10^2$ Pa or more and $3.0\times10^4$ Pa or less). When the storage elastic modulus satisfies the above range, both the low-temperature fixability and the offset resistance can be more favorably achieved.

G't(120) can satisfy the above-mentioned range by adjusting elasticity at 120° C. of the binder resin (a), a ratio of the resin (a2) in the binder resin (a), an amount of the magnetic substance, and the like.

The average circularity of the magnetic toner of the present invention is 0.960 or more and 1.000or less. When the average circularity of the magnetic toner is less than 0.960, transfer efficiency is easily reduced. The average circularity of the magnetic toner is more preferably 0.965 or more and 0.990 or less. For example, the average circularity of the magnetic toner can be achieved by producing a toner with a solution suspension method or forming a toner into a spherical shape in slurry during the production process.

The magnetic toner of the present invention has the average adhesive force (F50) measured by a centrifugal adhesion measurement apparatus (NS-C100: manufactured by Nano Seeds Corporation) of preferably 50 (nN) or less. The average adhesive force is more preferably 45 (nN) or less and still more preferably 40 (nN) or less. On the other hand, the average adhesive force (F50) is preferably 5 (nN) or more. When the average adhesive force satisfies the above-mentioned range, more favorable developing performance and transfer performance can be obtained.

The average adhesive force (F50) can satisfy the above-mentioned range by adjusting mean roughness (Ra) of the toner particle surface, average circularity, toner grain size distribution, and the like.

The mean roughness (Ra) of the surface of the toner particles used in the magnetic toner of the present invention (hereinafter, may be simply referred to as mean roughness (Ra)) is preferably 1.0 nm or more and 5.0 nm ore less, more preferably 1.5 nm or more and 5.0 nm or less, and still more preferably 2.0 nm or more and 5.0 nm or less.

The surface of the toner particles has the above-mentioned mean roughness, whereby a contact area between toners decreases and the average adhesive force (F50) can be set to 50 (nN) or less.

As a method of controlling the mean roughness (Ra) of the surface of the toner particles, when toner particles are produced by the solution suspension method, there are given a method of controlling a speed at which a solvent is removed from a dispersion liquid, substituting the air inside a container containing the dispersion liquid by a nitrogen gas, or bubbling the nitrogen gas in the dispersion solution in the step of removing the solvent. In addition, in preparing toner particles by the solution suspension method, use of a wax dispersant with the wax in an oil phase also enables to decrease the mean roughness.

The magnetization (σt) in the external magnetic field of 79.6 kA/m of the magnetic toner of the present invention is 12 $Am^2/kg$ or more and 30 $Am^2/kg$ or less. When the magnetization (at) of the magnetic toner is less than 12 $Am^2/kg$, supporting ability at a toner carrying member decreases, resulting in toner scattering and fogging on paper. In addition, when the magnetization (at) of the toner exceeds 30 $Am^2/kg$, the amount of the magnetic substance is apt to be too large, and dispersion defect of the magnetic substance and deterioration of fixing performance due to reduction of resin components are easily caused. The magnetization (at) in the external magnetic field of 79.6 kA/m of the magnetic toner is preferably 15 $Am^2/kg$ or more and 28 $Am^2/kg$ or less.

Note that the magnetization (at) of the magnetic toner can be set to the above-mentioned range by adjusting addition amount of the magnetic substance and magnetization of the magnetic substance to be used.

Here, when a magnetic toner using a polyester was produced by a solution suspension method, dispersion defect of the magnetic substance was easily occurred. In addition, the magnetic substance was included in toner, and thus stable production of toner particles became difficult. As a result, there were frequently occurred generation of a white lump, deposition of the magnetic substance on the toner surface, and dispersion of the particle diameter due to granulation defect.

From the foregoing, by using the following methods [1] to [3], it is possible to provide a toner capable of responding to high-quality image.

[1] The binder resin (a) mainly formed of a polyester and the magnetic substance are premixed sufficiently to improve dispersibility of the magnetic substance.

[2] Polarity of the resin (b) used in the surface layer (B) is increased to enclose the magnetic substance firmly in the toner particles.

[3] The magnetic substance is subjected to hydrophobic treatment to decrease affinity thereof to an aqueous phase.

Next, the technique [1] is described: the binder resin (a) mainly formed of a polyester and the magnetic substance are premixed sufficiently to improve dispersibility of the magnetic substance.

In order to improve the dispersibility of the magnetic substance, it is preferred to perform a wet dispersion (media dispersion) or a dry kneading in the present invention.

In order to further improve the dispersibility of the magnetic substance:

1) a dry-kneaded product is subjected to the wet dispersion;

2) a solvent is added upon the dry kneading; and 3) a wax is added upon the dry kneading.

Those techniques may be performed singly or in combination.

In addition, in a mixing process upon preparing an oil phase after respective kinds of materials are premixed, dispersion of each component is apt to be insufficient. In particular, in the present invention, dispersion defect of the magnetic substance remarkably appears on degradation of performance of the toner. In the present invention, not only dispersion with a general mechanical stirring blade but also a fine dispersion process by an ultrasonic wave or a media dispersion process of oil phase-mixing solution are employed, whereby dispersion of the magnetic substance into the toner particles can be improved.

For the technique [2]: polarity of the resin (b) used in the surface layer (B) is increased to enclose the magnetic substance firmly in the toner particles, the Following techniques may be used.

A functional group having high polarity is introduced into the resin (b) used in the surface layer (B). For example, a carboxyl group or a sulfonic group is introduced into the resin (b). Further, it is effective to use a resin including, as a main chain, polyurethane having a urethane bond, and then introduce the functional group into the resin.

For the technique [3]: the magnetic substance is subjected to hydrophobic treatment to decrease affinity of the magnetic substance to an aqueous phase, it is effective that free magnetic substance which outflows to the aqueous phase from the toner particles is decreased. However, in the case of increasing a treatment amount and using a treatment agent having high hydrophobicity, it is necessary to pay attention thereto because the magnetic substance is apt to aggregate in the toner particles.

In the magnetic toner of the present invention, the volume resistivity Rt (Ω·cm) and the magnetization σt ($Am^2/kg$) of the toner preferably satisfy a relationship represented by the following formula (2).

$$\text{Log } Rt > 14 - \sigma t/25 \quad (2)$$

Because, it is considered that an amount of free magnetic substance and an amount of the magnetic substance on the surface are decreased, the surface of the toner base particle is covered with the resin as a capsule type toner, and the dispersion of the magnetic substance is improved.

In addition, the toner of the present invention preferably satisfies a relationship represented by the following formula (3).

$$\text{Log } Rt > 15 - \sigma t/25 \quad (3)$$

Further, the magnetic toner of the present invention preferably satisfies a relationship represented by the following formula (4).

$$\text{Log } Rt > 15 - \sigma t/40 \quad (4)$$

The relationship between the volume resistivity of the magnetic toner and the magnetization of the magnetic toner can satisfy the above-mentioned range by improving the dispersion of the magnetic substance and forming a core-shell structure.

The magnetic toner of the present invention has a dielectric loss (tan δ) represented by [a dielectric loss index ∈"]/[a dielectric constant ∈'] at a frequency of $10^5$ Hz of preferably 0.015 or less. More preferred is 0.010 or less. On the other hand, the dielectric loss (tan δ) at a frequency of $10^5$ Hz is preferably 0.004 or more.

When the dielectric loss of the magnetic toner falls within the above-mentioned range, scattering and degradation of developing performance can be suppressed, and it becomes easy to obtain more stable charge upon developing or transferring.

The dielectric loss (tan δ) of the magnetic toner can satisfy the above-mentioned range by controlling dispersion state of the magnetic substance, that is, selecting a dispersion method of the magnetic substance. In particular, an ultrasonic dispersion is applied upon preparing the oil phase, and thus the dispersion state can be controlled by adjusting output, irradiation time, and the like.

In the magnetic toner of the present invention, a number average dispersed-particle diameter of the magnetic substance in a sectional enlarged photograph of the toner particles is preferably 0.50 μm or less. When the number average dispersed-particle diameter of the magnetic substance is 0.50 μm or less, sufficient coloring performance can be easily obtained and definition of the above-mentioned dielectric loss tangent is easily satisfied. More preferred is 0.45 μm or less. Note that the number average dispersed-particle diameter of the magnetic substance is preferably 0.10 μm or more and more preferably 0.20 μm or more.

The number average dispersed-particle diameter of the magnetic substance in the sectional enlarged photograph of the toner particles, can satisfy the above-mentioned range by adjusting output and irradiation time when the ultrasonic wave dispersion is performed upon preparing an oil phase.

In the present invention, the weight average particle diameter (D4) of the magnetic toner is 4.0 μm or more and 9.0 μm or less and more preferably 4.5 μm or more and 7.0 μm or less.

When the weight average particle diameter of the toner falls within the above-mentioned range, charge-up of the toner after long time use can be favorably suppressed, and decrease in image density can be suppressed. In addition, in the case of outputting a line image or the like, scattering or dropping of the toner can be favorably suppressed.

In addition, the weight average particle diameter (D4) of the toner can be adjusted to the above-mentioned range by controlling an addition amount of the resin (b), and a blending amount of the oil phase and the dispersion liquid.

In the magnetic toner of the present invention, particles each having the diameter of 0.6 μm or more and 2.0 μm or less (hereinafter, also referred to as fine powder amount of toner) account for preferably 5.0 number % or less of the toner, and more preferably 2.0 number % or less of the toner. In the case where fine powders each having the diameter of 2.0 μm or less account for 5.0 number % or less, contamination of an agent or fluctuation in charge quantity can be easily suppressed, and problems such as decrease in image density and fogging even after long-term image output can be easily suppressed.

Further, in the magnetic toner of the present invention, the content of particles each having the diameter of 0.6 μm or more and 2.0 μm or less is preferably 5.0 number % or less of the toner even after ultrasonic wave treatment of the toner in a water dispersion substance. In particular, in the case where share is applied in a developing device of high-speed machine or the like, problems such as toner cracking and shell peeling are apt to occur, resulting in the cause of the above-mentioned problems. More preferred is 2.0 number % or less.

The fine powder amount of the toner can satisfy the above-mentioned range by adjusting stirring strength upon emulsification and rotating speed of a stirring blade upon desolvation after the emulsification.

The magnetic toner of the present invention has the ratio (D4/D1) of the weight average particle diameter (D4) to the number average particle diameter (D1) of preferably 1.25 or less. More preferred is 1.20 or less. Note that the lower limit of the ratio D4/D1 is 1.00.

Hereinafter, the toner base particle (A) used in the present invention is described in detail.

The toner base particle (A) used in the present invention includes at least the binder resin (a) mainly formed of a polyester, a magnetic substance, and a wax. Accordingly, another additive other than the above items, as required, may be incorporated in the toner base particle (A).

The binder resin (a) used in the present invention includes a polyester as a main component. Here, the term "main component" means that the polyester accounts for 50 mass % or more of the total amount of the binder resin (a). As the polyester, a polyester mainly formed of an aliphatic diol as an alcohol component and/or a polyester mainly formed of an aromatic diol as an alcohol component are/is preferably used.

The aliphatic diol has preferably 2 to 8 carbon atoms, and more preferably 2 to 6 carbon atoms.

Examples of the aliphatic diol having 2 to 8 carbon atoms include: diols such as ethylene glycol, 1,2-propylene glycol, 1,3-propylene glyocol, 1,4-butane diol, 1,5-pentane diol, 1,6-hexane diol, neopentyl glycol, 1,4-butene diol, 1,7-heptane diol, and 1,8-octane diol; and polyhydric alcohols having trivalent or more such as glycerin, pentaerythritol, and trimethylol propane. Of those, α, ω-straight-chain alkanediol is preferred and 1,4-butane diol and 1,6-hexanediol are more preferred. Further, from the viewpoint of durability, the content of the aliphatic diol is preferably 30 to 100 mol % and more preferably 50 to 100 mol % of the alcohol component forming the polyester.

Examples of the aromatic diol include polyoxypropylene (2.2)-2,2-bis(4-hydroxyphenyl)propane and polyoxyethylene(2.2)-2,2-bis(4-hydroxyphenyl)propane.

Examples of the carboxylic acid component forming the polyester include the followings:

aromatic polycarboxylic acids such as phthalic acid, isophthalic acid, terephthalic acid, trimellitic acid, and pyromellitic acid; aliphatic polycarboxylic acids such as fumaric acid, maleic acid, adipic acid, succinic acid, and succinic acid substituted with an alkyl group having 1 to 20 carbon atoms or an alkenyl group having 2 to 20 carbon atoms such as dodecenyl succinic acid and octenyl succinic acid; anhydrides of those acids; and alkyl (having 1 to 8 carbon atoms) esters of those acids.

From the viewpoint of the charging performance, the carboxylic acid preferably includes an aromatic polycarboxylic acid compound. The content thereof is preferably 30 to 100 mol % and more preferably 50 to 100 mol % of the carboxylic acid component forming the polyester.

In addition, a raw material monomer may include, from the viewpoint of fixing performance, a polyvalent monomer having trivalent or more, that is, a polyhydric alcohol having trivalent or more and/or polycarboxylic acid compound having trivalent or more.

A production method for the polyester is not particularly limited and may follow a known method. For example, in an inert gas atmosphere, an alcohol component and a carboxylic acid component are subjected to a condensation polymerization at 180 to 250° C. using, as required, an esterification catalyst.

The binder resin (a) includes, as a main component, preferably polyester using the aliphatic diol as an alcohol component. On the other hand, in the case where the binder resin (a) includes polyester using a bisphenol-based monomer as the alcohol component, there is no large difference in melting characteristics of the binder resin (a) between the case of the aliphatic diol and bisphenol-based monomer. However, because there is possibility to influence on granulation property due to a relationship with the resin (b), it is effective to appropriately select a suitable polyester.

The binder resin (a) may include a resin other than the polyester using a predetermined amount of an aliphatic diol or an aromatic diol as an alcohol component. For example, a polyester resin in which a use amount of an aliphatic diol is out of the range, a styrene-acrylic resin, a mixing resin of polyester and styrene acryl, an epoxy resin, or the like may be included. In these case, the content of the polyester using the predetermined amount of an aliphatic diol as the alcohol component is preferably 50 mass % or more and more preferably 70 mass % or more with respect to the total amount of the binder resin (a).

Further, in a more preferred embodiment of the present invention, the peak molecular weight of the binder resin (a) is 8,000 or less and more preferably less than 5,500. In addition, in one of preferred embodiments, a ratio of the molecular weight of 100,000 or more is 5.0% or less, and more preferably 1.0% or less.

In the case where the molecular weight of the binder resin (a) satisfies the above-mentioned prescription, more favorable fixing performance can be obtained.

In the present invention, a ratio of the binder resin (a) having the molecular weight of 1,000 or less is preferably 10.0% or less and more preferably less than 7.0%. In this case, contamination of members caused by a low-molecular-weight component can be favorably suppressed.

In the present invention, in order to set the ratio of the binder resin (a) having the molecular weight of 1,000 or less to 10.0% or less, the following preparation method can be favorably used.

For decreasing the ratio of the binder resin (a) having the molecular weight of 1,000 or less, the binder resin is dissolved into a solvent, and the obtained solution is brought into contact with water, and left to stand. As a result, the ratio of the binder resin (a) having the molecular weight of 1,000 or less can effectively decreased. With the operation, the low-molecular-weight component having the molecular weight of 1,000 or less elutes into water and can be removed from the resin solution efficiently.

From the above-mentioned reason, the solution suspension method can be preferably used as a method of producing a toner. By using a method including leaving a solution in which the binder resin (a), the magnetic substance, and the wax are dissolved or dispersed to stand while the solution is in contact with an aqueous medium before suspended in the aqueous medium, the low-molecular-weight component can be removed efficiently.

In the present invention, in order to adjust the molecular weight of the toner, a resin having two or more kinds of molecular weights may be mixed and used.

In the present invention, a crystalline polyester may be included in the binder resin (a). As the crystalline polyester, preferred is a resin obtained by subjecting an alcohol component mainly formed of an aliphatic diol and a carboxylic acid component mainly formed of an aliphatic dicarboxylic acid compound to a condensation polymerization. Of those, preferred is a resin obtained by subjecting an alcohol component including 60 mol % or more of an aliphatic diol having 2 to 6 carbon atoms and preferably 4 to 6 carbon atoms, and a carboxylic acid component including 60 mol % or more of the aliphatic dicarboxylic acid compound having 2 to 8-carbon atoms, preferably 4 to 6-carbon atoms, and more preferably 4 carbon atoms to a condensation polymerization.

As the aliphatic diol having 2 to 6 carbon atoms which forms the crystalline polyester, the followings are exemplified: ethylene glycol, 1,2-propyleneglycol, 1,3-propyleneglycol, 1,4-butanediol, 1,5-pentanediol, 1,6-hexanediol, neopentyl glycol, and 1,4-butene diol. Of those, 1,4-butanediol and 1,6-hexane diol are preferred.

The alcohol component forming the crystalline polyester may include a polyhydric alcohol component other than the aliphatic diol. As the polyhydric alcohol component, the followings are exemplified: aromatic alcohols each having bivalent including alkylene (having 2 to 3 carbon atoms) oxides (the number of average addition moles of 1 to 10) adduct of bisphenol A such as polyoxypropylene(2.2)-2,2-bis(4-hydroxyphenyl)propane and polyoxyethylene(2.2)-2,2-bis(4-hydroxyphenyl)propane; and alcohols having trivalent or more such as glycerin, pentaerythritol, and trimethylol propane.

Examples of the aliphatic dicarboxylic acid compounds having 2 to 8 carbon atoms which forms the above crystalline polyester include: oxalic acid, malonic acid, maleic acid, fumaric acid, citraconic acid, itaconic acid, glutaconic acid, succinic acid, adipic acid, and anhydrides and alkyl (having 1 to 3 carbon atoms) esters of the acids. Of those, fumaric acid and adipic acid are preferable, and fumaric acid is particularly preferable.

The carboxylic acid component forming the crystalline polyester may include a polycarboxylic acid component other than the aliphatic dicarboxylic acid compound. Examples of the polycarboxylic acid component include: aromatic dicarboxylic acids such as phthalic acid, isophthalic acid, and terephthalic acid; aliphatic dicarboxylic acids such as sebacic acid, azelaic acid, n-dodecyl succinic acid, and n-dodecenyl succinic acid; alicyclic dicarboxylic acid such as cyclohexane dicarboxylic acid; polycarboxylic acids each having trivalent or more such as trimellitic acid and pyromellitic acid; and anhydrides and alkyl (having 1 to 3 carbon atoms) esters of those acids.

The alcohol component and the carboxylic acid component which form the crystalline polyester can be subjected to a condensation polymerization in an inert gas atmosphere by a reaction at 150 to 250° C. using, as required, an esterification catalyst.

As the wax used in the present invention, the followings are exemplified: aliphatic hydrocarbon-based waxes such as a low-molecular-weight polyethylene, a low-molecular-weight polypropylene, a low-molecular-weight olefin copolymer, a microcrystalline wax, a paraffin wax, and a Fischer-Tropsch wax; oxides of aliphatic hydrocarbon-based waxes such as a polyethylene oxide wax; waxes mainly formed of fatty acid esters, such as aliphatic hydrocarbon-based ester waxes; partially or wholly deacidified fatty acid esters such as a deacidified carnauba wax; partially esterified compounds of fatty acids and polyhydric alcohols such as behenic monoglyceride; and methyl ester compounds each having a hydroxyl group obtained by the hydrogenation of vegetable oil.

In the present invention, particularly preferably used wax is an ester wax because of, in the solution suspension method, ease with which a dispersion liquid of wax is produced, ease with which the wax is incorporated in the produced toner, exuding property from the toner upon fixation, and a releasing performance.

In the present invention, the ester wax only has to have at least one ester bond in one molecule, and may be a natural ester wax or a synthetic ester wax.

As the synthetic ester wax, monoester waxes each synthesized from a long, straight-chain saturated fatty acid and long, straight-chain saturated alcohol may be exemplified. The long, straight-chain saturated fatty acid is represented by the general formula $C_nH_{2n+1}COOH$ and a fatty acid in which n represents about 5 to 28 is preferably used. In addition, the long, straight-chain saturated alcohol is represented by $C_nH_{2n+1}OH$ and an alcohol in which n represents about 5 to 28 is preferably used.

Here, specific examples of the long, straight-chain saturated fatty acid include capric acid, undecylic acid, lauric acid, tridecylic acid, myristic acid, palmitic acid, pentadecylic acid, heptadecanoic acid, tetradecanoic acid, stearic acid, nonadecanoic acid, arachic acid, behenic acid, lignoceric acid, cerotic acid, heptacosanic acid, montanic acid, and melissic acid.

On the other hand, specific examples of the long, straight-chain saturated alcohol include amyl alcohol, hexyl alcohol, heptyl alcohol, octyl alcohol, caprylilc alcohol, nonyl alcohol, decyl alcohol, undecyl alcohol, lauryl alcohol, tridecyl alcohol, myristyl alcohol, pentadecyl alcohol, cetyl alcohol, heptadecyl alcohol, stearyl alcohol, nonadecyl alcohol, eiocsyl alcohol, ceryl alcohol, and heptadecanol.

In addition, examples of the ester wax having two or more ester bonds in one molecule include trimethylolpropane tribehenate, pentaerythritol tetrabehenate, pentaerythritol diacetate dibehenate, glycerin tribehenate, 1,18-octadecane diol-bis-stearate, and polyalkanol ester (tristearyl trimellitic acid, distearyl maleate)

In addition, examples of the natural ester waxes include candelila wax, carnauba wax, rice wax, haze wax, jojoba oil, bees wax, lanoline, castor wax, montan wax, and derivatives thereof.

In addition, examples of other modified waxes include: polyalkanoic acid amide(ethylene diamine dibehenyl amide); polyalkyl amide(trimellitic acid tristearyl amide); and dialkyl ketone (distearyl ketone).

Those waxes may be partially saponified.

Of those, preferred wax is a synthetic ester wax obtained from a long, straight-chain saturated fatty acid and a long, straight-chain saturated aliphatic alcohol or a natural wax mainly formed of the esters.

The reason therefor is not clear, but is presumed that the wax has a straight-chain structure, so mobility in a melting state may become large. That is, it is necessary for the wax to pass through between the substances which have relatively high polarity as a polyester which is binder resin and a reaction product formed of a diol and a diisocyanate on a surface layer upon fixing, and exude on the toner surface layer. Therefore, it may have an advantage to pass through between those substances each having high polarity that the wax has as a straight-chain structure as possible.

Further, the ester wax functions as an auxiliary agent for dispersing the magnetic substance in the toner, to thereby function advantageously to decrease aggregates and free substances.

Further, in the present invention, in addition to the straight-chain structure, the ester is preferred to be a monoester. As the same reason described above, the inventors suggest that, if the wax has such a bulky structure that ester bond is bound to respective branched chains, it might be difficult for the wax to exude on the surface by passing through the substances having high polarity such as polyester and the surface layer of the present invention.

In addition, in one of preferred embodiments of the present invention, a hydrocarbon-based wax other than the ester wax, as required, is used together.

Examples of the hydrocarbon-based wax other than the ester wax include: petroleum-based natural waxes such as a paraffin wax, a microcystalline wax, petrolatum, and derivatives thereof; synthetic hydrocarbons such as a Fischer-Tropsch wax, a polyolefin wax, and derivatives thereof (polyethylene wax, polypropylene wax) and natural waxes such as ozokerite and ceresin.

In the present invention, the content of the wax in the toner is preferably 3.0 to 15.0 mass % and more preferably 3.0 to 10.0 mass %. When the content of the wax falls within the above-mentioned range, releasing performance can be favorably kept while the heat-resistant storage stability of the toner is maintained.

In the present invention, the wax has a peak temperature of a maximum endothermic peak at preferably 60° C. or higher and 90° C. or lower in a measurement of differential scanning calorimetry (DSC). When the peak temperature of the maximum endothermic peak falls within the above-mentioned range, the wax is appropriately exposed to the toner surface and both the low-temperature fixability and the heat-resistant storage stability can be satisfied.

In the present invention, the toner base particle (A) may include a wax dispersion medium containing the following items i) and ii):

i) a copolymer synthesized by using a styrene-based monomer and one or two or more kinds of monomers selected from a nitrogen-containing vinyl monomer, a carboxyl group-containing monomer, a hydroxyl group-containing monomer, an acrylate monomer, and a methacrylate monomer; and ii) polyolefin.

The content of the wax dispersion medium is preferably 2.5 mass % or more and 10.0 mass % or less.

In addition, the wax dispersion medium is preferably a copolymer synthesized by using a styrene-based monomer and one or two or more kinds of monomers selected from a nitrogen-containing vinyl monomer, a carboxyl group-containing monomer, a hydroxyl group-containing monomer, an acrylate monomer, and a methacrylate monomer, and a grafted polyolefin.

In the present invention, a product obtained by melting and mixing, as a master batch, a dispersion liquid of wax in which an ester wax and the above-mentioned wax dispersion medium are dissolved into ethyl acetate is prepared. Then, it is preferred to add the obtained product to in the binder resin (a) mainly formed of a polyester upon preparing an oil phase as a wax dispersion master batch.

In addition, as the ester wax used in the present invention, the ester wax which has been dispersed finely in the dispersion liquid of wax beforehand is preferably used.

The wax dispersion medium has effects of improving not only dispersibility of the wax but also dispersibility of the magnetic substance. For exhibiting those effects sufficiently, the content of the wax dispersion medium in the toner base particle (A) is preferably 2.5 mass % or more and 10.0 mass % or less and more preferably 2.5 mass % or more and 7.5 mass % or less.

Next, the magnetic substance used in the present invention is described below.

As the magnetic substance used in the present invention, there are exemplified: iron oxides such as magnetite and ferrite; metals such as iron, cobalt, and nickel; alloys of those metals and metals such as aluminum, cobalt, copper, lead, magnesium, tin, zinc, antimony, beryllium, bismuth, cadmium, calcium, manganese, selenium, titanium, tungsten, and vanadium; and mixtures thereof.

The magnetic substance used in the present invention is produced by the following method, for example. A metal salt, a silicate, and the like are added to an aqueous solution of a ferrous salt. Thereafter an alkali such as sodium hydroxide is added in an amount equivalent or more with respect to an iron component. Thereby an aqueous solution containing ferrous hydroxide is prepared. Air is blown while the pH of the prepared aqueous solution is maintained at 7 or more (preferably pH 8 to 10), and an oxidation reaction of ferrous hydroxide is performed while the aqueous solution is heated to 70° C. or higher. Thus, a seed crystal serving as a core of a magnetic substance is first produced.

Next, an aqueous solution containing about equivalent of ferrous sulfate based on the amount of the alkali previously added is added to a slurry-like liquid containing the seed crystal. Thereafter, air is blown while the pH of the liquid is maintained at 6 to 10, and a reaction of ferrous hydroxide is advanced to grow the magnetic iron oxide particle with the seed crystal as a core. The method of producing the magnetic iron oxide is characterized by including proceeding an oxidation reaction in combination with adjustment of pH step by step. The oxidation reaction is proceeded step by step according to pH, for example, pH of 9 to 10 at an early stage of the reaction, pH of 8 to 9 at a middle stage of the reaction, and pH of 6 to 8 at a latter stage of the reaction. With the method, a composition ratio of the outermost surface of the magnetic iron oxide can be easily controlled. Note that although pH of the liquid moves toward acidic side with proceeding of the oxidation reaction, it is preferred to keep the pH of the liquid not to be less than 6.

As the salt other than sulfate to be added, a nitrate and a chloride may be used. In addition, as the silicate to be added, sodium silicate and potassium silicate are exemplified.

As the ferrous salt, an iron sulfate which is generally produced as a by-product upon the titanium production by sulfur acid method, and an iron sulfate which is produced as a by-product by surface washing of a copper plate can be used. Further, iron chloride can be also used.

For example, in producing the magnetic substance by an aqueous solution method, in general, a sulfate aqueous solution having iron concentration of 0.5 to 2 mol/l is used from the viewpoints of preventing increase in viscosity upon the reaction and of solubility of the iron sulfate. In general, the grain size of the product is apt to be finer with smaller concentration of iron sulfate. In the reaction, the product is easily formed into fine particles with larger air amount and lower reaction temperature.

In the present invention, preferably used is a magnetic substance having a spherical shape, an octahedral shape, or a hexahedral shape by observation of photographs with a transmission electron microscope. Mixed substances thereof can be also used.

In the present invention, the magnetic substance has the bulk density based on a measurement method described below of preferably 0.3 to 2.0 g/cm$^3$ and more preferably 0.5 to 1.3 g/cm$^3$. When the bulk density falls within the above-mentioned range, toner is excellent in mixing property with another constituting material upon producing the toner, and thus the dispersibility of the toner is improved.

In the present invention, the magnetic substance has a BET specific surface area, based on the measurement method described below, of preferably 15.0 m$^2$/g or less and more preferably 12.0 m$^2$/g or less, and further, preferably 3.0 m$^2$/g or more and more preferably 5.0 m$^2$/g or more. When the BET specific surface area of the magnetic substance falls with in the range, moisture adsorption of the magnetic substance can be controlled and charging performance of the magnetic toner can be favorably maintained.

In the present invention, as magnetic characteristics of the magnetic substance, the magnetization in the magnetic field of 79.6 kA/m is preferably 10 to 200 Am$^2$/kg and more preferably 50 to 100 Am$^2$/kg. In addition, the residual magnetization is preferably 1 to 100 Am$^2$/kg and more preferably 2 to 20 Am$^2$/kg. Further, coercive force is preferably 1 to 30 kA/m and more preferably 2 to 15 kA/m. The magnetic substance has those magnetic characteristics, so the magnetic toner can obtain favorable developing performance while keeping balance between image density and fogging.

In the present invention, the magnetic substance has the number average particle diameter of preferably 0.10 μm or more and 0.30 μm or less, based on the measurement method described below. More preferred is 0.15 μm or more and 0.25 μm or less. When the magnetic substance satisfies the above-mentioned range, it is favorable in terms of dispersibility of the magnetic substance in the binder resin (a), charge uniformity of toner, coloring performance of toner, and tinges can be obtained. Further, the magnetic substance used in the present invention has the variation coefficient of preferably 50% or less based on the number of particles. By adjusting the variation coefficient to the above-mentioned range, dispersibility of the magnetic substance can be improved and the toner excellent in tinges can be obtained.

The number average particle diameter and the variation coefficient of the magnetic substance can satisfy the above-mentioned range by adjusting temperature and treatment time upon producing the magnetic substance.

The magnetic substance is included in an amount of preferably 30 parts by mass or more and 120 parts by mass or less with respect to 100 parts by mass of the binder resin (a). More preferred is 40 parts by mass or more and 110 parts by mass or less. When the content of the magnetic substance is small, coloring performance is insufficient and magnetization of the toner lowers, and hence restraint force of the magnetic substance in the toner carrying member lowers. As a result, problems such as scattering and fogging tends to occur. On the other hand, when a large amount of the magnetic substance is included, it becomes difficult to control dispersion of the magnetic substance in the toner particles. In addition, dissolution characteristics of the toner changes, fixability at low temperature worsen, and problems such as low-temperature offset and insufficient gloss tends to occur.

The toner of the present invention includes the magnetic substance and exhibit a black color. However, the toner of the present invention may be used in combination with another black colorant. In addition, another colorant can be used together for adjusting tinges.

As the another black colorant, organic pigments such as carbon black and aniline black, and metal oxides such as nonmagnetic, black complex oxides can be also used together. As the carbon black, the followings are exemplified: carbon black such as a furnace black, a channel black, an acetylene black, a thermal black, or a lamp black.

In particular, when a rufescent magnetic substance is used, it is effective to use the magnetic substance with addition of a blue or cyan-based colorant.

As the cyan-based colorant, a pigment or a dye may be used. As the pigment, specifically, the following pigments are exemplified: C.I. Pigment Blue 1, 7, 15, 15:1, 15:2, 15:3, 15:4, 16, 17, 60, 62, and 66; C.I. Vat Blue 6, and C.I. Acid Blue 45. As the dye, the following dyes are exemplified: C.I. Solvent Blue 25, 36, 60, 70, 93, and 95. Those may be added alone, or two or more kinds of them may be added in combination.

In the case where the toner is produced by the solution suspension method, it is not preferred to use, as a colorant, a dye or pigment which has extremely high solubility to water. When the dye or the pigment is used, the dye or the pigment is dissolved into water upon the production process of the toner, granulation may be jumbled, and desired coloring may not be obtained.

In the present invention, a charge control agent may be used as required. The charge control agent may be incorporated in the toner base particle (A) or the surface layer (B).

As the charge control agent, the followings are exemplified: nigrosin-based dyes, triphenyl methane-based dyes, gold-containing azo complex dyes, molybdic acid chelate pigments, rhodamine-based dyes, alkoxy-based amines, quaternary ammonium salts (including fluorine-modified quaternary ammonium salt), alkyl amides, a single body or compounds of phosphorus, a single body or compounds of tungsten, fluorine-based activators, metal salts of salicylic acid, and metal salts of salicylic acid derivatives.

Specifically, the followings are exemplified. BONTRON N-03 which is a nigrosin-based dye, BONTRON P-51 which is a quaternary ammonium salt, BONTRON S-34 which is a gold-containing azo dye, E-82 which is an oxynaphthoic acid-based metal complex, E-84 which is a salicylic acid-based metal complex, E-89 which is a phenol-based condensate (all of which are manufactured by Orient Chemical Industries), TP-302 and TP-415 which are quaternary ammonium salt molybdenum complexes (all of which are manufactured by HODOGAYA CHEMICAL CO., LTD.), Copy Charge PSYVP2038 which is a quaternary ammonium salt, Copy Blue PR which is a triphenyl methane derivative, Copy Charge NEG VP2036 and Copy Charge NXVP434 which are a quaternary ammonium salt (all of which are manufactured by Hoechst AG.), LRA-901, LR-147 which is a boron complex (manufactured by Japan Carlit Co., Ltd), copper phthalocyanine, perylene, quinacridone, azo-based pigments, and polymer-based compounds having a sulfonic group, a carboxyl group, a quaternary ammonium salt, and the like as functional groups.

Next, the surface layer (B) incorporated in the toner of the present invention is described.

The surface layer (B) includes the resin (b). The resin (b) includes a resin selected from the group consisting of the polyester resin (b1), the vinyl resin (b2), and the urethane resin (b3). As the resin (b), there is no harm in using two or more kinds of the resins in combination.

The resin (b) has preferably at least one functional group, at a side chain, selected from the group consisting of a carboxyl group, a sulfonic group, a carboxylate, and a sulfoante.

In particular, it is preferred that the resin (b) include a sulfonic group, and the sulfonic group value of the resin (b) is 1 mgKOH/g or more and 25 mgKOH/g or less.

In order to decrease the melt viscosity of the surface layer (B), the polyester resin (b1) or the urethane resin (b3) each having polyester as a constituent element is preferred. In addition, the resin (b) particularly preferably includes the urethane resin (b3) which is a compound formed of urethane bonds in terms of appropriate affinity to a solvent, ease with which water dispersibility and the viscosity are adjusted, and ease with which the particle diameters are uniformed.

The glass transition temperature Tg(b) of the resin (b) used in the present invention is larger than the glass transition temperature Tg(a) of the binder resin (a). For setting the glass transition temperature Tg(b) to a predetermined value, the kind of monomer, the molecular weight, and the branched structure of the resin (b) are preferably controlled. Tg(b) is preferably 50° C. or higher and 100° C. or lower. Further, 55° C. or higher and 90° C. or lower is more preferred. When the Tg(b) falls within the above-mentioned range, the heat-resistant storage stability can be improved without deteriorating the low-temperature fixability.

As the polyester resin (b1), the same raw materials as for the binder resin (a) may be used and may be produced in the same manner as for the binder resin (a). However, in the case where the polyester resin (b1) is produced by the solution suspension method, when raw materials which are easily dissolved into the solvent are used, it is difficult to maintain the shape as the toner particles upon the granulation step or shell constitution. Therefore, a monomer having high polarity is preferably introduced.

The polyester resin (b1) has preferably a sulfonic group. The polyester resin (b1) has the sulfonic group value of 1 mgKOH/g or more and 25 mgKOH/g or less, and more preferably 10 mgKOH/g or more and 25 mgKOH/g or less.

The vinyl resin (b2) is a polymer obtained by homopolymerizing or copolymerizing vinyl-based monomers. As the vinyl-based monomers to be used, the following monomers are exemplified.

(1) Vinyl-based hydrocarbons:

(1-1) Aliphatic vinyl-based hydrocarbons: alkenes such as ethylene, propylene, butene, isobutylene, pentene, heptene, diisobutylene, octene, dodecene, octadecene, and α-olefines other than the above alkenes; alkadienes such as butadiene, isoprene, 1,4-pentadiene, 1,6-hexadiene, and 1,7-octadiene.

(1-2) Alicyclic vinyl-based hydrocarbons: mono- or di-cycloalkenes and alkadienes such as cyclohexene, cyclopentadiene, dicyclopentadiene vinylcyclohexene, and ethylidene bicycloheptene; and terpenes such as pinene, limonene, and indene.

(1-3) Aromatic vinyl-based hydrocarbons: styrene and its hydrocarbil (alkyl, cycloalkyl, aralkyl and/or alkenyl) substituents such as α-methyl styrene, vinyltoluene, 2,4-dimethyl styrene, ethyl styrene, isopropyl styrene, butylstyrene, phenyl styrene, cyclohexyl styrene, benzyl styrene, chlotyl benzene, divinyl benzene, divinyl toluene, divinyl xylene, trivinyl benzene; and vinyl naphthalene.

(2) Carboxyl group-containing vinyl-based monomers and metal salts thereof:

unsaturated monocarboxylic acids each having 3 to 30 carbon atoms, unsaturated dicarboxylic acids, its anhydrides, and its monoalkyl (having 1 to 24 carbon atoms) esters, for example, carboxyl group-containing vinyl-based monomers such as acrylic acid, methacrylic acid, maleic acid, maleic anhydrides, monoalkyl maleates, fumaric acid, monoalkyl fumarates, crotonic acid, itaconic acid, monoalkyl itaconates, itaconic acid glycol monoethers, citraconic acid, monoalkyl citraconate and cinnamic acid.

(3) Sulfonic group-containing vinyl-based monomers, vinyl-based sulfonic monoesterification products, and salts thereof:

alkene sulfonic acids having 2 to 14 carbon atoms such as vinyl sulfonic acid, acryl sulfonic acid, methacryl sulfonic acid, methyl vinyl sulfonic acid, and styrene sulfonic acid; alkyl derivatives each having 2 to 24 carbon atoms such as α-methyl styrene sulfonic acid; sulfo(hydroxy)alkyl-acrylates or acryl amides, sulfo(hydroxy) alkyl-methacrylates or methacryl amides, such as sulfopropyl acrylate, sulfopropyl methacrylate, 2-hydroxy-3-acryloxypropyl sulfonate, 2-hydroxy-3-methacyloxypropyl sulfonate, 2-acryloylamino-2,2-dimethylethane sulfonate, 2-methacryloylamino-2,2-dimethylethane sulfonate, 2-acryloyloxyethane sulfonate, 2-methacryloyloxyethane sulfonate, 3-acryloyloxy-2-hydroxypropane sulfonate, 3-methacryloyloxy-2-hydroxypropane sulfonate, 2-acrylamide-2-methylpropane sulfonate, 2-methacrylamide-2-methylpropane sulfonate, 3-acrylamide-2-hydroxypropane sulfonate, 3-methacrylamide-2-hydroxypropanesulfonate, alkyl (having 3 to 18 carbon atoms) allyl sulfosuccinate, sulfate ester [poly (n=5 to 15) oxypropylene monomethacrylate sulfonate and the like] of poly(n=2 to 30)oxyalkylene (ethylene, propylene, butylene: single, random, or block polymer) monoacrylate or monomethacrylate, polyoxyethylene polycyclic phenyl ether sulfate ester, and sulfate esters or sulfonic group-containing monomer represented by the following formulae (1-1) to (1-3); and their salts.

[Chem. 1]

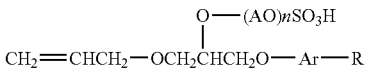

(1-1)

-continued

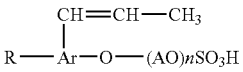

(1-2)

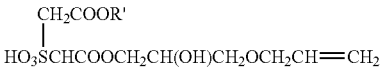

(1-3)

In the formulae (1-1) to (1-3): R represents an alkyl group having 1 to 15 carbon atoms; A represents an alkylene group having 2 to 4 carbon atoms; if n represents 2 or more, A's may be the same as or different from each other, and if A's are different from each other, $(AO)_n$ may be a random polymer or a block polymer; Ar represents a benzene ring; n represents an integer of 1 to 50; R' represents an alkyl group having 1 to 15 carbon atoms which may be substituted with a fluorine atom.

The vinyl resin (b2) has preferably a sulfonic group. The sulfonic group value of the vinyl resin (b2) is preferably 1 mgKOH/g or more and 25 mgKOH/g or less and more preferably 10 mgKOH/g or more and 25 mgKOH/g or less.

The urethane resin (b3) is a reaction product of a diol component and a diisocyanate component, which are prepolymers. By adjusting the diol component and the diisocyanate components, a resin having various functions can be obtained.

Examples of the diisocyanate component described above include the following diisocyanates.

An aromatic diisocyanate having 6 to 20 carbon atoms (excluding the carbon atoms in the NCO groups, the same holds true for the following), an aliphatic diisocyanate having 2 to 18 carbon atoms, an alicyclic diisocyanate having 4 to 15 carbon atoms, an aromatic hydrocarbon diisocyanate having 8 to 15 carbon atoms, and a modified product of each of these diisocyanates (modified product containing a urethane, carbodiimide, allophanate, urea, burette, urethodione, urethoimine, isocyanurate, or oxazolidone group, hereinafter referred to as "modified diisocyanate"), and a mixture of two or more kinds of them.

Examples of the aromatic diisocyanate are as follows: 1,3-phenylene diisocyanate, 1,4-phenylene diisocyanate, 1,5-naphthylene diisocyanate, 2,4-tolylene diisocyanate, 2,6-tolylene diisocyanate (TDI), 2,4'-diphenylmethane diisocyanate, and 4,4'-diphenylmethane diisocyanate (MDI).

Examples of the aliphatic diisocyanate are as follows: ethylene diisocyanate, tetramethylene diisocyanate, hexamethylene diisocyanate (HDI), dodecamethylene diisocyanate, 1,6,11-undecane triisocyanate, 2,2,4-trimethylhexamethylene diisocyanate, lysine diisocyanate, 2,6-diisocyanatomethyl caproate, bis(2-isocyanatoethyl)fumarate, bis(2-isocyanatoethyl)carbonate, and 2-isocyanatoethyl-2,6-diisocyanatohexanoate.

Examples of the alicyclic diisocyanate are as follows: isophorone diisocyanate (IPDI), dicyclohexylmethane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, 2,5-norbornane diisocyanate, and 2,6-norbornane diisocyanate.

Examples of the aromatic hydrocarbon diisocyanate are as follows: m-xylylene diisocyanate, p-xylylene diisocyanate (XDI), and α,α,α',α'-tetramethyl xylylene diisocyanate (TMXDI).

Examples of the modified diisocyanate include modified products of isocyanates such as modified MDI (urethane-modified MDI, carbodiimide-modified MDI, or trihydrocarbyl phosphate-modified MDI) and urethane-modified TDI, and a mixture of two or more kinds of them [such as a combination of modified MDI and urethane-modified TDI (isocyanate-containing prepolymer)].

Of those, an aromatic diisocyanate having 6 to 15 carbon atoms, an aliphatic diisocyanate having 4 to 12-carbon atoms, and an alicyclic diisocyanate having 4 to 15 carbon atoms are preferable. HDI, XDI, and IPDI are particularly preferable.

In addition, as the urethane resin (b3) in the resin (b), an isocyanate compound having three or more functional groups may be used in addition to the above-mentioned diisocyanate components. Examples of the isocyanate compound having three or more functional groups include polyallyl polyisocyanate (PAPI), 4,4',4"-triphenylmethane triisocyanate, m-isocyanato phenylsulfonyl isocyanate, and p-isocyanato phenyl sulfonyl isocyanate.

In addition, as the diol component that can be used in the urethane resin (b3), the followings are exemplified: alkylene glycols (ethyleneglycol, 1,2-propylene glycol, 1,3-propylene glycol, 1,4-butane diol, 1,6-hexane diol, octane diol, decane diol, dodecane diol, tetradecane diol, neopentyl glycol, and 2,2-diethyl-1,3-propanediol); alkylene ether glycols (diethylene glycol, triethyleneglycol, dipropyleneglycol, polyethyleneglycol, polypropylene glycol, and polytetramethylene ether glycol); alicyclic diols (1,4-cyclohexane dimethanol, hydrogenated bisphenol A, and the like); bisphenols (bisphenol A, bisphenol F, bisphenol S, and the like); alkylene oxide (ethylene oxide, propylene oxide, butylene oxide, and the like) adducts of the alicyclic diol; alkylene oxide (ethylene oxide, propylene oxide, butylene oxide, and the like) adducts of the bisphenols; and polylactone diols (poly ∈-caprolactonediol and the like) and polybutadiene diol. The alkyl parts of the alkylene ether glycol may be a straight chain, or a branched chain. In the present invention, alkylene glycol having a branched structure is preferably used.

Of those, preferred is an alkyl structure in view of solubility (affinity) to ethyl acetate, and an alkylene glycol having 2 to 12 carbon atoms is preferably used.

In the urethane resin, in addition to the diol components, a polyester oligomer having a hydroxy group at a terminal (polyester oligomer having terminal diol) is also favorably used as a diol component.

In this time, the molecular weight (number average molecular weight) of the polyester oligomer having terminal diol is preferably 3,000 or less and more preferably 800 or more and 2,000 or less.

When the molecular weight of the polyester oligomer having terminal diol exceeds the above molecular weight, reactivity with a compound having isocyanate at a terminal lowers. As a result, properties of the polyester becomes too strong to be soluble to ethyl acetate.

In addition, the content of the polyester oligomer having terminal diol, in monomers constituting the reaction product of the diol component and the diisocyanate component, is preferably 1 mol % or more and 10 mol % or less and more preferably 3 mol % or more and 6 mol % or less.

When the content of the polyester oligomer having terminal diol exceeds 10 mol % or more, the reaction product of the diol component and the diisocyanate component becomes soluble to ethyl acetate in some cases.

On the other hand, when the content of the polyester oligomer having terminal diol is less than 1 mol %, the reaction product of the diol component and the diisocyanate component becomes thermally too solid to inhibit fixing performance or to decrease affinity to the binder resin (a), resulting in difficulty in forming a surface layer in some cases.

It is preferred that a polyester skeleton of the polyester oligomer having terminal diol and a polyester skeleton of the binder resin (a) be the same for forming favorable capsule type toner particles. The reason is related with affinity between the reaction product of the diol component and the diisocyanate component on the surface layer and toner base particle (core).

In addition, the polyester oligomer having terminal diol may have an ether bond modified with ethylene oxide, propylene oxide, or the like.

The urethane resin may include together, in addition to the reaction product of the diol component and the diisocyanate component, a compound connected with a reaction product of an amino compound and an isocyanate compound by a urea bond.

Examples of the amino compound include: diamines such as diaminoethane, diaminopropane, diaminobutane, diaminohexane, piperazine, 2,5-dimethyl piperazine, amino-3-aminomethyl-3,5,5-trimethyl cyclohexane (isophoronediamine, IPDA), 4,4'-diaminodicyclohexyl methane, 1,4-diaminocyclohexane, aminoethyl ethanol amine, hydrazine, and hydrazine hydrate; and triamines such as triethyl amine, diethylene triamine, and 1,8-diamino-4-aminomethyl octane.

The urethane resin may include together, in addition to the above compounds, with a reaction product of an isocyanate compound and a compound having a group containing highly-reactive hydrogen such as a carboxylic group, a cyano group, and a thiol group.

The urethane resin includes preferably a carboxylic group, a sulfonic group, a carboxylate, or a sulfonate at a side chain. Thus, an aqueous dispersion liquid is easily formed, and the resin is effective to form a capsule type structure stably without melting in a solvent of an oil phase. The resin can be easily produced by introducing a carboxylic group, a sulfonic group, a carboxylate, or a sulfonate into a side chain of the diol component or the diisocyanate component.

Examples of the diol component introduced with a carboxylic group or a carboxylate at a side chain include dihydroxyl carboxylates such as dimethylol acetate, dimethylol propionate, dimethylol butanoate, dimethylol butyrate, and dimethylol pentanoate, and metal salts thereof.

On the other hand, examples of the diol component introduced with a sulfonic group or a sulfonate at a side chain include sulfoisophthalate, N,N-bis(2-hydroxyethyl)-2-aminoethane sulfonate, and metal salts thereof.

The content of the diol component introduced with a carboxylic group, a sulfonic group, a carboxylate, or a sulfonate at a side chain is preferably 10 mol % or more and 50 mol % or less, and more preferably 20 mol % or more and 30 mol % or less, with respect to all monomers forming the reaction product of the diol component and the diisocyanate component.

When the content of the diol component is less than 10 mol %, dispersibility of resin fine particles described below is apt to deteriorate, and granulation property is impaired in some cases. On the other hand, when the content of the diol component is more than 50 mol %, the reaction product of the diol component and the diisocyanate component may be dissolved into an aqueous media, and may not exert functions as a dispersant.

The surface layer (B) is preferably a layer formed by using resin fine particles including the resin (b). A method of preparing the above resin fine particles is not particularly limited, and is an emulsion polymerization method or a method involving: dissolving the resin in a solvent, or melting the resin, to liquefy the resin; and suspending the liquid in the aqueous medium to granulate the liquid.

In the preparation of the resin fine particles, a known surfactant or dispersant can be used , or the resin of which each of the resin fine particles is formed can be provided with self-emulsifying property.

Examples of the solvent that can be used when the resin fine particles are prepared by dissolving the resin in the solvent include, but not particularly limited to, the following solvents. Hydrocarbon-based solvents such as ethyl acetate, xylene, and hexane, halogenated hydrocarbon-based solvents such as methylene chloride, chloroform, and dichlorethane, ester-based solvents such as methyl acetate, ethyl acetate, butyl acetate, and isopropyl acetate, ether-based solvents such as diethyl ether, ketone-based solvents such as acetone, methyl ethyl ketone, diisobutyl ketone, cyclohexanone, and methylcyclohexane, and alcohol-based solvents such as methanol, ethanol, and butanol.

In addition, in the case of preparing the resin fine particles, a production method using resin fine particles each containing the reaction product of the diol component and the diisocyanate component as a dispersant is one of a preferred embodiment. With the production method, the prepolymer having the diisocyanate component is produced, the resultant is rapidly dispersed in water, and subsequently, the diol component is added thereto, whereby the side chain is extended or crosslinked.

That is, the following method can be suitably used for producing the reaction product of the diol component and the diisocyanate component having desired physical properties: a prepolymer having an diisocyanate component, and, as required, any other necessary component are dissolved or dispersed in a solvent having high solubility in water such as acetone or an alcohol out of the above solvents, the resultant is then charged into water to disperse the prepolymer having a diisocyanate component rapidly, and subsequently, the diol component is added.

The number average particle diameter of the resin fine particles including the resin (b) is preferably 30 nm or more and 100 nm or less in order that the toner particles form a capsule structure. When the number average particle diameter falls within the above-mentioned range, high granulation stability can be obtained, and coalescence of particles with each other or generation of deformed particles can be prevented. In addition, forming of a capsule structure becomes easy and toner having particularly favorable heat-resistant storage stability can be obtained.

Hereinafter, easy preparation method for toner particles used in the present invention is described, but is not limited thereto.

The toner particles is obtained preferably as follows: in an aqueous media (hereinafter, may be referred to as aqueous phase) in which the resin fine particles containing the resin (b) are dispersed, a dissolved product or a dispersion product (hereinafter, may be referred to as oil phase) is dispersed, the dissolved product or the dispersion product being obtained by dispersing at least the binder resin (a) mainly formed of a polyester, the magnetic substance, and the wax in an organic medium; the organic medium is removed from the obtained dispersion liquid; and the resultant is dried.

In the above-mentioned system, the resin fine particles function as a dispersant when the dissolved product or the dispersion product (oil phase) is suspended in the aqueous phase. The toner particles are prepared by the above-mentioned method, whereby capsule type toner particles can be easily obtained without requiring an aggregation process on the toner surface.

In the preparation method for the oil phase, as the organic medium dissolving the binder resin (a) and the like, the followings are exemplified: hydrocarbon-based solvents such as ethyl acetate, xylene, and hexane, halogenated hydrocarbon-based solvents such as methylene chloride, chloroform, and dichlorethane, ester-based solvents such as methyl acetate, ethyl acetate, butyl acetate, and isopropyl acetate, ether-based solvent such as diethyl ether, and ketone-based solvents such as acetone, methyl ethyl ketone, diisobutyl ketone, cyclohexanone, and methyl cyclohexane.

The binder resin (a) is used preferably in a form of the dispersion liquid of resin in which the resin is dissolved into the organic medium. In this case, the binder resin (a) is blended in the organic medium as a resin component in the range of preferably 40 mass % to 60 mass %, which depends on viscosity and solubility of the resin, in view of easy production in the next step. In addition, it is preferred to heat the resin at a boiling point of the organic medium or lower upon dissolving the resin because the solubility of the resin is increased.

The wax and the magnetic substance are also preferred in a form of being dispersed in the organic medium. The organic medium as described above is used. That is, a dispersion liquid of wax and a dispersion liquid of magnetic substance are prepared preferably by dispersing a wax or a magnetic substance pulverized mechanically beforehand by a wet method or a dry method in the organic medium.

Note that the dispersibility of the wax and the magnetic substance can be increased by adding a dispersant or a resin matching to each of the wax and the magnetic substance. The dispersant and the resin vary depending on the wax, the magnetic substance, the resin, and the organic solvent to be used, and may be used by selecting them appropriately. The magnetic substance is preferably used after being dispersed beforehand in the organic medium together with the binder resin (a). In particular, the dissolved product or the dispersion product are prepared preferably by dispersing the magnetic substance beforehand in the organic medium together with a part of the binder resin (a) and then mixing the resultant with the residual binder resin (a) and the wax.

The oil phase can be prepared by blending each of dispersion liquid of resin, the dispersion liquid of wax, the dispersion liquid of magnetic substance, and the organic medium in a desired amount and dispersing each component in the organic medium.

Hereinafter, preparation method for the dispersion liquid of magnetic substance is described in more detail with examples.

In the present invention, to increase dispersibility of the magnetic substance, the following techniques were used.

(1) Wet Dispersion (Media Dispersion)

This method involves dispersing the magnetic substance in a solvent in the presence of a media for dispersion. For example, the magnetic substance, the resin, another additive, and the organic solvent are mixed, and the mixture is then dispersed using a dispersing machine in the presence of the media for dispersion. The media for dispersion is collected and a dispersion liquid of magnetic substance is obtained. As the dispersion machine, Attritor (MITSUI MIIKE MACHINERY Co., Ltd.) is used, for example. As the media for dispersion, beads of alumina, zirconia, glass and iron are exemplified and zirconia beads which hardly cause media contamination are preferred. In this case, the bead diameter is preferably 2 mm to 5 mm because of excellent in dispersibility.

(2) Dry Kneading

The resin, the magnetic substance, another additive are melt-kneaded with a kneader and a roll-type dispersion machine. The obtained melt-kneaded product of the resin and the magnetic substance are pulverized, and dissolved into the organic medium, whereby the dispersion liquid of magnetic substance is obtained.

The following techniques are effective for increasing dispersibility of the magnetic substance additionally.

(3) Wet Dispersion of Dry Melt-kneaded Product

The dispersion liquid of magnetic substance produced using the obtained melt-kneaded product of the resin and the magnetic substance by the above-mentioned dry kneading is subjected to a wet dispersion using the media for dispersion and the dispersing machine.

(4) Addition of Solvent in Producing Dry Melt-kneaded Product

A solvent is added in producing the dry melt-kneaded product. The temperature upon the melt-kneading is preferably equal to or higher than a glass transition temperature (Tg) of the resin, and equal to or lower than the boiling point of the solvent. The solvent to be used is preferably a solvent capable of dissolving the resin, and preferably a solvent used in the oil phase.

(5) Addition of Wax in Producing Dry Melt-kneaded Product

A wax is added in producing the dry melt-kneaded product. The temperature upon the melt-kneading is preferably equal to or higher than the glass transition temperature (Tg) of the resin, and equal to or lower than the boiling point of the solvent. The wax to be used may be a wax that can be dissolved into the oil phase, and another wax having relatively high melting point may also be used.

(6) Resin Having High Affinity to Magnetic Substance is Used as Resin

As the resin used in producing the dry melt-kneaded product, a resin having high affinity to the magnetic substance is used. For example, for the binder resin (a) mainly formed of a polyester, at least two kinds of resins (a1) and (a2) are used. The magnetic substance is dispersed with the resin (a2), the one of the resins. Here, a resin synthesized from at least an aliphatic diol is used as the resin (a1), a crystalline polyester or a resin synthesized from at least an aromatic diol is used as the resin (a2).

Further, a fine dispersion process by a ultrasonic wave after mixing of each dispersion liquid is effective. In this case, an agglomerate of the magnetic substance in the dispersion liquid after oil phase preparation looses and the each dispersion liquid can be further finely dispersed.

The aqueous dispersion medium includes water alone and a solvent which is miscible with water may also be used together. Examples of the solvent which is miscible with water include alcohols (methanol, isopropanol, ethylene glycol), dimethyl formamide, tetrahydrofuran, cellosolves (methyl cellosolve), and lower ketones (acetone, methyl ethyl ketone). In addition, a preferred method includes mixing the organic medium used as the oil phase inappropriate amount in the aqueous media used in the present invention. This method is presumed to have such effects that droplet stability during granulation is increased and the oil phase is easily suspended in the aqueous medium.

In the production of the toner of the present invention, it is preferred to use the resin fine particles containing the resin (b) dispersed in the aqueous medium. The resin fine particles containing the resin (b) are blended in a desired amount according to stability of the oil phase in the next step and capsulation of the toner base particle. When the resin fine particles are used for forming the surf ace layer (B), the use amount of the resin fine particles is preferably 2.0 parts by mass or more and 15.0 parts by mass or less with respect to 100 parts by mass of the toner base particle (A).

A known surfactant, dispersant, dispersion stabilizer, water-soluble polymer, or viscosity modifier can be added to the aqueous medium.

Examples of the surfactant include an anionic surfactant, a cationic surfactant, an amphoteric surfactant, and a nonionic surfactant. Each of the surfactants can be appropriately selected in association with polarity upon formation of the toner particles.

Specific examples of the surfactants include anionic surfactants such as alkylbenzene sulfonate, α-olefin sulfonate, and phosphate; cationic surfactants including amine salt type surfactants such as alkyl amine salts, amino alcohol fatty acid derivatives, polyamine fatty acid derivatives, and imidazoline, and quaternary ammonium salt type surfactants such as alkyltrimethyl ammonium salts, dialkyldimethyl ammonium salts, alkyldimethylbenzyl ammonium salts, pyridinium salts, alkylisoquinolinium salts, and benzethonium chloride; nonionic surfactants such as fatty acid amide derivatives and polyalcohol derivatives; and amphoteric surfactants such as alanine, dodecyldi(aminoethyl)glycine, di(octylaminoethyl) glycine, and N-alkyl-N,N-dimethyl ammonium betaine.

Examples of the dispersant are as follows: acids such as acrylic acid, methacrylic acid, α-cyano acrylic acid, α-cyano methacrylic acid, itaconic acid, crotonic acid, fumaric acid, maleic acid, and maleic anhydride; acrylic monomers or methacrylic monomers each having a hydroxy group such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylol acrylamide, and N-methylol methacrylamide; vinyl alcohols, or ethers of vinyl alcohols such as vinylmethyl ether, vinylethyl ether, and vinylpropyl ether; esters of a compound containing a vinyl alcohol and a carboxy group such as vinyl acetate, vinyl propionate, and vinyl butyrate; acrylamide, methacrylamide, diacetone acrylamide, and methylol compounds thereof; acid chlorides such as acryloyl chloride and methacryloyl chloride; homopolymers or copolymers of substances each having a nitrogen atom or a heterocycle containing the nitrogen atom such as vinyl pyridine, vinyl pyrrolidone, vinyl imidazole, and ethylene imine; polyoxyethylenes such as polyoxyethylene, polyoxypropylene, polyoxyethylene alkyl amine, polyoxypropylene alkyl amine, polyoxyethylene alkyl amide, polyoxypropylene alkyl amide, polyoxyethylene nonylphenyl ether, polyoxyethylene laurylphenyl ether, polyoxyethylene stearylphenyl ester, and polyoxyethylene nonylphenyl ester; and celluloses such as methyl cellulose, hydroxyethyl cellulose, and hydroxypropyl cellulose.

When a dispersant is used, the dispersant, which may remain on the surface of each toner particle, is preferably removed by dissolution and washing in terms of the charging of the toner.

In the present invention, a dispersion stabilizer is preferably used. The reason is as follows: an organic medium in which the binder resin (a) as a main component of the toner is dissolved has a high viscosity. Therefore the dispersion stabilizer should be used to surround droplets formed by the fine dispersion of the organic medium by a high shear force. Consequently the reagglomeration of the droplets is prevented and the droplets is stabilized.

Each of an inorganic dispersion stabilizer and an organic dispersion stabilizer can be used as the dispersion stabilizer.

The inorganic dispersion stabilizer is preferably as follows: the stabilizer can be removed by any one of the acids each having no affinity for the solvent such as hydrochloric acid because the toner particles are granulated in a state where the stabilizer adheres onto the surface of each of the particles after the dispersion. For example, calcium carbonate, calcium chloride, sodium hydrogen carbonate, potassium hydrogen carbonate, sodium hydroxide, potassium hydroxide, hydroxyapatite, or calcium triphosphate can be used.

A dispersion method used in preparing the toner particles is not particularly limited, and a general-purpose apparatus such as a low-speed shearing type, high-speed shearing type, friction type, high-pressure jet type, or ultrasonic can be used; a high-speed shearing type is preferable in order that dispersed particles may each have a particle diameter of about 2 μm to 20 μm.

The stirring apparatus having a rotating blade is not particularly limited, and any apparatus can be used as long as the apparatus is generally used as an emulsifier or a dispersing machine in the dispersion method. Examples of the apparatus include: continuous emulsifiers such as Ultraturrax (manufactured by IKA), POLYTRON (manufactured by KINEMATICA Inc), TK Autohomomixer (manufactured by Tokushu Kika Kogyo), Ebaramilder (manufactured by EBARA CORPORATION), TK Homomic Line Flow (manufactured by Tokushu Kika Kogyo), Colloid Mill (manufactured by Shinko Pantec Co., Ltd.), Slasher, Trigonal Wet Pulverizer (manufactured by Mitsui Miike Machinery Co., Ltd.), Cavitron (manufactured by EuroTec), and Fine Flow Mill. (manufactured by Pacific Machinery & Engineering Co., Ltd.); and batch type or continuous duplex emulsification machine such as CLEAR MIX (manufactured by MTECHNIQUE Co., Ltd.) and Filmix (manufactured by Tokushu Kika Kogyo).

When a high-speed shearing type dispersing machine is used in the dispersion method, the number of revolutions of the machine, which is not particularly limited, is typically about 1,000 rpm to 30,000 rpm, and preferably 3,000 rpm to 20,000 rpm.

In the case of a batch type dispersing machine, the time period for dispersion in the dispersion method is typically 0.1 minute to 5 minutes. The temperature at the time of the dispersion is typically 10° C. to 150° C. (under pressure), or preferably 10° C. to 100° C.

The following method can be adopted for removing an organic solvent from the resultant dispersion liquid: the temperature of the entire system is gradually increased so that the organic solvent in each droplet is completely evaporative removal.

Alternatively, the following method can also be adopted: the dispersion liquid is sprayed in a dry atmosphere, a water-insoluble organic solvent in each droplet is completely removed, then toner particles are formed, and, together with the formation, water in the dispersion liquid is evaporative removal.

In that case, the dry atmosphere in which the dispersion liquid is sprayed is, for example, a gas obtained by heating the air, nitrogen, a carbon dioxide gas, or a combustion gas, and in particular, various air streams heated to temperatures equal to or higher than the boiling point of a solvent having the highest boiling point out of the solvents to be used are generally used. The treatment using any one of a spray dryer, a belt dryer, or a rotary kiln and so on for a short time period provides sufficient target quality.

When the dispersion liquid obtained by the dispersion method shows a wide grain size distribution, and is subjected to washing and drying treatments while the grain size distribution is maintained, the grain size distribution can be ordered by classifying the toner particles so that the particles have a desired grain size distribution.

The dispersant used in the dispersion method is preferably removed from the resultant dispersion liquid. The removal is more preferably performed simultaneously with the classification operation.

In the production method, after the organic solvent has been removed, a heating process may be further provided. By providing the heating process, the toner particle surfaces can be smoothed and spherical degree of the toner particle surfaces can be adjusted.

In the classification operation, a fine particle part can be removed in the liquid by a cyclone, a decanter, a centrifugation, or the like. Of course, the classification may be performed after obtaining powders after drying, but the classification in the liquid is preferred from an aspect of efficiency.

Unnecessary fine particles or coarse particles obtained in the classification operation may be subjected to the dissolving process again and then used for forming particles. In this case, the fine particles or coarse particles may be in a wet state.

In the toner of the present invention, inorganic fine particles each serving as an external additive for aiding the flowability, developing performance, and charging performance of the toner can be used.

Primary particles of the inorganic fine particles each have a number average particle diameter of preferably 5 nm to 2 μm, or more preferably 5 nm to 500 nm. In addition, the inorganic fine particles have a specific surface area according to a BET method of preferably 20 $m^2/g$ to 500 $m^2/g$.

The inorganic fine particles are used at a ratio of preferably 0.01 part by mass to 5 parts by mass, or more preferably 0.01 to 2.0 parts by mass with respect to 100 parts by mass of the toner particles.

The inorganic fine particles may be of one kind, or may be a combination of multiple kinds.

Specific examples of the inorganic fine particles are as follows: silica, alumina, titanium oxide, barium titanate, magnesium titanate, calcium titanate, strontium titanate, zinc oxide, tin oxide, silica sand, clay, mica, wollastonite, diatomaceous earth, chromium oxide, ceric oxide, colcothar, antimony trioxide, magnesium oxide, zirconium oxide, barium sulfate, barium carbonate, calcium carbonate, silicon carbide, and silicon nitride.

In order to suppress the deterioration of the flowability characteristic and charging characteristic of toner under high humidity, the inorganic fine particles is preferably subjected to hydrophobic treatment using a surface treatment agent.

Examples of the preferable surface treatment agent include a silane coupling agent, a silylating agent, a silane coupling agent having an alkyl fluoride group, an organic titanate-based coupling agent, an aluminum-based coupling agent, a silicone oil, and a modified silicone oil.

An external additive (cleaning performance improver) for removing toner after transfer remaining on a photosensitive member or primary transfer medium is, for example, any one of the following substances: aliphatic acid metal salts such as zinc stearate and calcium stearate, and polymer fine particles produced by soap-free emulsion polymerization such as polymethyl methacrylate fine particles and polystyrene fine particles. It is preferable that the above polymer fine particles show a relatively narrow grain size distribution, and have a number average particle diameter of preferably 0.01 to 1 μm.

Measurement methods for various physical properties of the toner of the present invention are described below.

<Method of Measuring Softening Point (Tm) of Resin>

The softening point (Tm) of a resin was measured by a flow tester which is a constant load extruding capillary rheometer.

That is, the softening point (Tm) of the resin was measured using Elevated Flow Tester CFT500C manufactured by SHIMADZU CORPORATION according to the following conditions. Based on the obtained data, a flow tester curve was produced (shown in FIGS. 1(*a*) and (*b*)). The softening point (Tm) of the resin was determined with the figures. In FIG. 1, Tfb (efflux starting temperature) is defined as the softening point (Tm) of the resin.

(Measurement Conditions)
Load: 10 kgf/cm$^2$ (9.807×10$^5$ Pa)
Rate of temperature increase: 4.0° C./min
Die diameter: 1.0 mm
Die length: 1.0 mm <Method of Measuring Melting Point of Wax>

The melting point of a wax was measured by using a differential scattering calorimeter (DSC), "Q1000" (manufactured by TA Instruments), according to ASTMD3418-82.

The melting points of indium and zinc were used for temperature correction of a detector of the device. The melting heat of indium was used for heat correction. Specifically, about 10 mg of sample are precisely weighed; the sample is charged into an aluminum pan, and measurement is performed in the measurement temperature range of 30 to 200° C. and at a rate of temperature increase of 10° C./min by using an empty aluminum pan as a reference. Note that, in the measurement, the temperature was increased to 200° C. once, and subsequently, decreased to 30° C., and then increased again. In the second temperature increase process, a temperature indicating a maximum endothermic peak of the DSC curve in the temperature range of 30 to 200° C. was defined as the melting point of the wax. When there are plural peaks, the maximum endothermic peak refers to a peak showing largest endotherm.

<Method of Measuring Glass Transition Temperature (Tg) of Resin>

The glass transition temperature (Tg) of a resin was measured by using a differential scattering calorimeter (DSC), "Q1000" (manufactured by TA Instruments), according to ASTMD3418-82. The melting points of indium and zinc were used for temperature correction of a detector of the device. The melting heat of indium was used for heat correction.

Specifically, about 10 mg of sample are precisely weighed; the sample is charged into an aluminum pan, and measurement is performed in the measurement temperature range of 30 to 200° C. and at a rate of temperature increase of 10° C./min by using an empty aluminum pan as a reference. In the elevated temperature process, specific heat change in the range of 30 to 100° C. is obtained. The intersection of the line passing through the intermediate points of the base line which joins the point before specific heat change to after specific heat change and a differential thermal curve is defined as the glass transition temperature (Tg) of the resin.

<Method of Measuring BET Specific Surface Area of Magnetic Substance>

The BET specific surface area of the magnetic substance of the present invention was measured as follows.

The BET specific surface area was measured using an automated apparatus for measuring gas adsorption amount (AUTOSORB 1) manufactured by Yuasa Ionics. Inc. by a BET multiple-points method using nitrogen as an adsorption gas. As a pretreatment of the sample, the sample was degassed at 50° C. for 10 hours.

<Methods of Measuring Weight Average Particle Diameter (D4) and Number Average Particle Diameter (D1) of Toner>

The weight average particle diameter (D4) and number average particle diameter (D1) of the toner were measured with a precision grain size distribution measuring apparatus based on a pore electrical resistance method provided with a 100-μm aperture tube "Coulter Counter Multisizer 3" (registered trademark, manufactured by Beckman Coulter, Inc) and dedicated software included with the apparatus "Beckman Coulter Multisizer 3 Version 3.51" (manufactured by Beckman Coulter, Inc) for setting measurement conditions and analyzing measurement data while the number of effective measurement channels was set to 25,000. The weight average particle diameter (D4) and number average particle diameter (D1) of the toner were calculated by analyzing the measurement data.

An electrolyte solution prepared by dissolving reagent grade sodium chloride in ion-exchanged water to have a concentration of about 1 mass %, for example, an "ISOTON II" (manufactured by Beckman Coulter, Inc) can be used in the measurement.

It should be noted that the dedicated software was set as described below prior to the measurement and the analysis. In the "change screen of standard measurement method (SOM)" of the dedicated software, the total count number of a control mode is set to 50,000 particles, the number of times of measurement was set to 1, and a value obtained by using "standard particles each having a particle diameter of 10.0 μm" (manufactured by Beckman Coulter, Inc) was set as a Kd value. A threshold and a noise level were automatically set by pressing a threshold/noise level measurement button. In addition, a current was set to 1,600 μA, a gain was set to 2, and an electrolyte solution was set to an ISOTON II, and a check mark was placed in a check box as to whether the aperture tube was flushed after the measurement. In the "setting screen for conversion from pulse to particle diameter" of the dedicated software, a bin interval was set to a logarithmic particle diameter, particle diameter bins was set to 256 particle diameter bins, and a particle diameter range was set to the range of 2 μm to 60 μm.

A specific measurement method is as described below.

(1) About 200 ml of the electrolyte solution were charged into a 250-ml round-bottom beaker made of glass dedicated for the Multisizer 3. The beaker was set in a sample stand, and the electrolyte solution in the beaker was stirred with a stirrer rod at 24 rotations/sec in a counterclockwise direction. Then, dirt and bubbles in the aperture tube were removed by the "aperture flush" function of the analysis software.

(2) About 30 ml of the electrolyte solution were charged into a 100-ml flat-bottom beaker made of glass. About 0.3 ml of a diluted solution prepared by diluting a "Contaminon N" (10-mass % aqueous solution of a neutral detergent for washing a precision measuring device formed of a nonionic surfactant, an anionic surfactant, and an organic builder and having a pH of 7, manufactured by Wako Pure Chemical Industries, Ltd.) with ion-exchanged water by three mass fold was added as a dispersant to the electrolyte solution.

(3) An ultrasonic dispersing unit "Ultrasonic Dispersion System Tetra 150" (manufactured by Nikkaki Bios Co., Ltd.) in which two oscillators each having an oscillatory frequency of 50 kHz are built so as to be out of phase by 180° and which has an electrical output of 120 W was prepared. A predetermined amount of ion-exchanged water was charged into the water tank of the ultrasonic dispersing unit. About 2 ml of the Contaminon N were charged into the water tank.

(4) The beaker in the section (2) was set in the beaker fixing hole of the ultrasonic dispersing unit, and the ultrasonic dispersing unit was operated. Then, the height position of the beaker was adjusted in order that the state of resonance of the liquid level of the electrolyte solution in the beaker may be maximum.

(5) About 10 mg of toner are gradually added to and dispersed in the electrolyte solution in the beaker in the section (4) in a state where the electrolyte solution was irradiated with the ultrasonic wave. Then, the ultrasonic dispersion treatment was continued for an additional 60 seconds. It should be noted that the temperature of water in the water tank was appropriately adjusted so as to be 10° C. or higher and 40° C. or lower upon ultrasonic dispersion.

(6) The electrolyte solution in the section (5) in which the toner has been dispersed was dropped with a pipette to the round-bottom beaker in the section (1) placed in the sample stand, and the concentration of the toner to be measured was adjusted to about 5%. Then, measurement was performed until the measured number of the particle diameters are 50,000 particles.

(7) The measurement data was analyzed with the dedicated software included with the apparatus, and the weight average particle diameter (D4) and number average particle diameter (D1) of the toner were calculated. It should be noted that an "average diameter" on the analysis/volume statistics (arithmetic average) screen of the dedicated software when the dedicated software is set to show a graph in a vol % unit is the weight average particle diameter (D4), and an "average diameter" on the analysis/number statistics (arithmetic average) screen of the dedicated software when the dedicated software is set to show a graph in a number % unit is the number average particle diameter (D1).

<Methods of Measuring Average Circularity of Toner and Fine Powder Amount of Toner>

The average circularity of the toner was measured by using a flow-type particle image analyzer "FPIA-3000" (manufactured by SYSMEX CORPORATION.) under the same measurement and analysis conditions as in calibration.

The specific measurement method was as follows: a surfactant as a dispersant, preferably dodecyl benzene sodium sulfonate in an appropriate amount was added to 20 ml of ion-exchanged water; 0.02 g of a measurement sample was added to the mixture; and dispersion treatment was performed for 2 minutes using a desktop ultrasonic cleaning and dispersing machine having an oscillatory frequency of 50 kHz and an electrical output of 150 W (for example, "VS-150" (manufactured by VELVO-CLEAR)) to prepare a dispersion liquid for measurement. In this case, the dispersion liquid was appropriately cooled so as to have a temperature of 10° C. or higher and 40° C. or lower.

For the measurement, the flow-type particle image analyzer mounting a standard object lens (10 magnifications) was used and particle sheath "PSE-900A" (manufactured by SYSMEX CORPORATION.) was used as a sheath liquid. The dispersion liquid prepared according to the procedures was introduced into the flow-type particle image analyzer, and 3,000 of toner particles were measured with a total count mode of HPF measurement mode. A binary threshold upon particle analysis was set to 85% and the particle diameter to be analyzed was limited to a circle-equivalent diameter of 2.00 μm or more and 200.00 μm or less. Then, the average circularity of the toner particles was determined.

In the measurement, automatic focus is performed using a standard latex particles (for example, "5100A" manufactured by Duke Scientific Corporation was diluted with ion-exchanged water) before starting the measurement. After that, the focus is preferably performed each two hours from the start of the measurement.

Note that, in examples of the present invention, the measurement was performed under the same measurement and analysis conditions as when a calibration certification was issued: a flow-type particle image analyzer in which the calibration has been performed by SYSMEX CORPORATION and a calibration certification has been issued by SYSMEX CORPORATION was used; except that and the particle diameter to be analyzed was limited to a circle-equivalent diameter of 2.00 μm or more and 200.00 μm or less.

On the other hand, the fine powder amount of the toner was determined in the same manner as in the measurement of the average circularity with the particle diameter to be analyzed of 0.60 μm or more and 200.00 μm or less. A number frequency of particles in the range of 0.60 μm or more and 2.00 μm or less was determined and the ratio of the particles in the range of 0.60 μm or more and 200.00 μm or less to particles in all range was determined. The ratio was defined as the fine powder amount of the toner.

<Fine Powder Amount of Toner after Ultrasonic Treatment>

The dispersion liquid used for determining the fine powder amount of the toner was further subjected to dispersion treatment for 30 minutes using a desktop ultrasonic cleaning and dispersing machine having an oscillatory frequency of 50 kHz and an electrical output of 150 W ("VS-150" (manufactured by VELVO-CLEAR)) to prepare a dispersion liquid for measurement.

This dispersion liquid was measured in the same manner as in the measurement of the fine powder amount of the toner. A number frequency of particles in the range of 0.60 um or more and 2.00 μm or less was determined and the ratio of the particles in the range of 0.60 μm or more and 200.00 μm or less to particles in all range was determined.

<Method of Measuring Particle Diameters of Resin Fine Particles and Wax Particles in Dispersion Liquid of Wax>

The particle diameters of the resin fine particles and the wax particles in the dispersion liquid of wax were measured using Microtrack grain size distribution measurement apparatus HRA (X-100) (manufactured by NIKKISO CO., LTD.) with a range setting of 0.001 μm to 10 μm. The particle diameters were measured as number average particle diameters (μm or nm). As dilution solvents, water was selected for the resin fine particles and ethyl acetate was selected for the wax particles.

<Methods of Measuring Molecular Weight Distribution, Peak Molecular Weight, and Number Average Molecular Weight of Resin by Gel Permeation Chromatography (GPC)>

The molecular weight distribution, the peak molecular weight, and the number average molecular weight of the resin were measured by gel permeation chromatography (GPC) in which tetrahydrofuran (THF)-soluble matter of the resin was measured using THF as a solvent. Measurement conditions were as follows.

(1) Production of Measurement Sample

The resin (sample) and THF were mixed in a concentration of about 0.5 to 5 mg/ml (for example, about 5 mg/ml) and left to stand at room temperature for several hours (for example, 5 to 6 hours). After that, the mixture was shaken sufficiently to mix the THF and the sample to such an extent that coalescence of the sample disappeared. Further, the mixture was left to stand at room temperature for 12 hours or more (for example, 24 hours). In this time, the time from beginning of mixing of the sample and the THF to termination of left standing was set to 24 hours or more.

After that, the filtrate obtained by being passed through a sample treatment filter (pore size of 0.45 to 0.5 μm, Maishoridisk H-25-2 [manufactured by TOSOH CORPORATION.], Ekikuro-Disk 25CR [manufactured by Gelman Science Japan] are preferably used) was used as a sample for GPC.

(2) Measurement of Sample

A column was stabilized in a heat chamber at 40° C. THF as a solvent was allowed to flow into the column at the temperature at a flow rate of 1 ml/min, and about 50 to 200 μl of a THF sample solution of a resin having a sample concentration adjusted to 0.05 to 5 mg/ml were injected for measurement.

In measuring the molecular weight of the sample, the molecular weight distribution possessed by the sample was calculated from a relationship between a logarithmic value of an analytical curve prepared by several kinds of monodisperse polystyrene standard samples and the number of counts. As standard polystyrene samples for preparing an analytical curve that can be used, samples manufactured by Pressure Chemical Co. or by TOSOH CORPORATION each having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, or $4.48\times10^6$ were used. A RI (refractive index) detector was used as a detector. It should be noted that a combination of multiple commercially available polystyrene gel columns was used in combination as described below for accurately measuring a molecular weight region of $1\times10^3$ to $2\times10^6$. Measurement conditions of GPC in the present invention are as follows.

[GPC Measurement Conditions]

Apparatus: LC-GPC 150C (manufactured by Waters)

Columns: KF801, 802, 803, 804, 805, 806, and 807 (manufactured by SHOWA DENKO K.K.), seven columns connected Column temperature: 40° C.

Mobile phase: THF (tetrahydrofuran)

<Method of Measuring Dielectric Loss (tan δ) represented by Dielectric Loss Index ∈"/Dielectric Constant ∈' of Toner>

The dielectric loss (tan δ) represented by a dielectric loss index ∈"/a dielectric constant ∈' of the toner was calculated using 4284A precision LCR meter (manufactured by Hewlett-Packard Development Company, L.P.). After calibrations at frequencies of 1,000 Hz and 1 MHz, the dielectric loss tangent (tan δ=∈"/∈') was calculated with a measurement value of a complex dielectric constant at a frequency of $10^5$ Hz.

That is, 1.0 g of toner was weighed and molded by applying a load of 19,600 kPa (200 kgf/cm$^2$) for 1 minute, whereby a disk-like measurement sample having a diameter of 25 mm and a thickness of 2 mm or less (preferably 0.5 mm or more and 1.5 mm or less) was prepared. The measurement sample was mounted on ARES (manufactured by Rheometric Scientific F.E) mounting a dielectric measurement jig (electrode) having a diameter of 25 mm. The complex dielectric constant of the measurement sample at room temperature with a frequency of 1,000 Hz to 1 MHz was measured, whereby the dielectric loss tangent (tan ∈=∈"/∈') was calculated. A value at a frequency of $10^5$ Hz was defined as the dielectric loss (tan δ) represented by a dielectric loss index ∈"/a dielectric constant ∈'.

<Method of Measuring Volume Resistivity Rt (Ω·cm) of Toner>

Figure 2:
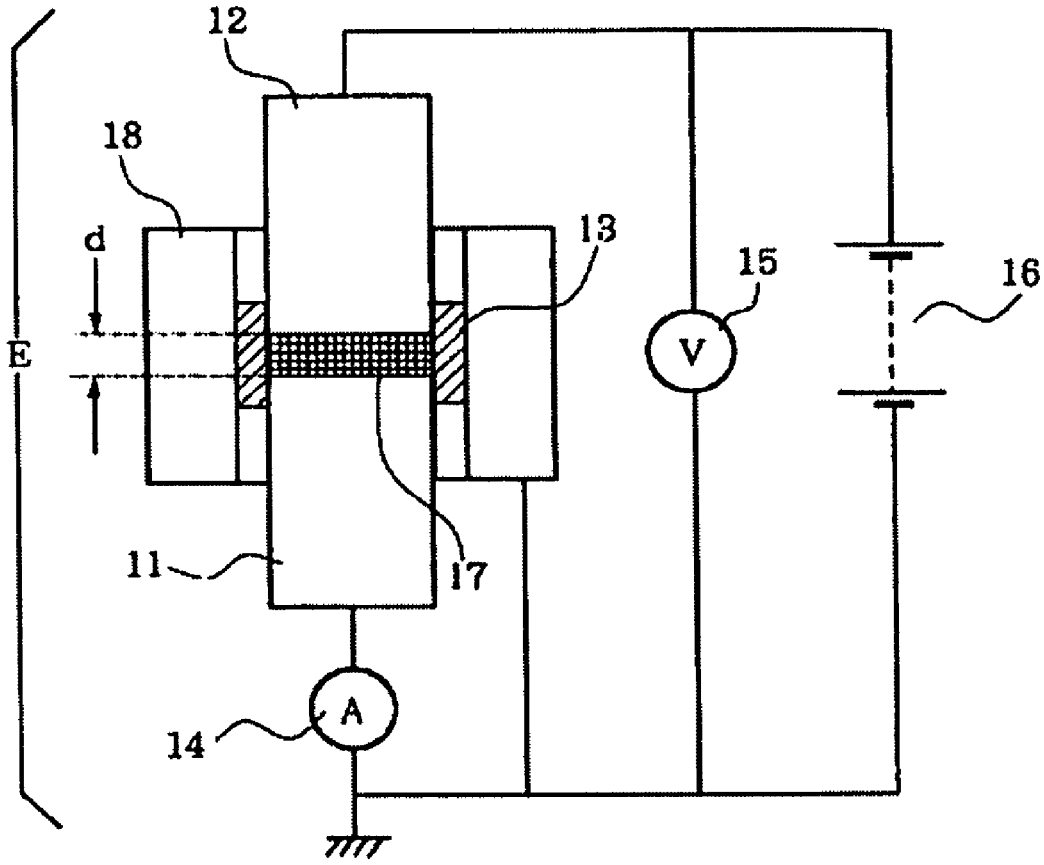
FIG. 2 is a schematic drawing of an apparatus for measuring a volume resistivity of a toner.

The volume resistivity Rt (Ω·cm) of the toner was measured using a measurement apparatus shown in FIG. 2.

That is, a resistance measurement cell E was filled with toner and a lower electrode 11 and an upper electrode 12 were arranged so as to be in contact with the toner. A voltage was applied between the electrodes, and a current flowing at that time was measured, whereby the volume resistivity was determined. The measurement conditions were as follows.

Contact area between filled toner and electrodes: S=about 2.3 cm$^2$

Thickness: d=about 0.5 mm

Load of upper electrode 12: 180 g

Applied voltage: 500 V

<Method of Measuring Number Average Dispersed-particle Diameter of Magnetic Substance in Sectional Enlarged Photograph of Toner Particles>

Toner particles dispersed in a water-soluble resin were added in a cryomicrotome apparatus (ULTRACUT N FC4E manufactured by Reichert, Inc.). The apparatus was cooled to −80° C. with liquid nitrogen, whereby the water-soluble resin in which the toner particles were dispersed was frozen. The frozen water-soluble resin was trimmed with a glass knife in such a manner that a cutting surface has a width of about 0.1 mm and a length of about 0.2 mm. Next, by using a diamond knife, an extreme thin section (setting of thickness: 70 nm) of the toner containing the water-soluble resin was produced and moved to a grid mesh for TPM observation by using an eye-lash probe. The temperature of the extreme thin section of the toner particles containing the water-soluble resin was returned to room temperature. After that, the water-soluble resin was dissolved into pure water and used as a sample for observation of a transmission electron microscope (TEM). The sample was observed using a transmission electron microscope, H-7500 (manufactured by Hitachi, Ltd.), at an accelerating voltage of 100 kV, and an enlarged photograph of a section of the toner particles was taken. The section of the toner particles was arbitrary selected. In addition, magnification of the enlarged photograph was 10,000.

The image obtained in the photo taking was read with 600 dpi through an interface and introduced to an image analyzer, Win ROOF Version 5.0 (manufactured by Microsoft-MITANI CORPORATION.), and converted to binary image data. Of those data, data with respect to only the magnetic substance were analyzed randomly and an aggregation diameter of the magnetic substance was determined by repeating the measurements until the number of sampling reached 100. A number average diameter of the obtained aggregation diameters was defined as the number average dispersed-particle diameter of the magnetic substance present in the toner particles.

<Method of Measuring Magnetization at of Magnetic Substance and Toner>

Magnetization intensities of the magnetic substance and the toner were determined from magnetic characteristics and mass. The magnetic characteristics of the magnetic substance and the toner were measured using "Vibrating Sample Magnetometer VSM-3S-15" (manufactured by TOEI INDUSTRY CO., LTD.).

The measurement method was as follows: the magnetic substance or the toner was filled in a cylindrical plastic container so as to be sufficiently dense; an external magnetic field of 1.00 kilo-oersted (79.6 kA/m) was produced; and, in the state, a magnetization moment of the magnetic substance or the toner filled in the container was measured.

Next, actual mass of the magnetic substance or the toner filled in the container was measured and a magnetization intensity (Am$^2$/kg) of the magnetic substance or the toner was determined.

In addition, a hysteresis loop when the maximum applied magnetic field was set to 1.00 kilo-oersted (79.6 kA/m) was drawn, whereby a residual magnetization (σr) was determined.

<Methods of Measuring Number Average Particle Diameter (D1) of Magnetic Substance and Variation Coefficient of Particle Diameter of Magnetic Substance>

The number average particle diameter (D1) of the magnetic substance and standard deviation a were calculated by measuring particle images (arbitrary 350 particles) photographed by an electron microscope observation with a statistical analysis (Digitizer KD4620 manufactured by GRAPHTECH).

In addition, the variation coefficient of the particle diameter of the magnetic substance was calculated according to the following formula from the number average diameter D1 (μm) and the standard deviation σ (μm). The grain size distribution was indicated to be excellent when the variation coefficient was smaller.

$$\text{Variation coefficient of particle diameter of magnetic substance}=(\sigma/D1)\times 100(\%)$$

<Measurement of Bulk Density of Magnetic Substance>

The bulk density of the magnetic substance was measured using Powder Tester PT-R (manufactured by Hosokawa Micron Group) according to an operation manual of the device.

Specifically, a comb having an aperture of 500 μm was used and the magnetic substance was supplied so as to be 10 ml while the comb was vibrated with an amplitude of 1 mm. Then, a cup made of a metal was tapped for 180 vertical reciprocating with an amplitude of 18 mm. From a magnetic substance amount after the tapping, a bulk density (g/cm$^3$) was calculated.

<Method of Measuring Sulfonic Group Value>

After the dispersion liquid of resin fine particles having a solid content ratio of 20 mass % is neutralized (pH=7.0±0.1) with hydrochloric acid or sodium hydroxide, a pH and a zeta potential of the dispersion liquid are measured while hydrochloric acid is dropped. In the pH range of 2.0 or more to 3.0 or less, change of the zeta potential from negative to positive is observed. In the range, a point at which the zeta potential is 0 is determined and the number of moles of required hydrochloric acid is determined. The mass of potassium hydroxide of the same number of moles is determined. On the other hand, the mass of a solid content ratio of the dispersion liquid of resin fine particles is determined and defined as a value of sulfonic group value per unit mass. Note that, in the case where the zeta potential is changed from negative to positive at a pH of 3.0 or more, the sulfonic group value was defined as 0 mgKOH/g.

<Method of Measuring Acid Value of Resin>

An acid value is the number of milligrams of potassium hydroxide needed for the neutralization of an acid in 1 g of a sample. The acid value of a binder resin is measured in conformance with JIS K 0070-1966. To be specific, the measurement is performed in accordance with the following procedure.

(1) Preparation of Reagent 1.0 g of phenolphthalein is dissolved in 90 ml of ethyl alcohol (95 vol %). Ion-exchanged water is added to the solution so that the mixture has a volume of 100 ml. Thus, a "phenolphthalein solution" is obtained.

7 g of reagent grade potassium hydroxide are dissolved in 5 ml of water. Ethyl alcohol (95 vol %) is added to the solution so that the mixture has a volume of 1 l. The mixture is left to stand in an alkali-resisting container for 3 days while being out of contact with a carbon dioxide gas. After that, the mixture is filtrated, where by a "potassium hydroxide solution" is obtained. The resultant potassium hydroxide solution is stored in the alkali-resisting container. Standardization is performed in conformance with JIS K 0070-1996.

(2) Operation (A) Run Proper 2.0 g of a pulverized sample of the binder resin are precisely weighed in a 200-ml Erlenmeyer flask, and 100 ml of a mixed solution of toluene and ethanol (at a ratio of 2:1) are added to dissolve the sample over 5 hours. Subsequently, several drops of the phenolphthalein solution as an indicator are added to the solution, and the solution is titrated with the potassium hydroxide solution. It should be noted when the faint red color of the indicator is exhibited for about 30 seconds is defined as the end point of the titration.

(B) Blank Run

Titration is performed by the same operation as that described above except that no sample is used (that is, only the mixed solution of toluene and ethanol (at a ratio of 2:1) is used).

(3) The acid value of the sample is calculated by substituting the obtained results into the following equation:

$$A=[(B-C)\times f\times 5.61]/S$$

where A represents the acid value (mgKOH/g), B represents the addition amount (ml) of the potassium hydroxide solution in the blank run, C represents the addition amount (ml) of the potassium hydroxide solution in the run proper, f represents the factor of the potassium hydroxide solution, and S represents the mass (g) of the sample.

<Method of Measuring Loss Elastic Modulus (G") and Storage Elastic Modulus (G') of Toner>

Measurement was performed with a viscoelasticity measuring apparatus (rheometer) ARES (manufactured by Rheometrics Scientific) The outline of the measurement, which is described in the operation manuals 902-30004 (version in August, 1997) and 902-00153 (version in July, 1993) of the ARES published by Rheometrics Scientific, is as described below.

Measuring jig: a cerated parallel plate having a diameter of 7.9 mm is used.

Measurement sample: a cylindrical sample having a diameter of about 8 mm and a height of about 2 mm is produced with a pressure molder while 15 kN is maintained at normal temperature for 1 minute. A 100 kN Press NT-100H (manufactured by NPa SYSTEM CO., LTD.) is used as the pressure molder.

The temperature of the cerated parallel plate is adjusted to 90° C. The cylindrical sample is melted by heating. Sawteeth are engaged in the molten sample, and a load is applied to the sample in the direction perpendicular to the sample so that an axial force does not exceed 30 (grams weight). Thus, the sample is caused to adhere to the cerated parallel plate. In this case, a steel belt may be used in order that the diameter of the sample may be equal to the diameter of the parallel plate. The cerated parallel plate and the cylindrical sample are slowly cooled to the temperature at which the measurement is initiated, that is, 30.00° C. over 1 hour.

Measuring frequency: 6.28 radians/sec

Setting of measurement strain: measurement is performed according to an automatic measurement mode while an initial value is set to 0.1%.

Correction for elongation of sample: adjustment is performed by using the automatic measurement mode.

Measurement temperature: the temperature is increased from 30° C. to 180° C. at a rate of 2° C./min.

Measurement interval: viscoelasticity data is measured every 30 seconds, that is, every 1° C.

Data is transferred to an RSI Orchesrator VER.6.5.6 (software for control, data acquisition, and analysis) (manufactured by Rheometrics Scientific) that operates on a Windows 2000 manufactured by Microsoft Corporation through an interface and then analyzed. Thus, each value was obtained. Note that a temperature showing the maximum value was determined by selecting "Peak an Valleys" in "Tools" and assigning "AutoFind Peaks" in RSI Orchesrator VER. 6.5.6.

<Measurement of Content of THF-insoluble Matter Excluding Magnetic Substance>

The content of the THF-insoluble matter in the resin component excluding magnetic substance in the toner particles is measured as described below.

About 1.0 g of the toner particles is weighed (W1 [g]). The weighed toner particles are placed in extraction thimble (such as a product available from Advantec Toyo under the tradename "No. 86R" (measuring 28×100 mm)) which has been weighted in advance, and is set in a Soxhlet extractor so as to be extracted with 200 ml of tetrahydrofuran (THF) as a solvent for 16 hours; in this case, the extraction is performed at such a reflux speed that the cycle of the extraction with the solvent is once per about five minutes.

After the completion of the extraction, the extraction thimble is taken out and air-dried. After that, the extraction thimble is dried in a vacuum at 40° C. for 8 hours, and the mass of the extraction thimble containing an extraction residue is weighed. The mass (W2 [g]) of the extraction residue is calculated by subtracting the mass of the extraction thimble from the above weighed mass.

Then, the content of the THE-insoluble matter can be determined by subtracting the content (W3 [g]) of the magnetic substance as represented by the following equation.

$$\text{Content of THF-insoluble matter (mass \%)}=\{(W2-W3)/(W1-W3)\}\times 100$$

The content of the magnetic substance can be measured by known conventional analytical means. However, in the case where the analysis is difficult, the content of the magnetic substance (incineration residue ash content in the toner W3' (g)) can be estimated as follows and the content is subtracted and thus the THE-insoluble content can be determined.

The incineration residue ash content in the toner particles was determined by the following procedures. In a 30-ml magnetic crucible which had been weighed beforehand, about 2 g of toner were weighed (Wa (g)). The crucible was put in an electric furnace, and heated at about 900° C. for about 3 hours. Then, the crucible was left to cool in the electric furnace and then left to cool in a desiccator for 1 hour or more under normal temperature. After that, the mass of the crucible containing the incineration residue ash content was weighed, and the mass of the crucible was subtracted, whereby the incineration residue ash content Wb (g) was calculated. Then, the mass of the incineration residue ash content in the sample W1 (*g*) was calculated (W3'(*g*)).

$$W3'=W1\times(Wb/Wa)$$

In this case, the THF-insoluble content can be determined by the following formula.

$$\text{THE-insoluble content (mass \%)}=\{(W2-W3')/(W1-W3')\}\times 100$$

<Method of Measuring Average Adhesive Force (F50) of Toner by Centrifugation Method>

The average adhesive force (F50) of the toner was measured using a centrifugal adhesion measurement apparatus, NS-C100 type (manufactured by Nano Seeds Corporation.), according to the operation manual under a normal-temperature, normal-humidity environment (23° C./60% RH). Note that the apparatus is roughly formed of an image analysis part and a centrifugal separation part. The image analysis part is formed of a metal microscope, an image analyzer, and a screen monitor. The centrifugal separation part is formed of a high-speed centrifugal machine and a sample cell (the material is Aluminum A5052).

(Measurement Method)

Toner was adhered to a glass substrate (slide glass manufactured by The Matsunami Glass Ind., Ltd.) and the glass substrate was then fixed to a sample cell. The sample cell was centrifuged with the high-speed centrifugal machine at 5 standards: 2,000 rpm, 4,000 rpm, 6,000 rpm, 8,000 rpm, and 10,000 rpm. Then, separation state of the toner was recorded.

In this case, a separation force acting on the toner was calculated from the true specific gravity of the toner, the particle diameter of the toner, the number of rotation, and the radius of rotation.

A toner residual ratio R after the rotation was measured with respect to an adhesion amount at the initial stage of the measurement. The residual ratio and the separation force were plotted on an ordinate axis and an abscissa axis, respectively. The separation force with which 50% of the toner separates was calculated from an approximate line (in this case, the separation force is equal to adhesive force) and defined as the average adhesive force (F50).

(Analysis Method)

A rotational angular rate (, at which the toner residual ratio Rafter the rotation reached 50% was calculated by the above-mentioned measurement method and the average adhesive force (F50) was calculated by the following formula:

$$\text{Average adhesive force } (F50)=(\pi/6)\cdot\rho\cdot d^3\cdot r\cdot\omega^2$$

where ρ represents the particle density, d represents the particle diameter, r represents the rotation radius, and ω represents the rotational angular rate when 50% of toner separates.

<Method of Measuring Mean Roughness (Ra) of Toner Particle Surface>

In the present invention, the roughness (Ra) of the toner surface was measured by using a scanning probe microscope. The measurement conditions and methods are shown below.

Probe station: SPI3800N (manufactured by Seiko Instruments Inc.)

Measurement unit: SPA400

Measurement mode: DFM (oscillation mode) shape image

Cantilever: SI-DF40P

Resolution: the number of X data of 256, the number of Y data of 128

In the present invention, the mean roughness of a 1-square-μm area of the toner-particle surface was measured. The area to be measured was a 1-square-μm area in the central part of the toner particle surface which is to be measured with the scanning probe microscope. For toner particles to be measured, toner particles each having a particle diameter equal to the weight average particle diameter (D4) measured by the above-mentioned coulter counter method were randomly selected. The measured a data were subjected to a second calibration. 5 or more particles having different toner particle diameter from one another were measured and the average value of the obtained data was calculated, whereby the value was defined as the mean roughness (Ra) of the toner particle surface.

The mean roughness (Ra) thus obtained as described above was expanded three-dimensionally so that the central line mean roughness Ra defined in JIS B 0601 can be applied to the measured surface. The mean roughness is a value obtained by averaging an absolute value of deviation to an indicated surface. The mean roughness is represented by following equation.

$$Ra = \frac{1}{S_0}\int_{Y_B}^{Y_T}\int_{X_L}^{X_R}|F(X, Y) - Z_0|\,dX\,dY \quad \text{[Formula 1]}$$

F (X,Y): surfaces indicated by all measured data $S_0$: area when the indicated surface is suggested to be ideally flat $Z_0$: average value of Z data in the indicated surface (data perpendicular to the indicated surface)

Description of the Embodiments

Hereinafter, the present invention is described by way of examples, but the present invention is not limited thereto. Note that the number of part(s) in blending refers to part(s) by mass unless otherwise specified.

[Production of Dispersion Liquid of Resin Fine Particles 1]

| | |
|---|---|
| Polyester diol having the number average molecular weight of about 2,000 obtained from a mixture containing propylene glycol, ethylene glycol, and butane diol at the ratio of 40:50:10 (molar ratio), and a mixture containing terephthalic acid and isophthalic acid at the ratio of 50:50 (molar ratio) | 120 parts by mass |
| Dimethylol propanoic acid | 94 parts by mass |
| 3-(2,3-dihydroxypropoxy)-1-propane sulfonic acid | 8 parts by mass |
| Isophorone diisocyanate | 120 parts by mass |

The above-mentioned raw materials were dissolved into 60 parts by mass of acetone, followed by a reaction at 67° C. for 1 hour. Next, 271 parts by mass of isophoronediisocyanate were added to the mixture. The obtained mixture was further subjected to a reaction at 67° C. for 30 minutes, and then cooled. After 100 parts by mass of acetone were additionally added to the obtained reaction product, 80 parts by mass of triethyl amine were charged into the reaction product, followed by stirring. The thus obtained acetone solution was dropped to 1,000 parts by mass of ion-exchanged water while stirring at 500 rpm, whereby a dispersion liquid of fine particles was prepared.

Next, a solution in which 50 parts by mass of triethyl amine were dissolved into 100 parts by mass of a 10% ammonia water was charged into the dispersion liquid of fine particles. The obtained mixture was subjected to an extension reaction by a reaction at 50° C. for 8 hours. Further, ion-exchanged water was added until the solid content became 20 mass %, whereby a dispersion liquid of resin fine particles-1 was obtained. The dispersed-particle diameter of resin fine particles in the obtained dispersion liquid of resin fine particles-1 was measured and other physical properties were further determined using the obtained resin fine particles. Table 1 shows the results.

[Production of Dispersion Liquid of Resin Fine Particles 2]

The followings were loaded into an autoclave equipped with a temperature gauge and a stirring machine.

| | |
|---|---|
| Dimethyl terephthalate | 116 parts by mass |
| Dimethyl isophthalate | 66 parts by mass |

-continued

| | |
|---|---|
| 5-sodium sulfoisophthalate methyl ester | 30 parts by mass |
| Trimellitic anhydride | 5 parts by mass |
| Propylene glycol | 150 parts by mass |
| Tetrabutoxy titanate | 0.1 part by mass |

The whole was heated at 200° C. for 120 minutes to carry out an ester exchange reaction. Next, the temperature of the reaction system was increased to 220° C. and the pressure of the system was set to 1 to 10 mmHg, and the reaction was continued for 60 minutes. Thus, a polyester resin was obtained. 40 parts by mass of the polyester resin were dissolved into 15 parts by mass of methyl ethyl ketone and 10 parts by mass of tetrahydrofuran at 80° C. Then, while 60 parts by mass of water at 80° C. were added with stirring, a solvent medium was removed under reduced pressure. Further, ion-exchanged water was added to the resultant, whereby a dispersion liquid of resin fine particles-2 having a solid content ratio of 20 mass % was obtained. Table 1 shows physical properties thereof.

[Production of Dispersion Liquid of Resin Fine Particles 3]

The following raw materials were charged into a reactor equipped with a cooling pipe, a nitrogen introducing pipe, and a stirring machine.

| | |
|---|---|
| Styrene | 300 parts by mass |
| n-butyl acrylate | 110 parts by mass |
| Acrylic acid | 10 parts by mass |
| Sodium styrene sulfonate | 30 parts by mass |
| 2-butanone (solvent) | 50 parts by mass |

8 parts by mass of 2,2'-azobis(2,4-dimethylvaleronitrile) as a polymerization initiator were dissolved into the above-mentioned compositions, whereby a polymerizable monomer composition was prepared. After the polymerizable monomer composition was polymerized at 60° C. for 8 hours, the temperature of the resultant was increased to 150° C., followed by desolvation under reduced pressure. Thus, the reaction product was removed from the reactor. The reaction product was cooled to room temperature, and then pulverized into particles, whereby a linear vinyl resin was obtained. 100 parts by mass of the resin and 400 parts by mass of toluene were mixed and the mixture was heated to 8° C. to melt the resin, whereby dissolved liquid of the resin was obtained.

Next, 360 parts by mass of ion-exchanged water and 40 parts by mass of a 48.5% aqueous solution of dodecyldiphenyl ether sodium disulfonate ("ELEMINOL MON-7" manufactured by Sanyo Chemical Industries) were mixed, and the dissolved liquid of resin was added to the mixture, and the mixture was mixed and stirred whereby an opal liquid was obtained. The toluene was removed under reduced pressure and ion-exchanged water was added to the mixture, whereby a dispersion liquid of resin fine particles-3 having a solid content ratio of 20 mass % was obtained. Table 1 shows physical properties thereof.

[Production of Dispersion Liquid of Resin Fine Particles 4]

| | |
|---|---|
| Polyester diol having the number average molecular weight of about 2,000 obtained from a mixture containing propylene glycol, ethylene glycol, and butane diol at the ratio of 40:50:10 (molar ratio), and a mixture containing terephthalic acid and | 100 parts by mass |

-continued

| | |
|---|---|
| isophthalic acid at the ratio of 50:50 (molar ratio) | |
| Propylene glycol | 16 parts by mass |
| Dimethylol propanoic acid | 94 parts by mass |
| Sodium N,N-bis(2-hydroxyethyl)-2-aminoethane sulfonate | 8 parts by mass |
| Tolylene diisocyanate | 30 parts by mass |

The above-mentioned raw materials were dissolved into 60 parts by mass of acetone, followed by a reaction at 67° C. for 1 hour. Further, 271 parts by mass (1.2 mol) of isophorone diisocyanate were added to the mixture. The obtained mixture was further subjected to a reaction at 67° C. for 30 minutes, and then cooled. After 100 parts by mass of acetone were additionally added to the obtained reaction product, 80 parts by mass (0.8 mol) of triethyl amine were charged into the reaction product, followed by stirring. The thus obtained acetone solution was dropped to 1,000 parts by mass of ion-exchanged water while stirring at 500 rpm, whereby a dispersion liquid of fine particles was prepared.

Next, a solution in which 50 parts by mass of triethyl amine were dissolved into 100 parts by mass of a 10% ammonia water was charged into the dispersion liquid of fine particles. The obtained mixture was subjected to an extension reaction by a reaction at 50° C. for 8 hours. Further, ion-exchanged water was added until the solid content became 20 mass %, whereby a dispersion liquid of resin fine particles-4 was obtained. Table 1 shows physical properties thereof.

[Production of Dispersion Liquid of Resin Fine Particles 5]

| | |
|---|---|
| Polyester diol having the number average molecular weight of about 2,000 obtained from a mixture containing propylene glycol, ethylene glycol, and butane diol at the ratio of 40:50:10 (molar ratio), and a mixture containing terephthalic acid and isophthalic acid at the ratio of 50:50 (molar ratio) | 120 parts by mass |
| Propylene glycol | 8 parts by mass |
| Dimethylol propanoic acid | 94 parts by mass |
| 3-(2,3-dihydroxypropoxy)-1-propane sulfonic acid | 8 parts by mass |
| Isophorone diisocyanate | 39 parts by mass |

The above-mentioned raw materials were dissolved into 60 parts by mass of acetone, followed by a reaction at 67° C. for 1 hour. Next, 271 parts by mass of isophorone diisocyanate were added to the mixture. The obtained mixture was further subjected to a reaction at 67° C. for 30 minutes, and then cooled. The thus obtained acetone solution was dropped to 1,000 parts by mass of ion-exchanged water while stirring at 500 rpm, whereby a dispersion liquid of fine particles was prepared.

After 1.00 parts by mass of acetone were additionally added to the dispersion liquid of fine particles, 80 parts by mass of triethyl amine were charged into the reaction product, followed by stirring. Next, a solution in which 50 parts by mass of triethyl amine were dissolved into 100 parts by mass of a 10% ammonia water was charged into the mixture. The obtained mixture was subjected to an extension reaction by a reaction at 50° C. for 8 hours. Further, ion-exchanged water was added until the solid content became 20 mass %, whereby a dispersion liquid of resin fine particles-5 was obtained. Table 1 shows physical properties thereof.

[Production of Dispersion Liquid of Resin Fine Particles 6]

| | |
|---|---|
| Polyester diol having the number average molecular weight of about 2,000 obtained from a mixture containing propylene glycol, ethylene glycol, and butane diol at the ratio of 40:50:10 (molar ratio), and a mixture containing terephthalic acid and isophthalic acid at the ratio of 50:50 (molar ratio) | 120 parts by mass |
| Propylene glycol | 8 parts by mass |
| Dimethylol propanoic acid | 94 parts by mass |
| 3-(2,3-dihydroxypropoxy)-1-propane sulfonic acid | 8 parts by mass |
| Isophorone diisocyanate | 39 parts by mass |

The above-mentioned raw materials were dissolved into 60 parts by mass of acetone, followed by a reaction at 67° C. for 1 hour. Next, 150 parts by mass of isophorone diisocyanate were added to the mixture. The obtained mixture was further subjected to a reaction at 65° C. for 20 minutes, and then cooled. The thus obtained acetone solution was dropped to 1,000 parts by mass of ion-exchanged water while stirring at 500 rpm, whereby a dispersion liquid of fine particles was prepared.

After 100 parts by mass of acetone were additionally added to the dispersion liquid of fine particles, 80 parts by mass of triethyl amine were charged into the reaction product, followed by stirring. Next, a solution in which 50 parts by mass of triethyl amine were dissolved into 100 parts by mass of a 10% ammonia water was charged into the mixture. The obtained mixture was subjected to an extension reaction by a reaction at 50° C. for 8 hours. Further, ion-exchanged water was added until the solid content became 20 mass %, whereby a dispersion liquid of resin fine particles-6 was obtained. Table 1 shows physical properties thereof.

TABLE 1

| | Resin fine particles | Tg (° C.) | Tm (° C.) | Sulfonic group value (mgKOH/g) | Particle diameter in dispersion liquid (nm) |
|---|---|---|---|---|---|
| Dispersion liquid of resin fine particles-1 | Urethane-1 | 78 | 148 | 3 | 50 |
| Dispersion liquid of resin fine particles-2 | Polyester | 62 | 105 | 20 | 80 |
| Dispersion liquid of resin fine particles-3 | St-Ac | 65 | 123 | 18 | 60 |
| Dispersion liquid of resin fine particles-4 | Urethane-2 | 75 | 140 | 0 | 55 |
| Dispersion liquid of resin fine particles-5 | Urethane-3 | 63 | 108 | 3 | 40 |
| Dispersion liquid of resin fine particles-6 | Urethane-4 | 40 | 128 | 3 | 60 |

<Preparation of Polyester-1>

The followings were charged into a reactor equipped with a cooling pipe, a nitrogen introducing pipe, and a stirring machine.

| | |
|---|---|
| 1,4-butanediol | 928 parts by mass |
| Dimethyl terephthalate | 776 parts by mass |

-continued

| | |
|---|---|
| 1,6-hexanedioic acid | 292 parts by mass |
| Tetrabutoxy titanate (condensation catalyst) | 3 parts by mass |

The whole was subjected to a reaction at 160° C. for 8 hours in a stream of nitrogen while generated methanol was distilled off. Next, the temperature of the resultant was increased gradually to 210° C., the resultant was subjected to a reaction for 4 hours in a stream of nitrogen, while generated propylene glycol and water were distilled off. The obtained resultant was further subjected to a reaction for 1 hour under a reduced pressure of 20 mmHg and then cooled to 160° C. 173 parts by mass of trimellitic anhydride and 125 parts by mass of 1,3-propanedioic acid were added to the resultant, and the obtained mixture was subjected to a reaction for 2 hours under sealing at normal pressure, followed by a reaction at 200° C. and normal pressure. The obtained resultant was removed at the point when the softening point of the resultant became 170° C. After cooled to room temperature, the removed resin was pulverized into particles, whereby a polyester-1 as a non-linear polyester resin was obtained. Tg of the polyester-1 was 53° C. and an acid value thereof was 25 mgKOH/g.

<Preparation of Polyester-2>

| | |
|---|---|
| Polyoxypropylene(2.2)-2,2-bis(4-hydroxyphenyl)propane | 30 parts by mass |
| Polyoxyethylene(2.2)-2,2-bis(4-hydroxyphenyl)propane | 33 parts by mass |
| Terephthalic acid | 21 parts by mass |
| Trimellitic anhydride | 1 part by mass |
| Fumaric acid | 3 parts by mass |
| Dodecenyl succinic acid | 12 parts by mass |
| Dibutyltin oxide | 0.1 part by mass |

The whole was added to a four-necked-4-L flask, and a temperature gauge, a stirring bar, a condenser, and a nitrogen introducing pipe were provided to the flask and the flask was put in a mantle heater. Under a nitrogen atmosphere, the whole was subjected to a reaction at 215° C. for 5 hours, whereby a polyester-2 was obtained. Tg of the polyester-2 was 62° C., and an acid value thereof was 6 mgKOH/g.

<Preparation of Polyester-3>

The followings were charged into a reactor equipped with a cooling pipe, a nitrogen introducing pipe, and a stirring machine.

| | |
|---|---|
| 1,2-propanediol | 799 parts by mass |
| Dimethyl terephthalate | 815 parts by mass |
| 1,5-pentanedioic acid | 238 parts by mass |
| Tetrabutoxy titanate (condensation catalyst) | 3 parts by mass |

The whole was subjected to a reaction at 180° C. for 8 hours in a stream of nitrogen while generated methanol was distilled off. Next, the temperature of the resultant was increased gradually to 230° C.; the resultant was subjected to a reaction for 4 hours in a stream of nitrogen, while generated propylene glycol and water were distilled off. The obtained resultant was further subjected to a reaction for 1 hour under a reduced pressure of 20 mmHg and then cooled to 180° C.173 parts by mass of trimellitic anhydride were added to the resultant, and the obtained mixture was subjected to a reaction for 2 hours under sealing at normal pressure, followed by a reaction at 220° C. and normal pressure. The obtained resultant was removed at the point when the softening point of the resultant became 180° C. After cooled to room temperature, the removed resin was pulverized into particles, whereby a polyester-3 as a non-linear polyester resin was obtained. Tg of the polyester-3 was 62° C. and an acid value thereof was 2 mgKOH/g.

<Preparation of Polyester-4>

The followings were charged into a reactor equipped with a cooling pipe, a nitrogen introducing pipe, and a stirring machine.

| | |
|---|---|
| 1,3-butanediol | 1,036 parts by mass |
| Dimethyl terephthalate | 892 parts by mass |
| 1,6-hexanedioic acid | 205 parts by mass |
| Tetrabutoxy titanate (condensation catalyst) | 3 parts by mass |

The whole was subjected to a reaction at 180° C. for 8 hours in a stream of nitrogen while generated methanol was distilled off. Next, the temperature of the resultant was increased gradually to 230° C., the resultant was subjected to a reaction for 4 hours in a stream of nitrogen, while generated propylene glycol and water were distilled off. The obtained resultant was further subjected to a reaction under a reduced pressure of 20 mmHg. The obtained resultant was removed at the point when the softening point of the resultant became 150° C. After cooled to room temperature, the removed resin was pulverized into particles, whereby a polyester-4 as a linear polyester resin was obtained. Tg of the polyester-4 was 38° C. and an acid value thereof was 15 mgKOH/g.

<Preparation of Polyester-5>

The followings were charged into a reactor equipped with a cooling pipe, a nitrogen introducing pipe, and a stirring machine.

| | |
|---|---|
| 1,2-propanediol | 858 parts by mass |
| Dimethyl terephthalate | 873 parts by mass |
| 1,6-hexanedioic acid | 219 parts by mass |
| Tetrabutoxy titanate (condensation catalyst) | 3 parts by mass |

The whole was subjected to a reaction at 180° C. for 8 hours in a stream of nitrogen while generated methanol was distilled off. Next, the temperature of the resultant was increased gradually to 230° C., the resultant was subjected to a reaction for 4 hours in a stream of nitrogen, while generated propylene glycol and water were distilled off. The obtained resultant was further subjected to a reaction under a reduced pressure of 20 mmHg. The obtained resultant was removed at the point when the softening point of the resultant became 150° C. After cooled to room temperature, the removed resin was pulverized into particles, whereby a polyester-5 as a linear polyester resin was obtained. Tg of the polyester-5 was 44° C. and an acid value thereof was 13 mgKOH/g.

<Preparation of Polyester Resin Solution>

Ethyl acetate was charged into a closed reactor equipped with a stirring blade. Under stirring at 100 rpm, the polyesters-1 to 5 were each added, and stirred for 3 days at room temperature, whereby polyester resin solutions-1 to 5 were prepared. Table 2 shows the resin contents (mass %).

TABLE 2

| | Resin | Solvent | Resin content (mass %) |
|---|---|---|---|
| Polyester resin solution-1 | Polyester-1 | Ethyl acetate | 50 |
| Polyester resin solution-2 | Polyester-2 | Ethyl acetate | 50 |
| Polyester resin solution-3 | Polyester-3 | Ethyl acetate | 50 |
| Polyester resin solution-4 | Polyester-4 | Ethyl acetate | 50 |
| Polyester resin solution-5 | Polyester-5 | Ethyl acetate | 50 |

<Preparation of Dispersion Liquid of Wax-1>

| | |
|---|---|
| Carnauba wax (temperature of maximum endothermic peak: 81° C.) | 20 parts by mass |
| Ethyl acetate | 80 parts by mass |

The above-mentioned compounds were loaded into a glass beaker equipped with a stirring blade (manufactured by IWAKI CO., LTD.), and the carnauba wax was dissolved into the ethyl acetate by heating the system to 70° C. Next, the inside of the system was cooled gradually with stirring at 50 rpm to thereby be cooled to 25° C. over 3 hours, whereby an opal liquid was obtained.

The obtained solution and 20 parts by mass of 1-mm glass beads were loaded into a heat-resistant container, and dispersed with a paint shaker (manufactured by Toyo Seiki Seisaku-sho, Ltd.) for 3 hours, whereby a dispersion liquid of wax-1 was obtained.

The wax particle diameter in the dispersion liquid of wax-1 was measured with Microtrack grain size distribution measurement apparatus HRA (X-100) (manufactured by NIKKISO CO., LTD.), and the number average particle diameter was 0.15 μm.

<Preparation of Dispersion Liquid of Wax-2>

| | |
|---|---|
| Stearyl stearate (temperature of maximum endothermic peak 67° C.) | 16 parts by mass |
| Nitrile group-containing styrene acrylic resin (styrene/n-butylacrylate/acrylonitrile = 65/35/10 (mass ratio), peak molecular weight 8,500) | 8 parts by mass |
| Ethyl acetate | 76 parts by mass |

The whole was loaded into a glass beaker equipped with a stirring blade (manufactured by IWAKI CO., LTD.). By heating the inside of the system to 65° C., stearyl stearate was dissolved into ethyl acetate. Next, a dispersion liquid of wax-2 was obtained with the same operation as in the dispersion liquid of wax-1. The wax particle diameter in the dispersion liquid of wax-2 was measured with Microtrack grain size distribution measurement apparatus HRA (X-100) (manufactured by NIKKISO CO., LTD.), and a number average particle diameter was 0.12 μm.

<Preparation of Dispersion Liquid of Wax-3>

| | |
|---|---|
| Trimethylolpropane tribehenate (temperature of maximum endothermic peak 58° C.) | 16 parts by mass |

-continued

| | |
|---|---|
| Nitrile group-containing styrene acrylic resin (styrene/n-butylacrylate/acrylonitrile = 65/35/10 (mass ratio), peak molecular weight 8,500) | 8 parts by mass |
| Ethyl acetate | 76 parts by mass |

The whole was loaded into a glass beaker equipped with a stirring blade (manufactured by IWAKI CO., LTD.). By heating the inside of the system to 60° C., trimethylolpropane tribehenate was dissolved into ethyl acetate. Next, a dispersion liquid of wax-3 was obtained with the same operation as in the dispersion liquid of wax-1. The wax particle diameter in the dispersion liquid of wax-3 was measured with Microtrack grain size distribution measurement apparatus HRA (X-100) (manufactured by NIKKISO CO., LTD.), and a number average particle diameter was 0.18 μm.

<Preparation of Dispersion Liquid of Magnetic Substance-1>

| | |
|---|---|
| Ethyl acetate | 100 parts by mass |
| Polyester-1 | 50 parts by mass |
| Magnetite-1 (sphericity, number average particle diameter 0.22 μm, specific surface area 9.6 $m^2/g$, variation coefficient 44%, magnetization 68.4 $Am^2/kg$, residual magnetization 5.2 $Am^2/kg$) | 100 parts by mass |
| Glass beads (1 mm) | 100 parts by mass |

The above-mentioned raw materials were loaded into a heat-resistant glass container, and dispersed with a paint shaker (manufactured by Toyo Seiki Seisaku-sho, Ltd.) for 5 hours. The glass beads were removed with a nylon mesh, whereby a dispersion liquid of magnetic substance-1 was obtained.

<Preparation of Dispersion Liquid of Magnetic Substance-2>

| | |
|---|---|
| Polyester-2 | 50 parts by mass |
| Magnetite-2 (octahedron, number average particle diameter 0.18 μm, specific surface area 11.5 $m^2/g$, variation coefficient 48%, magnetization 69.3 $Am^2/kg$, residual magnetization 8.1 $Am^2/kg$) | 100 parts by mass |

The above-mentioned raw materials were loaded into a kneader-type mixer, and the temperature of the mixture was increased under no pressing while the mixture was stirred. The temperature was increased to 130° C. and the mixture was heated and melt-kneaded for about 10 minutes, whereby the magnetite was dispersed in the resin. After that, the kneading was continued with cooling, and the resultant was cooled to 80° C. 50 parts by mass of ethyl acetate were gradually added to the resultant. After the ethyl acetate was added, the temperature of the system was fixed to 75° C. and the mixture was kneaded for 30 minutes. Then, the mixture was cooled, whereby a kneaded product was obtained. Next, after the kneaded product was pulverized into coarse particles with a hammer, ethyl acetate was mixed into the coarse particles so that a solid concentration became 60 mass %. After that, the mixture was stirred at 8,000 rpm for 10 minutes using DISPER (manufactured by Tokushu Kika Kogyo), whereby a dispersion liquid of magnetic substance-2 was obtained.

<Preparation of Dispersion Liquid of Magnetic Substance-3>

| | |
|---|---|
| Magnetite-3 (octahedron, number average particle diameter 0.19 μm, specific surface area 10.9 $m^2/g$, variation coefficient 52%, magnetization 69.8 $Am^2/kg$, residual magnetization 9.3 $Am^2/kg$) | 250 parts by mass |
| Ethyl acetate | 250 parts by mass |
| Glass beads (1 mm) | 300 parts by mass |

The above-mentioned raw materials were loaded into a heat-resistant glass container, and dispersed with a paint shaker (manufactured by Toyo Seiki Seisaku-sho, Ltd.) for 5 hours. The glass beads were removed with a nylon mesh, whereby a dispersion liquid of magnetic substance-3 was obtained.

<Preparation of Dispersion Liquid of Magnetic Substance-4>

| | |
|---|---|
| Polyester-4 | 50 parts by mass |
| Magnetite-4 (sphericity, number average particle diameter 0.24 μm, specific surface area 7.4 $m^2/g$, variation coefficient 48%, magnetization 67.8 $Am^2/kg$, residual magnetization 5.3 $Am^2/kg$) | 100 parts by mass |

The above-mentioned raw materials were loaded into a kneader-type mixer, and the temperature of the mixture was increased under no pressing while the mixture was stirred. The temperature was increased to 130° C. and the mixture was heated and melt-kneaded for about 60 minutes, whereby the magnetite was dispersed in the resin. After that, the mixture was cooled, whereby a kneaded product was obtained. Next, the kneaded product was pulverized into coarse particles with a hammer, ethyl acetate was mixed into the coarse particles so that a solid concentration became 60 mass %. After that, the mixture was stirred at 8,000 rpm for 10 minutes using DISPER (manufactured by Tokushu Kika Kogyo), whereby a dispersion liquid of magnetic substance-4 was obtained.

<Preparation of Dispersion Liquid of Magnetic Substances-5>

| | |
|---|---|
| Polyester-5 | 50 parts by mass |
| Magnetite-5 (sphericity, number average particle diameter 0.23 μm, specific surface area 8.1 $m^2/g$, variation coefficient 47%, magnetization 67.5 $Am^2/kg$, residual magnetization 4.8 $Am^2/kg$) | 100 parts by mass |

The above-mentioned raw materials were loaded into a kneader-type mixer, and the temperature of the mixture was increased under no pressing while the mixture was stirred. The temperature was increased to 130° C. and the mixture was heated and melt-kneaded for about 60 minutes, whereby the magnetite was dispersed in the resin. After that, the mixture was cooled, whereby a kneaded product was obtained. Next, after the kneaded product was pulverized into coarse particles with a hammer, whereby a coarsely pulverized product was obtained.

| | |
|---|---|
| The above coarsely pulverized product | 150 parts by mass |
| Ethyl acetate | 100 parts by mass |
| Glass beads (1 mm) | 100 parts by mass |

The above-mentioned raw materials were loaded into a heat-resistant glass container, and dispersed with a paint shaker (manufactured by Toyo Seiki Seisaku-sho, Ltd.) for 5 hours. The glass beads were removed with a nylon mesh, whereby a dispersion liquid of magnetic substance-5 was obtained.

EXAMPLE 1

(Preparation of Oil Phase)

| | |
|---|---|
| Dispersion liquid of wax-1 | 50 parts by mass |
| Dispersion liquid of magnetic substance-1 | 75 parts by mass |
| Polyester resin solution-1 | 90 parts by mass |
| Triethyl amine | 0.5 part by mass |
| Ethyl acetate | 34.5 parts by mass |

The above-mentioned solutions were loaded into a container, and stirred and dispersed at 1,500 rpm for 10 minutes with HOMO DISPER (manufactured by Tokushii Kika Kogyo). Further, the solutions were dispersed for 30 minutes under normal temperature with an ultrasonic dispersing device, whereby an oil phase 1 was prepared.

(Preparation of Aqueous Phase)

The followings were loaded into a container and stirred at 5,000 rpm for 1 minute with TK-homomixer (manufactured by Tokushu Kika Kogyo), whereby an aqueous phase was prepared.

| | |
|---|---|
| Ion-exchanged water | 255 parts by mass |
| Dispersion liquid of resin fine particle-1 (5 parts by mass of resin fine particles were loaded with respect to 100 parts by mass of toner base particle) | 25 parts by mass |
| 50% aqueous solution of dodecyl diphenyl ether sodium disulfonate (ELEMINOL MON-7 manufactured by Sanyo Chemical Industries, Ltd.) | 25 parts by mass |
| Ethyl acetate | 30 parts by mass |

(Emulsifying and Desolvating Steps)

The oil phase was loaded into the aqueous phase, and the resultant was stirred continuously for 3 minutes with TK-homomixer in such a condition that the number of revolutions was up to 8,000 rpm, whereby the oil phase 1 was suspended. Next, a stirring blade was set to the container, the system was subjected to desolvation over 5 hours in the state where the temperature inside the system was increased to 50° C. while the system was stirred at 200 rpm and the pressure was reduced to 500 mmHg, whereby water dispersion liquid of toner particles was obtained.

(Washing to Drying Step)

Next, the water dispersion liquid of toner particles was filtered and the filtrate was charged into 500 parts by mass of ion-exchanged water so that reslurry was prepared. After that, while the system was stirred, hydrochloric acid was added to the system until the pH of the system reached 4. Then, the mixture was stirred for 5 minutes. The above slurry was filtrated again, 200 parts by mass of ion-exchanged water were added to the filtrate, and the mixture was stirred for 5 minutes; the operation was repeated three times. As a result, triethylamine remaining in the system was removed, whereby a filtrated cake of the toner particles was obtained. The above filtrated cake was dried with a warm air dryer at 45° C. for 3 days and sieved with a mesh having an aperture of 75 μm, whereby toner particles 1 were obtained.

(Preparation of Toner)

Next, with respect to 100 parts by mass of the toner particles 1, 0.7 part by mass of hydrophobic silica having the number average diameter of 20 nm and 3.0 parts by mass of strontium titanate having the number average diameter of 120 nm were mixed with a Henschel mixer, FM-10B (manufactured by MITSUI MIIKE MACHINERY Co., Ltd.). Thus, a toner 1 was obtained.

Table 3 shows the formulation of the toner and Table 4 shows physical properties thereof.

<Image Evaluation>

An evaluation method for the obtained toner is described. For the image evaluation, a commercially available monochrome printer manufactured by Canon Inc. (trade name: IR3570) was used. Table 5 shows the results of the image evaluation for toner.

A test machine for the image evaluation was left to stand in the environment of 23° C. and 5% RH overnight. The mode was set in such a manner, when printing a horizontal line pattern on a sheet having the print percentage of 3% was defined as one job, the test machine stopped once between a job and a job and the next job then started. A durability test was performed with output of 50,000 sheets using A4 normal paper (75 g/cm$^2$).

(1) Fogging

Evaluation for fogging was performed as follows: during the durability test, at the termination of 1,000-th sheet output, two solid white sheets were printed while amplitude of alternating components of the developing bias was set to 1.8 kV. Then, fogging of the second paper was measured by the following method.

Each of transfer material before and after the formation of an image was measured with a reflection densitometer (REFLECTOMETER MODEL TC-6DS manufactured by Tokyo Denshoku CO., LTD.). A worst value for the reflection density after the formation of the image was defined Ds. An average reflection density before the formation of image was defined Dr. Ds-Dr was obtained by subtracting Dr from Ds. The Ds-Dr was evaluated for fogging amount. With the smaller value, the fogging is demonstrated to be small. Evaluation criteria of the fogging are shown below.

A: Less than 1.0

B: 1.0 or more and less than 2.0

C: 2.0 or more and less than 3.5

D: 3.5 or more

<Evaluation for Fine-Line Reproducibility>

An evaluation for fine-line reproducibility was performed during the durability test at the termination of 1,000-th and 10,000-th sheet outputs. First, laser was exposed so that the line width of a latent image became 85 μm, whereby the fixed image printed on a thick paper (105 g/m$^2$) was used as a sample for measurement. As a measurement apparatus, a 450-particle analyzer, LUZEX (Nireco Corporation) was used. The line width was measured using a indicator from an enlarged monitor image. In this time, for the measurement position of line width, because there were irregularities in the width direction of the fine line image of the toner, an average line width of the irregularities was used as a measurement value. The fine-line reproducibility was evaluated by calculation of the ratio (image line width/latent image line width) of the image line width to the latent image line width (85 μm). Evaluation criteria of the fine-line reproducibility are shown below.

A: Less than 1.08

B: 1.08 or more and less than 1.12

C: 1.12 or more and less than 1.18

D: 1.18 or more (3) Transfer Efficiency

Transfer efficiency, following the fine-line reproducibility, was measured after the 1,000-th sheet output. A solid image was output in the setting conditions in which the fine-line reproducibility was measured. An image transferred on a transfer sheet and an image density of residue of the transfer on a photosensitive member were measured with a densitometer (X-rite 500 Series: X-rite). A laid-on level was calculated from the image density and the transfer efficiency on a transfer sheet was determined.

A: Transfer efficiency of toner is 95% or more.

B: Transfer efficiency of toner is 93% or more.

C: Transfer efficiency of toner is 90% or more.

D: Transfer efficiency of toner is less than 90%.

(4) Image Density

Image density was evaluated by the following procedures: an image after fixing was prepared using the test machine under normal-temperature, normal-humidity environment (23° C./60% RH) on Canon recycle paper EN-100 (Canon Inc.) while the toner laid-on level of a solid image was adjusted to 0.35 mg/cm$^2$.

The image was evaluated using a reflection densitometer, 500 Series Spectrodensotemeter manufactured by X-rite. Note that, when the toner is a black toner, a value evaluated by Visual was defined as a density value.

(5) Low-temperature Fixability

A solid unfixed image having the end blank of 5 mm, the width of 100 mm, and the length of 280 mm was prepared, using the test machine under normal-temperature, normal-humidity environment (23° C./60% RH) while the developing contrast was adjusted so that the toner laid-on level on paper was 0.35 mg/cm$^2$. As paper, an A4 thick paper ("PROVER BOND" 105 g/m$^2$ manufactured by FOX RIVER PAPER) was used. A fixing unit of the test machine was modified so that a fixing temperature of the fixing unit could be set by manual. In this state, a fixing test was performed between the range of 80° C. to 200° C. in the increment of 10° C. under a normal-temperature, normal-humidity environment (23° C./60% RH).

An image region of the obtained fixed image was rubbed with soft, thin paper (such as a trade name "Dasper" manufactured by OZU CORPORATION) for five reciprocations while a load of 4.9 kPa was applied to the image. The image densities of the image before and after the rubbing were measured, and the decreasing percentage of the image density ΔD (%) was calculated on the basis of the following equation. The temperature at which ΔD (%) described above was less than 10% was defined as a fixation starting temperature, serving as the criterion for the low-temperature fixability. It should be noted that the image density was measured with a color. reflection densitometer manufactured by X-Rite (Colorreflection densitometer X-Rite 404A).

$$\Delta D(\%)=\{(\text{image density before rubbing}-\text{image density after rubbing})/\text{image density before rubbing}\}\times 100$$

A: Fixation starting temperature is 120° C. or lower.
B: Fixation starting temperature is higher than 120° C. and 140° C. or lower.
C: Fixation starting temperature is higher than 140° C. and 160° C. or lower.
D: Fixation starting temperature is higher than 160° C.

Note that in the present invention, images of A rank and B rank were judged to have good low-temperature fixability.

(6) Evaluation for Charging Performance (Tribo)

Charging performance (tribo) was evaluated using triboelectric charge quantity of the toner.

Hereinafter, a measurement method for a triboelectric charge quantity of the toner is described.

Figure 3:
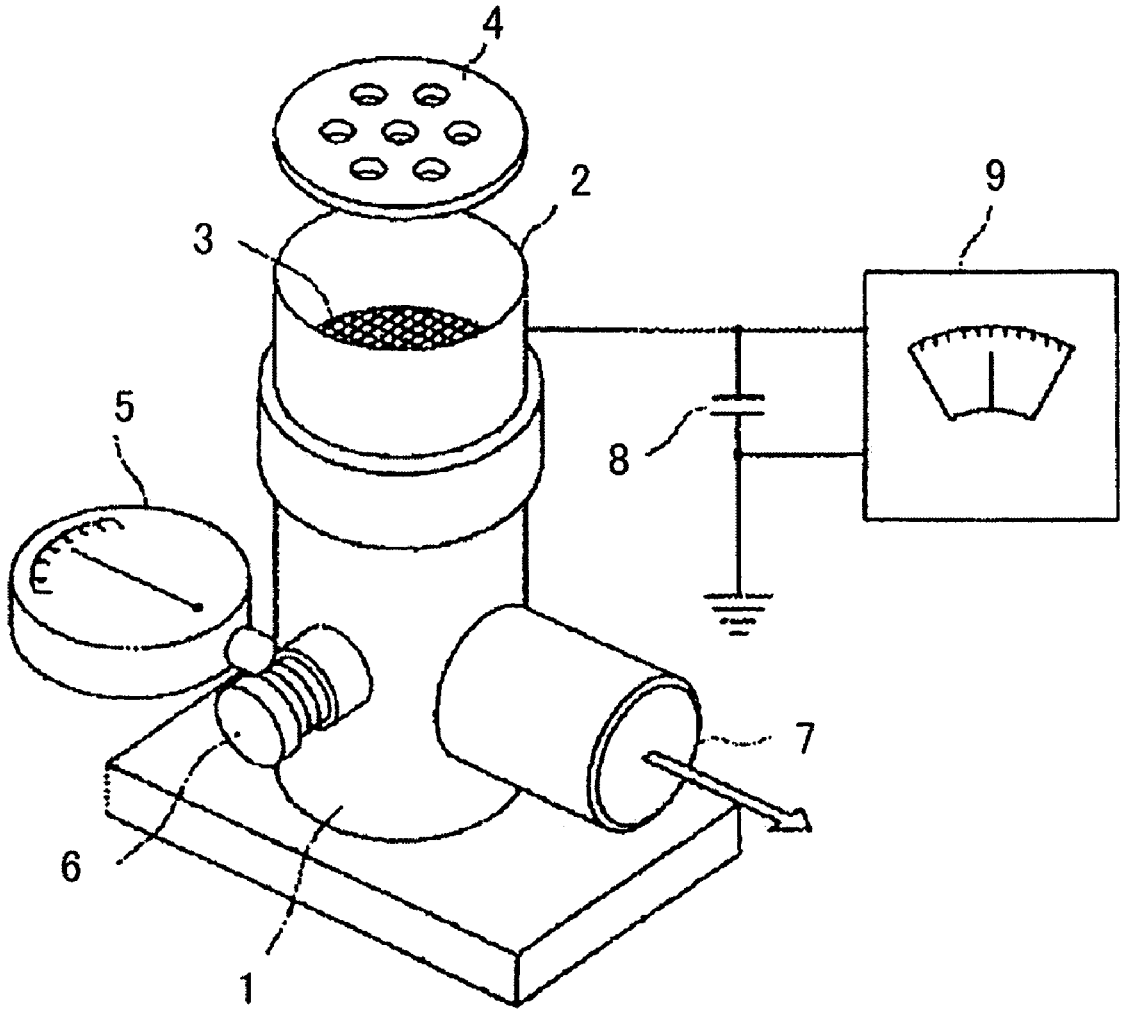
FIG. 3 is a schematic drawing of an apparatus for measuring a triboelectric charge quantity.

First, a predetermined carrier (a standard carrier defined by The Imaging Society of Japan: a spherical carrier the surface of which is treated with a ferrite core, N-01) and toner are put in a plastic bottle with a lid and shaken with a shaker (YS-LD, manufactured by YAYOI CHEMICAL INDUSTRY, CO., LTD.) for 1 minute at a speed of 4 reciprocations per 1 second, whereby a developer formed of the toner and the carrier is charged. Next, with an apparatus for measuring triboelectric charge quantity shown in FIG. 3, the triboelectric charge quantity is measured. In FIG. 3, about 0.5 to 1.5 g of the developer is charged into a measurement container made of metal 2 containing a 500-mesh screen 3 on the bottom and a lid made of metal 4 is put on the container. The weight of the entire measurement container 2 in this time is weighed and defined as W1 (*g*). Next, in an aspirator 1 (a portion in contact with the measurement container 2 is formed of at least an insulator), the air in the measurement container is aspirated from an aspiration port 7 and a air flow-controlling valve 6 is adjusted, whereby the pressure of a vacuum gauge 5 is set to 250 mmAq. In this state, aspiration is performed for 2 minutes and the toner is removed by aspiration. In this time, voltage shown in an electrometer 9 is defined as V (volt). Here, a volume of a condenser 8 is defined as C (mE). In addition, the weight of the entire measurement container after the aspiration is weighed to define as W2 (*g*). The triboelectric charge quantity (mC/kg) of the sample is calculated by the following formula.

$$\text{Triboelectric charge quantity (mC/kg) of the sample} = C \times V/(W1 - W2)$$

(7) Heat-Resistant Storage Stability

About 10 g of toner were put in a 100-ml polycup and left to stand at 50° C. for 3 days. The toner was evaluated by visual observation.

A: There is no aggregation.
B: There is aggregation but the aggregation easily collapses.
C: Aggregation can be caught but does not easily collapse.

COMPARATIVE EXAMPLE 1

Toner 2 was obtained in the same manner as in Example 1 except that the method including the following items (Preparation of aqueous phase), (Emulsifying and desolvating steps), and (Washing to drying step) was used in Example 1. Table 3 shows the formulation of the toner and Table 4 shows physical properties thereof. In addition, Table 5 shows the results of the image evaluation.

(Preparation of Aqueous Phase)

[Preparation of Inorganic-Based Aqueous Dispersion Substance]

451 parts by mass of a 0.1 mol/L aqueous solution of $Na_3PO_4$ were charged into 709 parts by mass of ion-exchanged water. After heated to 60° C., the mixture was stirred at 12,000 rpm with TK-homomixer (manufactured by Tokushu Kika Kogyo). 67.7 parts by mass of a 1.0 mol/L aqueous solution of $CaCl_2$ were gradually added, whereby an inorganic-based aqueous dispersion substance containing $Ca_3(PO_4)_2$ was obtained.

| | |
|---|---|
| The above-mentioned inorganic-based aqueous dispersion substance | 200 parts by mass |
| 50% aqueous solution of dodecyldiphenyl ether sodium disulfonate (ELEMINOL MON-7, manufactured by Sanyo Chemical Industries, Ltd.) | 4 parts by mass |
| Ethyl acetate | 16 parts by mass |

The whole was charged into a beaker, and stirred at 5,000 rpm for 1 minute with TK-homomixer. Thus, an aqueous phase was prepared.

(Emulsifying and Desolvating Steps)

The oil phase was loaded into the aqueous phase, and the resultant was stirred continuously for 3 minutes with TK-homomixer in such a condition that the number of revolutions was up to 8,000 rpm, whereby the oil phase 1 was suspended.

Next, a stirring blade was set to the beaker, the system was subjected to desolvation over 10 hours in a draft chamber in the state where the temperature inside the system was increased to 50° C. while the system was stirred at 200 rpm, whereby water dispersion liquid of toner particles was obtained.

(Washing to Drying Step)

The water dispersion liquid of toner particles was filtered and the filtrate was charged into 500 parts by mass of ion-exchanged water so that reslurry was prepared. After that, while the system was stirred, hydrochloric acid was added to the system until the pH of the system reached 1.5 to dissolve $Ca_3(PO_4)_2$. Then, the mixture was further stirred for 5 minutes.

The above slurry was filtrated again, 200 parts by mass of ion-exchanged water were added to the filtrate, and the mixture was stirred for 5 minutes; the operation was repeated three times. As a result, triethylamine remaining in the system was removed, whereby a filtrated cake of the toner particles was obtained. The above filtrated cake was dried with a warm air dryer at 45° C. for 3 days and sieved with a mesh having an aperture of 75 μm, whereby toner particles 2 were obtained.

COMPARATIVE EXAMPLE 2

Toner 3 was obtained in the same manner as in Example 1 except that the following aqueous phase was used instead of the aqueous phase used in Example 1. Table 3 shows the formulation of the toner and Table 4 shows physical properties thereof. In addition, Table 5 shows the results of the image evaluation.

(Preparation of Aqueous Phase)

The followings were loaded into a container and stirred at 5,000 rpm for 1 minute with TK-homomixer (manufactured by Tokushu Kika Kogyo), whereby an aqueous phase was prepared.

| | |
|---|---|
| Ion-exchanged water | 255 parts by mass |
| Dispersion liquid of resin fine particle-6 (5 parts by mass of resin fine particles were loaded with respect to 100 parts by mass of toner particles) | 25 parts by mass |

-continued

| | |
|---|---|
| 50% aqueous solution of dodecyl diphenyl ether sodium disulfonate (ELEMINOL MON-7 manufactured by Sanyo Chemical Industries, Ltd.) | 25 parts by mass |
| Ethyl acetate | 30 parts by mass |

COMPARATIVE EXAMPLES 3 and 4

Toners 4 and 5 were obtained in the same manner as in Example 1 except that the addition amounts of the dispersion liquid of magnetic substance-1 and the polyester resin solution-1 in the oil phase used in Example 1 were changed as shown in Table 3. Table 3 shows the formulation of the toner and Table 4 shows physical properties thereof. In addition, Table 5 shows the results of the image evaluation.

COMPARATIVE EXAMPLE 5

Toner 6 was obtained in the same manner as in Example 1 except that (Emulsifying and desolvating steps) were changed as described below in Example 1. Table 3 shows the formulation of the toner and Table 4 shows physical properties thereof. In addition, Table 5 shows the results of the image evaluation.

(Emulsifying and Desolvating Steps)

The oil phase was loaded into the aqueous phase, and the resultant was stirred continuously for 3 minutes with TK-homomixer in such a condition that the number of revolutions was up to 8,000 rpm, whereby the oil phase 1 was suspended.

Next, a stirring blade was set to the container, the system was subjected to desolvation over 5 hours in the state where the temperature inside the system was retained at 25° C. while the system was stirred at 200 rpm and the pressure was reduced to 200 mmHg, whereby water dispersion liquid of toner particles was obtained.

EXAMPLE 2

(Preparation of Oil Phase)

| | |
|---|---|
| Dispersion liquid of wax-1 | 50 parts by mass |
| Dispersion liquid of magnetic substance-2 | 112.5 parts by mass |
| Polyester resin solution-2 | 45 parts by mass |
| Triethyl amine | 0.5 part by mass |
| Ethyl acetate | 42 parts by mass |

The above-mentioned solutions were loaded into a container, and stirred and dispersed at 1,500 rpm for 10 minutes with HOMO DISPER (manufactured by Tokushu Kika Kogyo). Further, 100 parts by mass of glass beads were added to the above solution, the solutions were dispersed with a paint shaker (manufactured by Toyo Seiki Seisaku-sho, Ltd.) for 1 hour, and glass beads were removed with a nylon mesh, whereby an oil phase 7 was prepared.

(Preparation of Aqueous Phase)

The followings were loaded into a container and stirred at 5,000 rpm for 1 minute with TK-homomixer (manufactured by Tokushu Kika Kogyo), whereby an aqueous phase was prepared.

| | |
|---|---|
| Ion-exchanged water | 245 parts by mass |
| Dispersion liquid of resin fine particle-4 (7 parts by mass of resin fine particles were loaded with respect to 100 parts by mass of toner base particle) | 35 parts by mass |
| 50% aqueous solution of dodecyl diphenyl ether sodium disulfonate (ELEMINOL MON-7 manufactured by Sanyo Chemical Industries, Ltd.) | 25 parts by mass |
| Ethyl acetate | 30 parts by mass |

(Emulsifying and Desolvating Steps)

The oil phase 7 was loaded into the aqueous phase, and the resultant was stirred continuously for 3 minutes with TK-homomixer in such a condition that the number of revolutions was up to 8,000 rpm, whereby the oil phase 7 was suspended.

Next, a stirring blade was set to the container, the system was subjected to desolvation over 5 hours in the state where the temperature inside the system was increased to 50° C. while the system was stirred at 200 rpm and the pressure was reduced to 500 mmHg, whereby water dispersion liquid of toner particles was obtained.

(Washing to Drying Step)

Next, the water dispersion liquid of toner particles was filtered and the filtrate was charged into 500 parts by mass of ion-exchanged water so that reslurry was prepared. After that, while the system was stirred, hydrochloric acid was added to the system until the pH of the system reached 4. Then, the mixture was stirred for 5 minutes. The above slurry was filtrated again, 200 parts by mass of ion-exchanged water were added to the filtrate, and the mixture was stirred for 5 minutes; the operation was repeated three times. As a result, triethylamine remaining in the system was removed, whereby a filtrated cake of the toner particles was obtained.

The above filtrated cake was dried with a warm air dryer at 45° C. for 3 days and sieved with a mesh having an aperture of 75 μm, whereby toner particles 7 were obtained.

(Preparation of Toner)

Next, with respect to 100 parts by mass of the toner particles 7, 0.7 part by mass of hydrophobic silica having the number average diameter of 20 nm and 3.0 parts by mass of strontium titanate having the number average diameter of 120 nm were mixed with a Henschel mixer, FM-10B (manufactured by MITSUI MIIKE MACHINERY Co., Ltd.). Thus, a toner 7 was obtained.

Table 3 shows the formulation of the toner and Table 4 shows physical properties thereof. In addition, Table 5 shows the results of the image evaluation.

EXAMPLE 3

Toner 8 was obtained in the same manner as in Example 2 except that the addition amounts of the dispersion liquid of magnetic substance-2 and the polyester resin solution-2 in the oil phase used in Example 2 and the addition amount of the dispersion liquid of resin fine particle-4 were changed as shown in Table 3.

Table 3 shows the formulation of the toner and Table 4 shows physical properties thereof. In addition, Table 5 shows the results of the image evaluation.

EXAMPLE 4

(Preparation of Oil Phase)

| | |
|---|---|
| Dispersion liquid of wax-2 | 62.5 parts by mass |
| Dispersion liquid of magnetic substance-3 | 70.0 parts by mass |
| Polyester resin solution-3 | 100.0 parts by mass |
| Triethyl amine | 0.5 part by mass |
| Ethyl acetate | 17.0 parts by mass |

The above-mentioned solutions were loaded into a container, and stirred and dispersed at 1,500 rpm for 10 minutes with HOMO DISPER (manufactured by Tokushu Kika Kogyo). Further, the solutions were dispersed for 30 minutes under normal temperature with an ultrasonic dispersing device, whereby an oil phase 9 was prepared.

(Preparation of Aqueous Phase)

The followings were loaded into a container and stirred at 5,000 rpm for 1 minute with TK-homomixer (manufactured by Tokushu Kika Kogyo), whereby an aqueous phase was prepared.

| | |
|---|---|
| Ion-exchanged water | 215.0 parts by mass |
| Dispersion liquid of resin fine particle-2 (13.0 parts by mass of resin fine particles were loaded with respect to 100 parts by mass of toner base particle) | 65.0 parts by mass |
| 50% aqueous solution of dodecyl diphenyl ether sodium disulfonate (ELEMINOL MON-7 manufactured by Sanyo Chemical Industries, Ltd.) | 25.0 parts by mass |
| Ethyl acetate | 30.0 parts by mass |

Toner 9 was obtained with the same steps after (Emulsifying and desolvating steps) in Example 1. Table 3 shows the formulation of the toner and Table 4 shows physical properties thereof. In addition, Table 5 shows the results of the image evaluation.

EXAMPLE 5

(Preparation of Oil Phase)

| | |
|---|---|
| Dispersion liquid of wax-3 | 62.5 parts by mass |
| Dispersion liquid of magnetic substance-4 | 62.5 parts by mass |
| Polyester resin solution-4 | 95 parts by mass |
| Triethyl amine | 0.5 part by mass |
| Ethyl acetate | 29.5 parts by mass |

The above-mentioned solutions were loaded into a container, and stirred and dispersed at 1,500 rpm for 10 minutes with HOMO DISPER (manufactured by Tokushu Kika Kogyo). Further, the solutions were dispersed for 30 minutes under normal temperature with an ultrasonic dispersing device, whereby an oil phase 10 was prepared.

(Preparation of Aqueous Phase)

The followings were loaded into a container and stirred at 5,000 rpm for 1 minute with TK-homomixer (manufactured by Tokushu Kika Kogyo), whereby an aqueous phase was prepared.

| | |
|---|---|
| Ion-exchanged water | 265 parts by mass |
| Dispersion liquid of resin fine particle-3 (3 parts by mass of resin fine particles were loaded with respect to 100 parts by mass of toner base particle) | 15 parts by mass |
| 50% aqueous solution of dodecyl diphenyl ether sodium disulfonate (ELEMINOL MON-7 manufactured by Sanyo Chemical Industries, Ltd.) | 25 parts by mass |
| Ethyl acetate | 30 parts by mass |

Toner 10 was obtained with the same steps after (Emulsifying and desolvating steps) in Example 1. Table 3 shows the formulation of the toner and Table 4 shows physical properties thereof. In addition, Table 5 shows the results of the image evaluation.

EXAMPLE 6

(Preparation of Oil Phase)

| | |
|---|---|
| Dispersion liquid of wax-1 | 50.0 parts by mass |
| Dispersion liquid of magnetic substance-5 | 100.0 parts by mass |
| Polyester resin solution-5 | 60.0 parts by mass |
| Triethyl amine | 0.5 part by mass |
| Ethyl acetate | 39.5 parts by mass |

The above-mentioned solutions were loaded into a container, and stirred and dispersed at 1,500 rpm for 10 minutes with HOMO DISPER (manufactured by Tokushu Kika Kogyo). Further, the solutions were dispersed for 30 minutes under normal temperature with an ultrasonic dispersing device, whereby an oil phase 11 was prepared.

(Preparation of Aqueous Phase)

The followings were loaded into a container and stirred at 5,000 rpm for 1 minute with TK-homomixer (manufactured by Tokushu Kika Kogyo), whereby an aqueous phase was prepared.

| | |
|---|---|
| Ion-exchanged water | 267.5 parts by mass |
| Dispersion liquid of resin fine particle-5 (2.5 parts by mass of resin fine particles were loaded with respect to 100 parts by mass of toner base particle) | 12.5 parts by mass |
| 50% aqueous solution of dodecyl diphenyl ether sodium disulfonate (ELEMINOL MON-7 manufactured by Sanyo Chemical Industries, Ltd.) | 25 parts by mass |
| Ethyl acetate | 30 parts by mass |

Toner 11 was obtained with the same steps after (Emulsifying and desolvating steps) in Example 1. Table 3 shows the formulation of the toner and Table 4 shows physical properties thereof. In addition, Table 5 shows the results of the image evaluation.

EXAMPLE 7

(Preparation of Oil Phase)

| | |
|---|---|
| Dispersion liquid of wax-1 | 50.0 parts by mass |
| Dispersion liquid of magnetic substance-2 | 100.0 parts by mass |
| Polyester resin solution-2 | 60.0 parts by mass |
| Triethyl amine | 0.5 part by mass |
| Ethyl acetate | 39.5 parts by mass |

The above-mentioned solutions were loaded into a container, and stirred and dispersed at 1,500 rpm for 10 minutes with HOMO DISPER (manufactured by Tokushu Kika Kogyo), whereby an oil phase 12 was prepared.

(Preparation of Aqueous Phase)

The followings were loaded into a container and stirred at 5,000 rpm for 1 minute with TK-homomixer (manufactured by Tokushu Kika Kogyo), whereby an aqueous phase was prepared.

| | |
|---|---|
| Ion-exchanged water | 267.5 parts by mass |
| Dispersion liquid of resin fine particle-4 (2.5 parts by mass of resin fine particles were loaded with respect to 100 parts by mass of toner base particle) | 12.5 parts by mass |
| 50% aqueous solution of dodecyl diphenyl ether sodium disulfonate (ELEMINOL MON-7 manufactured by Sanyo Chemical Industries, Ltd.) | 25 parts by mass |
| Ethyl acetate | 30 parts by mass |

Toner 12 was obtained with the same steps after (Emulsifying and desolvating steps) in Example 1. Table 3 shows the formulation of the toner and Table 4 shows physical properties thereof. In addition, Table 5 shows the results of the image evaluation.

TABLE 3

| | Toner base particle (A) | | | | | | | | | | Surface layer (B) | |
|---|---|---|---|---|---|---|---|---|---|---|---|---|
| | Binder resin (a) | | Wax | | Dispersant | | Magnetic substance | | Resin for dispersing magnetic substance | | Resin (b) | |
| | Kind | Addition amount (parts by mass) | Kind | Addition amount (parts by mass) | Kind | Addition amount (parts by mass) | Kind | Addition amount (parts by mass) | Kind | Addition amount (parts by mass) | Kind | Addition amount (parts by mass) |
| Toner 1 | Polyester-1 | 45.0 | Carnauba-1 | 10.0 | — | — | Magnetite-1 | 30.0 | Polyester-1 | 15.0 | Urethane-1 | 5.0 |
| Toner 2 | Polyester-1 | 45.0 | Carnauba-1 | 10.0 | — | — | Magnetite-1 | 30.0 | Polyester-1 | 15.0 | — | — |
| Toner 3 | Polyester-1 | 45.0 | Carnauba-1 | 10.0 | — | — | Magnetite-1 | 30.0 | Polyester-1 | 15.0 | Urethane-4 | 5.0 |
| Toner 4 | Polyester-1 | 63.0 | Carnauba-1 | 10.0 | — | — | Magnetite-1 | 18.0 | Polyester-1 | 9.0 | Urethane-1 | 5.0 |
| Toner 5 | Polyester-1 | 15.0 | Carnauba-1 | 10.0 | — | — | Magnetite-1 | 50.0 | Polyester-1 | 25.0 | Urethane-1 | 5.0 |
| Toner 6 | Polyester-1 | 45.0 | Carnauba-1 | 10.0 | — | — | Magnetite-1 | 30.0 | Polyester-1 | 15.0 | Urethane-1 | 5.0 |
| Toner 7 | Polyester-2 | 22.5 | Carnauba-1 | 10.0 | — | — | Magnetite-2 | 45.0 | Polyester-2 | 22.5 | Urethane-2 | 7.0 |
| Toner 8 | Polyester-2 | 60.0 | Carnauba-1 | 10.0 | — | — | Magnetite-2 | 20.0 | Polyester-2 | 10.0 | Urethane-2 | 8.5 |
| Toner 9 | Polyester-3 | 50.0 | Ester-1 | 10.0 | Dispersant | 5.0 | Magnetite-3 | 35.0 | — | — | Polyester | 13.0 |
| Toner 10 | Polyester-4 | 47.5 | Ester-2 | 10.0 | Dispersant | 5.0 | Magnetite-4 | 25.0 | Polyester-4 | 12.5 | St-Ac | 3.0 |
| Toner 11 | Polyester-5 | 30.0 | Carnauba-1 | 10.0 | — | — | Magnetite-5 | 40.0 | Polyester-5 | 20.0 | Urethane-3 | 2.5 |
| Toner 12 | Polyester-2 | 30.0 | Carnauba-1 | 10.0 | — | — | Magnetite-2 | 40.0 | Polyester-2 | 20.0 | Urethane-2 | 2.5 |

TABLE 4

| | Particle diameter | | Number % of particles having 0.6 μm or more and 2.0 μm or less | | | Toner | Dielectric | Volume | Number average dispersed-particle diameter |
|---|---|---|---|---|---|---|---|---|---|
| | (D4) μm | D4/D1 | Initial stage | After ultrasonic dispersion | Average circularity | magnetization $Am^2/kg$ | loss tanδ | resistivity Ω · cm | (magnetic substance) nm |
| Toner 1 | 5.5 | 1.21 | 1.3 | 1.5 | 0.981 | 19.5 | 0.007 | $4 \times 10^{14}$ | 270 |
| Toner 2 | 5.5 | 1.24 | 1.7 | 1.8 | 0.978 | 20.5 | 0.008 | $2 \times 10^{13}$ | 280 |
| Toner 3 | 5.5 | 1.22 | 1.4 | 1.6 | 0.973 | 19.5 | 0.012 | $3 \times 10^{14}$ | 310 |
| Toner 4 | 5.5 | 1.20 | 1.5 | 1.6 | 0.968 | 11.7 | 0.006 | $6 \times 10^{14}$ | 250 |
| Toner 5 | 5.5 | 1.27 | 1.7 | 1.9 | 0.965 | 32.6 | 0.022 | $8 \times 10^{13}$ | 530 |
| Toner 6 | 5.5 | 1.24 | 1.6 | 1.7 | 0.952 | 19.5 | 0.010 | $3 \times 10^{14}$ | 260 |
| Toner 7 | 5.5 | 1.23 | 1.6 | 1.8 | 0.981 | 29.1 | 0.013 | $2 \times 10^{14}$ | 230 |
| Toner 8 | 5.5 | 1.16 | 1.3 | 1.4 | 0.983 | 12.8 | 0.006 | $9 \times 10^{14}$ | 420 |
| Toner 9 | 5.5 | 1.21 | 1.4 | 1.7 | 0.968 | 21.6 | 0.018 | $4 \times 10^{14}$ | 520 |
| Toner 10 | 5.5 | 1.33 | 1.8 | 3.4 | 0.971 | 16.5 | 0.011 | $6 \times 10^{14}$ | 320 |
| Toner 11 | 5.5 | 1.18 | 1.5 | 1.7 | 0.976 | 26.3 | 0.009 | $5 \times 10^{14}$ | 340 |
| Toner 12 | 5.5 | 1.20 | 3.3 | 4.7 | 0.980 | 27.0 | 0.019 | $5 \times 10^{13}$ | 570 |

TABLE 5

| | | Heat-resistant storage stability | Low-temperature fixability | Toribo (mC/kg) | Image density | Fogging | Transfer efficiency | Fine-line reproducibility After 1,000-th sheet output | Fine-line reproducibility After 10,000-th sheet output |
|---|---|---|---|---|---|---|---|---|---|
| Example 1 | Toner 1 | A | A | −23 | 1.42 | A | A | A | A |
| Comparative Example 1 | Toner 2 | C | A | −12 | 1.38 | B | B | A | D |
| Comparative Example 2 | Toner 3 | C | A | −18 | 1.4 | B | A | B | D |
| Comparative Example 3 | Toner 4 | A | A | −26 | 1.23 | C | A | A | A |
| Comparative Example 4 | Toner 5 | A | A | −17 | 1.45 | B | A | B | C |
| Comparative Example 5 | Toner 6 | A | A | −19 | 1.32 | B | C | A | A |
| Example 2 | Toner 7 | A | A | −25 | 1.44 | A | A | A | B |
| Example 3 | Toner 8 | A | A | −22 | 1.38 | A | A | A | A |
| Example 4 | Toner 9 | A | A | −21 | 1.41 | A | A | B | B |
| Example 5 | Toner 10 | A | A | −24 | 1.39 | B | A | B | B |
| Example 6 | Toner 11 | A | A | −23 | 1.43 | A | A | A | A |
| Example 7 | Toner 12 | A | A | −16 | 1.41 | B | B | B | B |

<Preparation of Resin (a1)-1>

The followings were charged into a reactor equipped with a cooling pipe, a nitrogen introducing pipe, and a stirring machine.

| | |
|---|---|
| Propylene glycol | 800 parts by mass |
| Dimethyl terephthalate | 760 parts by mass |
| Adipic acid | 300 parts by mass |
| Tetrabutoxy titanate (condensation catalyst) | 3 parts by mass |

The whole was subjected to a reaction for 8 hours at 180° C. in a stream of nitrogen while generated methanol was distilled off. Next, while the temperature was increased to 230° C. gradually and generated water and the like were distilled off in a stream of nitrogen, the obtained mixture was subjected to a reaction for 4 hours, followed by a reaction under a reduced pressure of 20 mmHg. Then, the resultant was removed at the time when the softening point of the resultant became 90° C. After cooled to room temperature, the removed resin was pulverized into particles, whereby a resin (a1)-1 as a linear polyester resin using an aliphatic diol was obtained. Table 6 shows physical. properties thereof.

<Preparation of Resin (a1)-2>

The followings were charged into a reactor equipped with a cooling pipe, a nitrogen introducing pipe, and a stirring machine.

| | |
|---|---|
| Bisphenol derivative represented by the following formula (A) where R represents an ethylene group and an average value of x + y is 2 [Chem. 2] | 1,600 parts by mass |
| Dimethyl terephthalate | 350 parts by mass |
| Adipic acid | 180 parts by mass |
| Tetrabutoxy titanate (condensation catalyst) | 3 parts by mass |

(A)

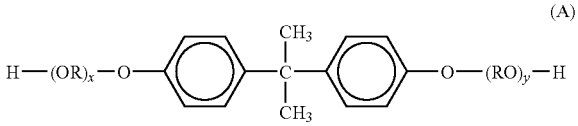

A resin (a1)-2 as an aromatic linear polyester resin was obtained in the same manner as in preparation of the resin (a1)-1. Table 6 shows physical properties thereof.

<Preparation of Resin (a1)-3>

A resin (a1)-3 as an aromatic linear polyester resin was obtained in the same manner as in preparation of the resin (a1)-2 except that the amount of tetrabutoxy titanate (condensation catalyst) was changed to 2 parts by mass and the temperature increase was suppressed to up to 210° C. Table 6 shows physical properties thereof.

<Preparation of Resin (a1)-4>

The followings were charged into a reactor equipped with a cooling pipe, a nitrogen introducing pipe, and a stirring machine.

| | |
|---|---|
| Bisphenol derivative represented by the following formula (A) where R represents an ethylene group and an average value of x + y is 2 | 1,300 parts by mass |
| Dimethyl terephthalate | 500 parts by mass |
| Adipic acid | 250 parts by mass |
| Tetrabutoxy titanate (condensation catalyst) | 3 parts by mass |

A resin (a1)-4 as an aromatic linear polyester resin was obtained in the same manner as in preparation of the resin (a1)-1. Table 6 shows physical properties thereof.

<Preparation of Resin (a1)-5>

The followings were charged into a reactor equipped with a cooling pipe, a nitrogen introducing pipe, and a stirring machine.

| | |
|---|---|
| Styrene | 320 parts by mass |
| n-butyl acrylate | 146 parts by mass |
| Methacrylic acid | 11 parts by mass |

Further, 8 parts by mass of 2,2'-azobis(2,4-dimethylvaleronitrile) as a polymerization initiator were charged into the mixture, followed by polymerization at 60° C. for 8 hours. The temperature was increased to 150° C. and the resultant was then removed from the reactor. After cooled to room temperature, the resultant was pulverized into particles, whereby a resin (a1)-5 as a linear vinyl resin was obtained. Table 6 shows physical properties thereof.

<Preparation of Resin (a2)-1>

The followings were charged into a reactor equipped with a cooling pipe, a nitrogen introducing pipe, and a stirring machine.

| | |
|---|---|
| Propylene glycol | 800 parts by mass |
| Dimethyl terephthalate | 815 parts by mass |
| Adipic acid | 263 parts by mass |
| Tetrabutoxy titanate (condensation catalyst) | 3 parts by mass |

The whole was subjected to a reaction at 180° C. for 8 hours in a stream of nitrogen while generated methanol was distilled off. Next, the temperature of the resultant was increased gradually to 230° C., the resultant was subjected to a reaction for 4 hours in a stream of nitrogen, while generated water and the like were distilled off. The obtained resultant was further subjected to a reaction for 1 hour under a reduced pressure of 20 mmHg and then cooled to 180° C. 173 parts by mass of trimellitic anhydride were added to the resultant, and the obtained mixture was subjected to a reaction for 2 hours under sealing at normal pressure, followed by a reaction at 220° C. and normal pressure. The resultant was removed at the point when the softening point of the resultant became 180° C. After cooled to room temperature, the removed resin was pulverized into particles, whereby a resin (a2)-1 as a non-linear polyester resin was obtained. Table 6 shows physical properties thereof.

<Preparation of Resin (a2)-2>

The followings were charged into a reactor equipped with a cooling pipe, a nitrogen introducing pipe, and a stirring machine.

| | |
|---|---|
| 1,4-butanediol | 928 parts by mass |
| Dimethyl terephthalate | 776 parts by mass |
| Adipic acid | 292 parts by mass |
| Tetrabutoxy titanate (condensation catalyst) | 3 parts by mass |

The whole was subjected to a reaction at 180° C. for 8 hours in a stream of nitrogen while generated methanol was distilled off. Next, the temperature of the resultant was increased gradually to 230° C., the resultant was subjected to a reaction for 4 hours in a stream of nitrogen, while generated water and the like were distilled off. The obtained resultant was further subjected to a reaction for 1 hour under a reduced pressure of 20 mmHg and then cooled to 180° C. 115 parts by mass of trimellitic anhydride were added to the resultant, and the obtained mixture was subjected to a reaction for 2 hours under sealing at normal pressure, followed by a reaction at 220° C. and normal pressure. The resultant was removed at the point when the softening point of the resultant became 180° C. After cooled to room temperature, the removed resin was pulverized into particles, whereby a resin (a2-2) as a non-linear polyester resin was obtained. Table 6 shows physical properties thereof.

<Preparation of Resin (a2)-3>

Production Example 1 of Aromatic Titanium Carboxylate Compound

After 19.6 parts by mass of terephthalic acid were dissolved into 100 parts by mass of pyridine, 80.4 parts by mass of tetra-n-butoxy titanate were dropped to the solution. The mixture was kept in a nitrogen atmosphere at 40° C. for 2 hours and thus tetra-n-butoxy titanate and terephthalic acid were reacted each other. After that, pyridine and butanol as a reaction product were distilled off by vacuum distillation, whereby an aromatic titanium carboxylate compound 1 was obtained.

| | |
|---|---|
| Bisphenol derivative represented by the following formula (A) where R represents an ethylene group and an average value of x + y is 2 | 200 parts by mass |
| Bisphenol derivative represented by the following formula (A) where R represents a propylene group and an average value of x + y is 3 | 200 parts by mass |
| Terephthalic acid | 180 parts by mass |

[Chem. 3]

(A)

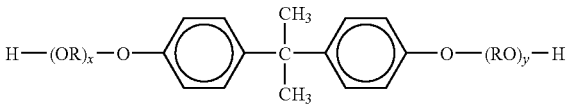

4 parts by mass of the aromatic titanium carboxylate compound 1 as a catalyst were added to the above-mentioned compounds, followed by a condensation polymerization at 230° C. for 10 hours. Here, 30 parts by mass of trimellitic anhydride and 2 parts by mass of titanyl potassium oxalate as additional catalysts were added to the mixture, whereby the condensation polymerization was proceeded. Thus, a resin (a2)-3 as a crosslinking aromatic polyester resin was obtained.

<Preparation of Resin (a2)-4>

The followings were charged into a reactor equipped with a cooling pipe, a nitrogen introducing pipe, and a stirring machine.

| | |
|---|---|
| Styrene | 320 parts by mass |
| n-butyl acrylate | 146 parts by mass |
| Methacrylic acid | 11 parts by mass |
| Divinylbenzene | 5.5 parts by mass |

Further, 8 parts by mass of 2,2'-azobis(2,4-dimethylvaleronitrile) as a polymerization initiator were charged into the mixture, followed by polymerization at 60° C. for 8 hours. The temperature was increased to 150° C. and the resultant was then removed from the reactor. After cooled to room temperature, the resultant was pulverized into particles, whereby a resin (a2)-4 as a linear vinyl resin was obtained. Table 6 shows physical properties thereof.

TABLE 6

| | Composition | Tg (° C.) | Softening point (° C.) | Weight average molecular weight of THF-soluble matter Mw | Number average molecular weight of THF-soluble matter Mn | Mw/Mn | Acid value (mgKOH/g) |
|---|---|---|---|---|---|---|---|
| Resin (a1)-1 | Aliphatic polyester | 45 | 74 | 3,900 | 1,900 | 2.1 | 14 |
| Resin (a1)-2 | Aromatic polyester | 46 | 78 | 3,100 | 1,400 | 2.2 | 14 |
| Resin (a1)-3 | Aromatic polyester | 43 | 79 | 1,600 | 900 | 1.8 | 41 |
| Resin (a1)-4 | Aromatic polyester | 47 | 104 | 6,500 | 1,100 | 5.9 | 17 |
| Resin (a1)-5 | Vinyl | 43 | 81 | 3,700 | 2,600 | 1.4 | 0 |
| Resin (a2)-1 | Aliphatic polyester | 65 | 154 | 168,000 | 5,900 | 28.5 | 1 |
| Resin (a2)-2 | Aliphatic polyester | 61 | 124 | 28,000 | 5,100 | 5.5 | 17 |
| Resin (a2)-3 | Aromatic polyester | 57 | 136 | 91,000 | 3,600 | 25.3 | 21 |
| Resin (a2)-4 | Vinyl | 63 | 147 | 84,000 | 5,500 | 15.3 | 0 |

The resins (a1)-1 to (a1)-5 and resins (a2)-1 to (a2)-4 were mixed at the ratios shown in Table 7, and thus the binder resins (a)-1 to (a)-16 were obtained.

TABLE 7

| | Resin (a1) | | Resin (a2) | |
|---|---|---|---|---|
| | Kind | Parts by mass | Kind | Parts by mass |
| Binder resin (a)-1 | Resin (a1-2) | 50 | Resin (a2-3) | 6 |
| Binder resin (a)-2 | Resin (a1-5) | 43 | Resin (a2-3) | 11 |
| Binder resin (a)-3 | Resin (a1-5) | 43 | Resin (a2-4) | 6 |
| Binder resin (a)-4 | Resin (a1-4) | 58 | Resin (a2-1) | 10 |
| Binder resin (a)-5 | Resin (a1-3) | 33 | — | — |
| Binder resin (a)-6 | Resin (a1-1) | 10 | Resin (a2-1) | 44 |
| Binder resin (a)-7 | Resin (a1-2) | 52 | Resin (a2-3) | 4 |
| Binder resin (a)-8 | Resin (a1-2) | 55 | Resin (a2-3) | 1 |
| Binder resin (a)-9 | Resin (a1-1) | 42 | Resin (a2-2) | 9 |
| Binder resin (a)-10 | Resin (a1-2) | 44 | Resin (a2-3) | 14 |
| Binder resin (a)-11 | Resin (a1-1) | 34 | Resin (a2-2) | 22 |
| Binder resin (a)-12 | Resin (a1-2) | 49 | Resin (a2-3) | 7 |
| Binder resin (a)-13 | Resin (a1-2) | 50 | Resin (a2-3) | 6 |
| Binder resin (a)-14 | Resin (a1-2) | 50 | Resin (a2-3) | 6 |
| Binder resin (a)-15 | Resin (a1-2) | 50 | Resin (a2-3) | 6 |
| Binder resin (a)-16 | Resin (a1-2) | 48 | Resin (a2-3) | 8 |

<Preparation of Dispersion Liquid of Resin Fine Particles 1>

The followings were charged into an autoclave equipped with a temperature gauge and a stirring machine, and the whole was subjected to an ester exchange reaction by heating at 190° C. for 120 minutes.

| | |
|---|---|
| Dimethyl terephthalate | 116 parts by mass |
| Dimethyl isophthalate | 66 parts by mass |
| 5-sodium sulfoisophthalate methyl ester | 30 parts by mass |
| Trimellitic anhydride | 5 parts by mass |
| Propylene glycol | 150 parts by mass |
| Tetrabutoxy titanate | 0.1 part by mass |

Next, the temperature of the reaction system was increased to 220° C. and the pressure of the system was set to 10 mmHg, followed by a continuous reaction for 50 minute. Thus, a raw material resin 1 was obtained.

40 parts by mass of the raw material resin 1, 15 parts by mass of methyl ethyl. ketone, and 10 parts by mass of tetrahydrofuran were dissolved at 80° C. After that, 60 parts by mass of water at 80° C. were added to the mixture with stirring, and thus an aqueous dispersion substance of polyester resin was obtained. The aqueous dispersion substance was diluted with ion-exchanged water so as to have a solid content ratio of 13%, whereby a dispersion liquid of resin fine particles 1 was obtained. Table 8 shows physical properties thereof.

<Preparation of Dispersion Liquid of Resin Fine Particles 2>

The followings were charged into an autoclave equipped with a temperature gauge and a stirring machine, and the whole was subjected to an ester exchange reaction by heating at 190° C. for 120 minutes.

| | |
|---|---|
| Dimethyl terephthalate | 116 parts by mass |
| Dimethyl isophthalate | 66 parts by mass |
| 5-sodium sulfoisophthalate methyl ester | 30 parts by mass |
| Trimellitic anhydride | 12 parts by mass |
| Polyoxypropylene(2.2)-2,2-bis(4-hydroxyphenyl)propane | 190 parts by mass |
| Tetrabutoxy titanate | 0.1 part by mass |

Next, the temperature of the reaction system was increased to 220° C. and the pressure of the system was set to 10 mmHg, followed by a continuous reaction for 50 minute. Thus, a raw material resin 2 was obtained.

40 parts by mass of the raw material resin 2, 15 parts by mass of methyl ethyl ketone, and 10 parts by mass of tetrahydrofuran were dissolved at 80° C. After that, 60 parts by mass of water at 80° C. were added to the mixture with stirring, and thus an aqueous dispersion substance of polyester resin was obtained. The aqueous dispersion substance was diluted with ion-exchanged water so as to have a solid content ratio of 13%, whereby a dispersion liquid of resin fine particles 2 was obtained. Table 8 shows physical properties thereof.

<Preparation of Dispersion Liquid of Resin Fine Particles 3>

| | |
|---|---|
| Ion-exchanged water | 100 parts by mass |
| Sodium salt of a methacrylic acid ethylene oxide adduct sulfate (ELEMINOL RS-30, manufactured by Sanyo Chemical Industries, Ltd.) | 20 parts by mass |

The whole was charged into a reactor capable of being sealed. When the whole were stirred at 500 rpm using a stirring blade,

| | |
|---|---|
| Styrene | 120 parts by mass |
| Sodium styrene sulfonate | 30 parts by mass |
| 1 mol/L aqueous solution of sodium hydroxide | 3 parts by mass |
| Butyl acrylate | 10 parts by mass |

a mixture of the above-mentioned monomers was dropped over 1 hour. Further, 400 parts by mass of ion-exchanged water and 100 g of a 2% aqueous solution of potassium persulfate were charged into the container, and the temperature of the container was increased to 90° C. and kept for 30 minutes. Next, 540 g of a 2% aqueous solution of potassium persulfate were filled in a dropping apparatus connected to the reactor. While the content of the reactor was stirred at 100 rpm with a stirring blade, the 2% aqueous solution of potassium persulfate was dropped over 5 hours, followed by an emulsion polymerization. After termination of the dropping, the stirring was continued for 30 minutes, and the temperature of the resultant was cooled to room temperature. Then, the resultant was diluted with ion-exchanged water so as to have a solid content ratio of 13%, and thus a dispersion liquid of resin fine particles 3 was obtained. Table 8 shows physical properties thereof.

<Preparation of Dispersion Liquid of Resin Fine Particles 4>

| | |
|---|---|
| Polyester resin having a weight average molecular weight of about 1,000 obtained by polycondensation of 1,3-propane diol and adipic acid | 265 parts by mass |
| 1,9-nonane diol | 100 parts by mass |
| Dimethylol propanoic acid | 170 parts by mass |
| 3-(2,3-dihydroxypropoxy)-1-propane sulfonate | 10 parts by mass |

The above-mentioned materials were dissolved into 500 parts by mass of acetone, and

| | |
|---|---|
| Isophorone diisocyanate | 440 parts by mass |

was added to the mixture, followed by a reaction at 60° C. for 4 hours. 130 parts by mass of triethyl amine were charged into the reaction product to neutralize an carboxyl group of dimethylol propanoic acid. The acetone solution was dropped to 1,300 parts by mass of ion-exchanged water with stirring to emulsify the mixture. Next, the emulsified resultant was diluted with ion-exchanged water so as to have a solid content ratio of 13%, whereby a dispersion liquid of resin fine particles 4 was obtained. Table 8 shows physical properties thereof.

<Preparation of Dispersion Liquid of Resin Fine Particles 5>

| | |
|---|---|
| Polyester resin having a weight average molecular weight of about 1,000 obtained by polycondensation of 1,3-propane diol and adipic acid | 220 parts by mass |
| Neopentyl glycol | 70 parts by mass |
| Dimethylol propanoic acid | 170 parts by mass |
| 3-(2,3-dihydroxypropoxy)-1-propane sulfonate | 25 parts by mass |

The above-mentioned materials were dissolved into 500 parts by mass of acetone, and

| | |
|---|---|
| Isophorone diisocyanate | 410 parts by mass |
| Hexamethylene diisocyanate | 120 parts by mass |

were added to the mixture, followed by a reaction at 60° C. for 4 hours. 130 parts by mass of triethyl amine were charged into the reaction product to neutralize an carboxyl group of dimethylol propanoic acid. The acetone solution was dropped to 1,300 parts by mass of ion-exchanged water with stirring to emulsify the mixture. Next, the emulsified resultant was diluted with ion-exchanged water so as to have a solid content ratio of 13%, whereby a dispersion liquid of resin fine particles 5 was obtained. Table 8 shows physical properties thereof.

<Preparation of Dispersion Liquid of Resin Fine Particles 6>

| | |
|---|---|
| Bisphenol derivative represented by the following formula (A) where R represents an ethylene group and an average value of x + y is 4 [Chem. 4] | 440 parts by mass |

(A)

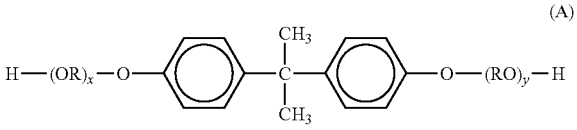

| | |
|---|---|
| Dimethylol propanoic acid | 140 parts by mass |
| 3-(2,3-dihydroxypropoxy)-1-propane sulfonate | 10 parts by mass |

The above-mentioned materials were dissolved into 500 parts by mass of acetone, and

| | |
|---|---|
| Isophorone diisocyanate | 420 parts by mass |

was added to the mixture, followed by a reaction at 60° C. for 4 hours. 105 parts by mass of triethyl amine were charged into the reaction product to neutralize an carboxyl group of dimethylol propanoic acid. The acetone solution was dropped to 1,300 parts by mass of ion-exchanged water with stirring to emulsify the mixture. Next, the emulsified resultant was diluted with ion-exchanged water so as to have a solid content ratio of 13%, whereby a dispersion liquid of resin fine particles 6 was obtained. Table 8 shows physical properties thereof.

<Preparation of Dispersion Liquid of Resin Fine Particles 7>

| | |
|---|---|
| Bisphenol derivative represented by the following formula (A) where R represents an ethylene group and an average value of x + y is 2 [Chem. 5] | 430 parts by mass |

(A)

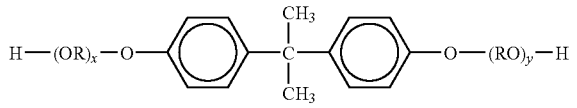

| | |
|---|---|
| Dimethylol propanoic acid | 120 parts by mass |
| 3-(2,3-dihydroxypropoxy)-1-propane sulfonate | 10 parts by mass |

The above-mentioned materials were dissolved into 500 parts by mass of acetone, and

| | |
|---|---|
| Isophorone diisocyanate | 440 parts by mass |

was added to the mixture, followed by a reaction at 60° C. for 4 hours. 91 parts by mass of triethyl amine were charged into the reaction product to neutralize an carboxyl group of dimethylol propanoic acid. The acetone solution was dropped to 1,300 parts by mass of ion-exchanged water with stirring to emulsify the mixture. Next, the emulsified resultant was diluted with ion-exchanged water so as to have a solid content ratio of 13%, whereby a dispersion liquid of resin fine particles 7 was obtained. Table 8 shows physical properties thereof.

<Preparation of Dispersion Liquid of Resin Fine Particles 8>

| | |
|---|---|
| Bisphenol derivative represented by the following formula (A) where R represents an ethylene group and an average value of x + y is 2 [Chem. 6] | 360 parts by mass |

(A)

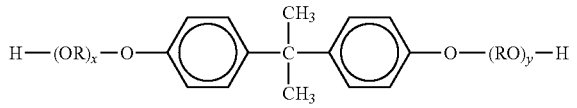

| | |
|---|---|
| Dimethylol propanoic acid | 100 parts by mass |
| 3-(2,3-dihydroxypropoxy)-1-propane sulfonate | 18 parts by mass |

The above-mentioned materials were dissolved into 500 parts by mass of acetone, and

| | |
|---|---|
| Isophorone diisocyanate | 520 parts by mass |

was added to the mixture, followed by a reaction at 60° C. for 4 hours. parts by mass of triethyl amine were charged into the reaction product to neutralize an carboxyl group of dimethylol propanoic acid. The acetone solution was dropped to 1,300 parts by mass of ion-exchanged water with stirring to emulsify the mixture. Next, 320 parts by mass of water, 11. parts by mass of ethylene diamine, and 6 parts by mass of n-butylamine were added to the emulsified resultant, followed by a reaction at 50° C. for 4 hours, and the whole was diluted with ion-exchanged water so as to have a solid content ratio of 13%, whereby a dispersion liquid of resin fine particles 8 was obtained. Table 8 shows physical properties thereof.

TABLE 8

| | Composition | Tg (b) (° C.) | Tb (° C.) | G"b (Tb + 5)/ G"b (Tb + 25) | Particle diameter (nm) |
|---|---|---|---|---|---|
| Resin fine particles 1 | Aliphatic polyester | 62 | 63 | 44 | 46 |
| Resin fine particles 2 | Aromatic polyester | 68 | 68 | 39 | 55 |
| Resin fine particles 3 | Vinyl | 69 | 71 | 23 | 39 |
| Resin fine particles 4 | Aliphatic urethane | 60 | 62 | 16 | 41 |
| Resin fine particles 5 | Aliphatic urethane | 73 | 74 | 38 | 52 |
| Resin fine particles 6 | Aromatic urethane | 68 | 69 | 65 | 53 |
| Resin fine particles 7 | Aromatic urethane | 51 | 53 | 29 | 59 |
| Resin fine particles 8 | Aromatic urethane | 89 | 90 | 8 | 44 |

<Preparation of Dispersion Liquid of Wax-II-1>

| | |
|---|---|
| Carnauba wax (temperature of maximum endothermic peak: 81° C.) | 20 parts by mass |
| Ethyl acetate | 80 parts by mass |

The whole was loaded into a glass beaker equipped with a stirring blade. By heating the inside of the system to 70° C., carnauba wax was dissolved into ethyl acetate.

Next, while stirred gently at 50 rpm, the inside of the system was cooled gradually to thereby be cooled to 25° C. over 3 hours. Thus, an opal liquid was obtained.

The obtained solution was charged into a heat-resistant container with 20 parts by mass of 1-mm glass beads. The mixture was dispersed for 3 hours with a paint shaker (manufactured by Toyo Seiki Seisaku-sho, Ltd.), whereby a dispersion liquid of wax II-1 (solid content ratio of 20%) was obtained. The wax particle diameter in the dispersion liquid of wax II-1 was measured with Microtrack grain size distribution measurement apparatus HRA (X-100) (manufactured by NIKKISO CO., LTD.). As a result, the number average particle diameter was 0.15 μm. Table 9 shows physical properties thereof.

<Preparation of Dispersion Liquid of Wax II-2>

| | |
|---|---|
| Stearyl stearate (maximum endothermic peak temperature: 67° C.) | 16 parts by mass |
| Nitrile group-containing styrene acrylic resin (styrene/n-butyl acrylate/acrylonitrile = 65/35/10 (molar ratio), peak molecular weight 8,500) | 4 parts by mass |
| Ethyl acetate | 80 parts by mass |

The whole was charged into a glass beaker equipped with a stirring blade and the inside of the system was heated to 65° C., whereby stearyl stearate was dissolved into ethyl acetate.

Next, the same operation as in preparation of the dispersion liquid of wax II-1 was performed, and thus a dispersion liquid of wax II-2 (solid content ratio of 20%) was obtained. The wax particle diameter in the dispersion liquid of wax II-2 was measured with Microtrack grain size distribution measurement apparatus HRA (X-100) (manufactured by NIKKISO CO., LTD.). As a result, the number average particle diameter was 0.12 μm. Table 9 shows physical properties thereof.

<Preparation of Dispersion Liquid of Wax II-3>

| | |
|---|---|
| Trimethylolpropane tribehenate (maximum endothermic peak temperature: 58° C.) | 16 parts by mass |
| Nitrile group-containing styrene acrylic resin (styrene/n-butyl acrylate/acrylonitrile = 65/35/10 (molar ratio), peak molecular weight 8,500) | 4 parts by mass |
| Ethyl acetate | 80 parts by mass |

The whole was charged into a glass beaker equipped with a stirring blade and the inside of the system was heated to 60° C., whereby trimethylolpropane tribehenate was dissolved into ethyl acetate.

Next, the same operation as in preparation of the dispersion liquid of wax II-I was performed, and thus a dispersion liquid of wax II-3 (solid content ratio of 20%) was obtained. The wax particle diameter in the dispersion liquid of wax II-3 was measured with Microtrack grain size distribution measurement apparatus HRA (X-100) (manufactured by NIKKISO CO., LTD.). As a result, the number average particle diameter was 0.18 μm. Table 9 shows physical properties thereof.

TABLE 9

| | Kind | Maximum endothermic peak temperature (° C.) | Solid content (%) | Number average particle diameter (μm) |
|---|---|---|---|---|
| Dispersion liquid of wax II-1 | Carnauba | 81 | 20 | 0.15 |
| Dispersion liquid of wax II-2 | Synthesized ester | 67 | 20 | 0.12 |
| Dispersion liquid of wax II-3 | Synthesized ester | 58 | 20 | 0.18 |

Table 10 shows physical properties of the following magnetic substances 1 to 3.

TABLE 10

| | Shape | Magnetization value* ($Am^2/kg$) | Residual magnetization ($Am^2/kg$) | Number average particle diameter (μm) | Variation coefficient (%) |
|---|---|---|---|---|---|
| Magnetic substance 1 | Octahedron | 69.3 | 8.1 | 0.18 | 48 |
| Magnetic substance 2 | | 69.8 | 9.3 | 0.19 | 52 |
| Magnetic substance 3 | Spheroid | 68.4 | 5.2 | 0.22 | 44 |

*Magnetization value in the external magnetic field of 79.6 kA/m

<Preparation of Dispersion Liquid of Magnetic Substance II-1>

| | |
|---|---|
| Ethyl acetate | 125 parts by mass |
| Resin (a2)-3 | 25 parts by mass |
| Magnetic substance 1 | 100 parts by mass |
| Glass beads (1 mm) | 200 parts by mass |

The above-mentioned substances were loaded into a closed container, and dispersed with a paint shaker (manufactured by Toyo Seiki. Seisaku-sho, Ltd.) for 5 hours. The glass beads were then removed with a nylon mesh, whereby a dispersion liquid of magnetic substance II-1 (solid content ratio of 50%) was obtained.

<Preparation of Dispersion Liquids of Magnetic Substance II-2 to II-7>

Dispersion liquids of magnetic substance II-2 to II-7 were obtained in the same manner as in preparation of the dispersion liquid of magnetic substance II-1 except that kinds of the resin for dispersing a magnetic substance and kinds of the magnetic substance were changed as shown in Table 11.

TABLE 11

| | Kind of resin | Kind of magnetic substance |
|---|---|---|
| Dispersion liquid of magnetic substance II-1 | Resin (a2)-3 | Magnetic substance 1 |
| Dispersion liquid of magnetic substance II-2 | Resin (a2)-4 | Magnetic substance 1 |
| Dispersion liquid of magnetic substance II-3 | Resin (a2)-1 | Magnetic substance 1 |
| Dispersion liquid of magnetic substance II-4 | Resin (a2)-3 | Magnetic substance 2 |
| Dispersion liquid of magnetic substance II-5 | Resin (a2)-2 | Magnetic substance 2 |
| Dispersion liquid of magnetic substance II-6 | Resin (a2)-2 | Magnetic substance 1 |
| Dispersion liquid of magnetic substance II-7 | Resin (a2)-3 | Magnetic substance 3 |

EXAMPLE II-I (Preparation of Toner Composition)

50 parts by mass of the resin (a1)-3 and 6 parts by mass of the resin (a2)-3 were dissolved into ethyl acetate and the mixture was dried at 40° C. under reduced pressure overnight, whereby a binder resin (a)-1 was obtained.

| | |
|---|---|
| Binder resin (a)-1 | 56 parts by mass |
| Dispersion liquid of magnetic substance II-1 (solid content ratio of 50%) | 75 parts by mass |
| Dispersion liquid of wax II-1 (solid content ratio of 20%) | 40 parts by mass |
| Ethyl acetate | 89 parts by mass |
| Triethyl amine | 0.6 part by mass |

The whole was charged into a beaker made of glass, and stirred at 2,000 rpm for 3 minutes with DISPER (manufactured by Tokushu Kika Kogyo). Thus, a liquid toner composition 1 was obtained. Next, iced water was put in a ultrasonic dispersing device, UT-305HS (manufactured by SHARP CORPORATION.), and the liquid toner composition 1 was subjected to a ultrasonication with an output of 60% for 5 minutes, whereby the wax and the magnetic substance were loosen.

(Emulsifying and Desolvating Steps)

| | |
|---|---|
| Ion-exchanged water | 157 parts by mass |
| Dispersion liquid of resin fine particle-6 (solid content ratio of 13%) | 31 parts by mass |
| 50% aqueous solution of dodecyl diphenyl ether sodium disulfonate (ELEMINOL MON-7 manufactured by Sanyo Chemical Industries, Ltd.) | 24 parts by mass |
| Ethyl acetate | 18 parts by mass |

The above substances were loaded into a beaker made of glass and stirred at 2,000 rpm for 1 minute with TK-homomixer (manufactured by Tokushu Kika Kogyo), whereby an aqueous phase 1 was prepared.

160 parts by mass of the liquid toner composition 1 were charged into the aqueous phase, and the mixture was continuously stirred with the TK-homomixer for 1 minute while the number of revolutions of the TK-homomixer was increased to 8,000 rpm. Thus, the liquid toner composition 1 was suspended.

A stirring blade was set in the beaker, and the suspension was stirred with the blade at 100 rpm for 20 minutes. The resultant was transferred to an eggplant flask, and was subjected to desolvation at normal temperature under normal pressure over 10 hours while the flask was rotated with a rotary evaporator. Thus, a water dispersion liquid of toner particles II-1 was obtained.

(Washing and Drying Steps)

The above water dispersion liquid of toner particles II-1 was filtrated, and the filtrate was charged into 500 parts by mass of ion-exchanged water so that reslurry was prepared. After that, while the system was stirred, hydrochloric acid was added to the system until the pH of the system reached 4. Then, the mixture was stirred for 5 minutes. The above slurry was filtrated again, 200 parts by mass of ion-exchanged water were added to the filtrate, and the mixture was stirred for 5 minutes; the operation was repeated three times. As a result, triethylamine remaining in the slurry was removed, whereby a filtrated cake of the toner particles was obtained. The above filtrated cake was dried with a vacuum dryer at normal temperature for 3 days and sieved with a mesh having an aperture of 75 μm, whereby toner particles II-1 were obtained.

Note that in the toner particles II-1, Tg(a) is a glass transition temperature of a resin formed of the binder resin (a)-1 and the resin (a2)-3 contained in a dispersion liquid of magnetic substance. Tg(a) of the toner particles II-I was 48° C.

(Preparation and Evaluation of Toner II-1)

Next, 40 parts by mass of the above toner particles II-1, 0.40 part by mass of hydrophobic silica having a number average particle diameter of 20 nm (subjected to a hydrophobic treatment with 20 parts by mass of hexamethyldisilazane per 100 parts by mass of silica fine particles), and 0.60 part by mass of monodisperse silica having a number average particle diameter of 120 nm (silica fine particles produced by a sol-gel method) were mixed and stirred with a Millser IFM-600DG (manufactured by Iwatani Corporation) (one cycle was such that the mixture was stirred for 10 seconds and the repose for 1 minute, and the cycle was repeated four times), whereby Toner II-1 was obtained. The toner II-1 was evaluated by the following method. Table 13 shows the evaluation results.

<Evaluation for Heat-Resistant Storage Stability of Toner>

3 g of toner were loaded into a 100-ml polycup, and were left to stand in a thermostat at 50° C. (±0.5° C. or less) for 3 days. After that, the toner was evaluated for its heat-resistant storage stability by observing the toner with the eyes and by touching the toner with a side of a finger.

(Evaluation Criteria)

A: The toner shows no change, and shows extremely good heat-resistant storage stability.

B: The toner shows a slight reduction in flowability, but shows good heat-resistant storage stability.

C: An agglomerate of the toner is generated, but the toner shows heat-resistant storage stability causing no problems in practical. use.

D: An agglomerate of the toner can be picked up, and does not easily collapse. The toner is poor in heat-resistant storage stability.

<Evaluation for Fixation Starting Temperature>

A fixation test was performed with a fixing unit in a fixing device, iR4570F (manufactured by Canon Inc.), which had been reconstructed so that a fixation temperature and a rate at which paper was passed could be manually set.

The fixation temperature was determined by measuring the temperature of the surface of a fixing roller with a non-contact temperature gauge Temperature Hitester 3445 (manufactured by HIOKI E.E. CORPORATION). The rate at which paper was passed was calculated from the diameter of the fixing roller and the rotational speed by a digital tachometer HT-5100 (manufactured by ONO SOKKI CO., LTD.).

An image for evaluation for fixation starting temperature was a solid unfixed image having a tip margin of 10 mm, a width of 200 mm, and a length of 20 mm produced by adjusting the development contrast of the iR4570F under a normal-temperature, normal-humidity environment (23° C./60%) so that a toner laid-on level on A4 paper EN-100 (manufactured by Canon Inc.) was 0.4 mg/cm$^2$.

Under a normal-temperature, normal-humidity environment (23° C./60%), the rate at which paper was passed was set to 280 mm/sec, and the above unfixed image was passed through the fixing unit so as to be fixed at a fixation temperature increased from 90° C. to 180° C. in an increment of 5° C. A portion at a distance of 5 cm from the rear end of the fixed image was rubbed with soft, thin paper (such as a trade name "Dasper" manufactured by OZU CORPORATION) for five reciprocations while a load of 4.9 kPa was applied to the image. The image densities of the image before and after the rubbing were measured, and the decreasing percentage of the image density ΔD (%) was calculated on the basis of the following equation. It should be noted that the image densities were each evaluated with a reflection densitometer 500 Series Spectrodensitemeter (manufactured by X-Rite). The temperature at which ΔD (%) described above was less than 1% was defined as a fixation starting temperature.

$$\Delta D(\%)=\{(\text{image density before rubbing}-\text{image density after rubbing})/\text{image density before rubbing}\}\times 100$$

A: The fixation starting temperature is in the range of 90° C. to 100° C. and toner has excellent fixing performance.

B: The fixation starting temperature is in the range of 105° C. to 120° C. and toner has favorable fixing performance.

C: The fixation starting temperature is in the range of 125° C. to 140° C. and toner has no problematic fixing performance in practical use, D: The fixation starting temperature is 145° C. or higher and toner has inferior fixing performance.

<Method for Evaluation for Peel Temperature>

Figure 4:
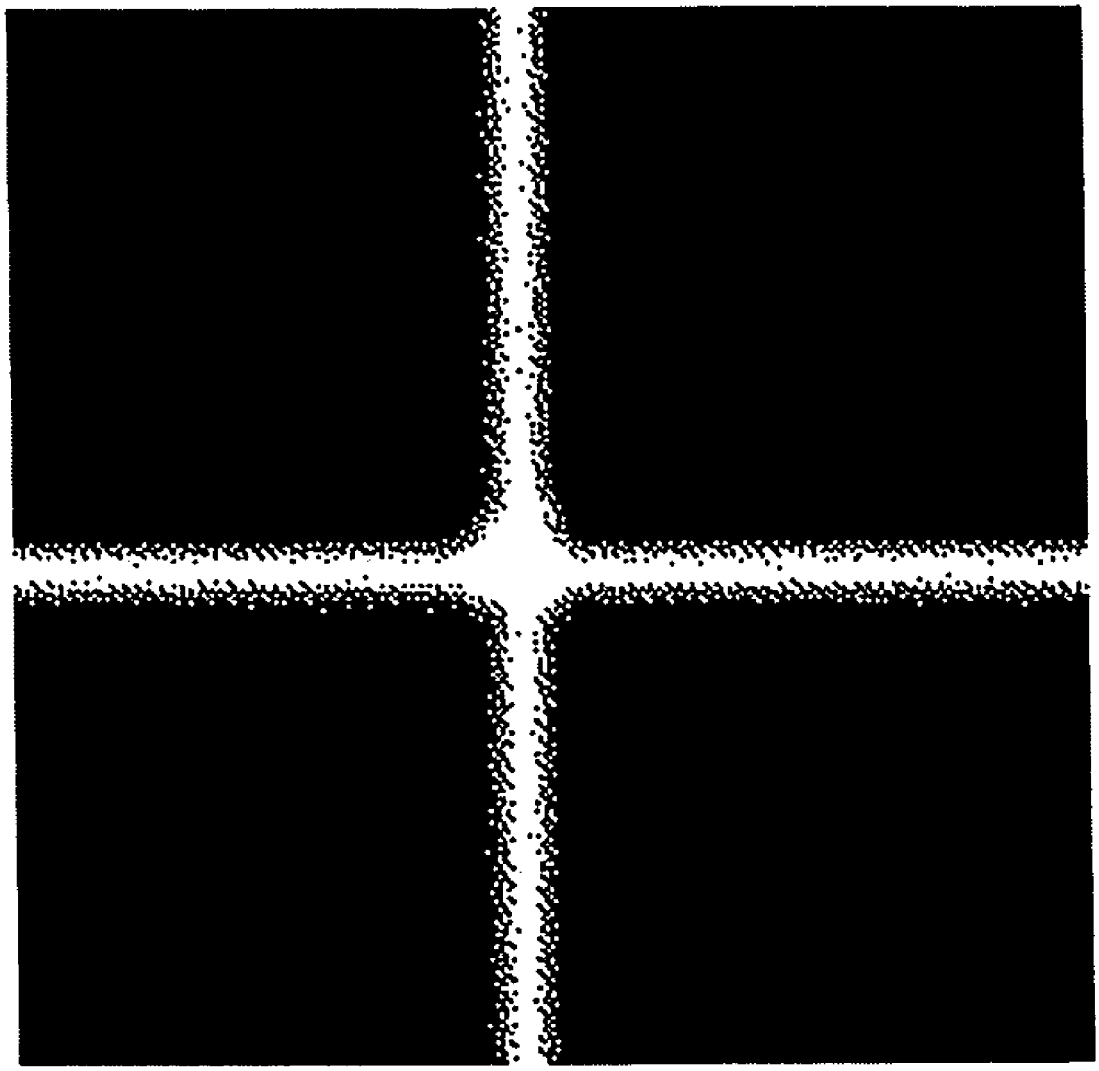
FIG. 4 is a sample drawing showing a piece of paper, which exposes background of the paper due to peeling of a toner.

Toner was evaluated for its low-temperature fixability from a viewpoint different from the fixation starting temperature. Evaluation for ease with which the toner adhered to paper at a low temperature was performed by the following method. A solid unfixed image was produced in the same manner as in the method for evaluation for fixation starting temperature, and a fixed image was obtained in the same manner as in the method. Subsequently, the fixed image was folded in the shape of a cross, and was rubbed with soft, thin paper (such as a trade name "Dasper" manufactured by OZU CORPORATION) for five reciprocations while a load of 4.9 kPa was applied to the image. Such a sample as shown in FIG. 4 in which the toner peeled at a cross portion so that the ground of paper was observed was obtained. Subsequently, a 512-pixel square region of the cross portion was photographed with a CCD camera at a resolution of 800 pixels/inch. The image was binarized with a threshold set to 60%, and the area ratio of the portion from which the toner had peeled, i.e., a white portion was defined as a peel ratio. The smaller the area ratio of the white portion, the greater the difficulty with which the toner peels.

The peel ratio was measured for each fixation temperature, and fixation temperatures and peel ratios were plotted on an axis of abscissa and an axis of ordinate, respectively. The plots were smoothly connected, and the temperature at which the resultant curve intersected a line corresponding to a peel ratio of 10% was defined as a peel temperature.

A: The peel temperature is in the range of 90° C. to 110° C. and toner has excellent low-temperature fixability.

B: The peel temperature is in the range of 115° C. to 130° C. and toner has favorable low-temperature fixability.

C: The peel temperature is in the range of 135° C. to 155° C. and toner has no problematic low-temperature fixability in practical use.

D: The peel temperature is 160° C. or higher and toner is determined to have inferior low-temperature fixability.

<Method for Evaluation for Offset Resistance>

The fixed image obtained in the evaluation for fixation starting temperature was evaluated for whether hot offset (phenomenon in which the fixed image adhered from paper to a fixing roller and adhered to paper again after one rotation of the fixing roller) occurred.

The case where the image density of the non-image portion of the image was at least 0.03 time as high as a solid image density was regarded as indicating the occurrence of offset. It should be noted that any such image density was measured with a reflection densitometer 500 Series Spectrodensitemeter (manufactured by X-Rite).

A: No hot offset occurs and toner has excellent offset resistance.

B: Hot offset occurs at 180° C., but toner has favorable offset resistance.

C: Hot offset occurs at 175° C. or 170° C., but toner has no problematic offset resistance in practical use.

D: Hot offset occurs at 165° C. or lower and toner has inferior offset resistance.

<Method for Evaluation for Durable Stability>

An image (having a print area ratio of 4%) in which a lattice pattern having a line width of 3 pixels had been printed on the entire surface of A4 paper was printed on up to 50,000 sheets with iR4570F reconstructed so as to have a process speed of 320 mm/sec. Toner was evaluated for durable stability on the basis of the number of sheets at the time point when dirt was generated on the image.

A: No dirt is generated at the time point when the image is printed on 50,000 sheets and toner has excellent durability.

B: Dirt is generated at the time point when the image is printed on 40,000 sheets and toner has favorable durability.

C: Dirt is generated at the time point when the image is printed on 20,000 sheets and toner has no problematic durability in practical use.

D: Dirt is generated at the time point when the image is printed on 5,000 sheets and toner has inferior durability.

<Method of Evaluating Fine-Line Reproducibility>

Evaluation for fine-line reproducibility was performed from the viewpoint of an improvement in image quality. An image on a 5,000-th sheet output in the above evaluation for durable stability was evaluated for fine-line reproducibility. The output resolution of iR4570F is 600 dpi., so a line width of 3-pixel has a theoretical width of 127 μm. The line width of the image was measured with a microscope VK-8500 (manufactured by KEYENCE CORPORATION), and L represented by the following equation was defined as a fine-line reproducibility index on condition that the measured line width was represented by d (μm).

$$L(\mu m)=|127-d|$$

L defines a difference between a theoretical line width of 127 μm and the line width d on the output image. L is represented as the absolute value of the difference because d may be larger than or smaller than 127. The image exerts better fine-line reproducibility with decreasing L.

A: L is 0 μm or more and less than 3 μm.

B: L is 3 μm or more and less than 10 μm.

C: L is 10 μm or more and less than 20 μm.

D: L is 20 μm or more.

<Method of Evaluating Blank Fogging>

The density of an image portion after fixing was adjusted so as to have a toner laid-on level of 1.4 mg/cm$^2$ under normal-temperature, normal-humidity environment (23° C./60%) using the iR4570F. A voltage on a photosensitive member was adjusted from the voltage of the developing bias on the blank portion to 150 V in a direction opposite to the image portion. The photosensitive member was stopped during formation of the image, and toner on the photosensitive member before a transfer process was then peeled off with Myler tape. The toner was adhered to paper (photosensitive member sample). In addition, Myler tape as it is was adhered to paper and the resultant was used as a standard sample.

For the measurement, a reflectance (%) was measured using DNESITOMETER TC-6DS (manufactured by Tokyo Denshoku). Then, a difference between the reflectance of "photosensitive member sample" and the reflectance of the standard sample (reflectance difference) was defined as a fogging value.

A: Reflectance difference is 0.5% or less and the evaluation is good.

B: Reflectance difference is 1.0% or less and the fogging cannot be discriminated as an image.

C: Reflectance difference exceeds 1.0% but there is no fogging as an image and no problem in practical use.

D: Reflectance difference exceeds 1.0% and there is fogging on the blank portion of an image.

COMPARATIVE EXAMPLES II-1 to II-6

(Preparation of toners II-2 to II-7)

Toners II-2 (Comparative Example II-1) to II-7 (Comparative Example II-6) were obtained in the same manner as in Example II-I except that compositions of the resin, the magnetic substance, the wax, and the resin fine particles were changed as shown in Table 12 (refer to ° Fable 12 and Table 13). In addition, the obtained toners were evaluated in the same manner as in Example II-1. Table 13 shows evaluation results thereof.

EXAMPLES II-2 to II-10

(Preparation of toners II-8 to II-16)

Toners II-8 (Example II-2) to II-16 (Example II-10) were obtained in the same manner as in Example II-I except that compositions of the resin, the magnetic substance, the wax, and the resin fine particles were changed as shown in Table 12 (refer to Table 12 and Table 13). In addition, the obtained toners were evaluated in the same manner as in Example II-1. Table 13 shows evaluation results thereof.

TABLE 12

| | Toner base particle (A) | | | | | | |
|---|---|---|---|---|---|---|---|
| | Binder resin (a) | | | Magnetic substance | | Resin for dispersing magnetic substance | |
| | Kind | Addition amount (parts by mass) | Tg (° C.) | Kind | Addition amount (parts by mass) | Kind | Addition amount (parts by mass) |
| Toner II-1 | Binder resin (a)-1 | 56 | 47 | Dispersion liquid of magnetic substance II-1 | 30 | Resin (a2)-3 | 8 |
| Toner II-2 | Binder resin (a)-2 | 54 | 46 | Dispersion liquid of magnetic substance II-1 | 30 | Resin (a2)-3 | 8 |
| Toner II-3 | Binder resin (a)-3 | 49 | 45 | Dispersion liquid of magnetic substance II-2 | 34 | Resin (a2)-4 | 9 |
| Toner II-4 | Binder resin (a)-4 | 68 | 50 | Dispersion liquid of magnetic substance II-3 | 18 | Resin (a2)-1 | 5 |
| Toner II-5 | Binder resin (a)-5 | 33 | 43 | Dispersion liquid of magnetic substance II-1 | 49 | Resin (a2)-3 | 12 |
| Toner II-6 | Binder resin (a)-6 | 54 | 61 | Dispersion liquid of magnetic substance II-3 | 30 | Resin (a2)-1 | 8 |
| Toner II-7 | Binder resin (a)-7 | 56 | 47 | Dispersion liquid of magnetic substance II-4 | 30 | Resin (a2)-3 | 8 |
| Toner II-8 | Binder resin (a)-8 | 56 | 46 | Dispersion liquid of magnetic substance II-4 | 30 | Resin (a2)-3 | 8 |
| Toner II-9 | Binder resin (a)-9 | 51 | 48 | Dispersion liquid of magnetic substance II-5 | 30 | Resin (a2)-2 | 8 |
| Toner II-10 | Binder resin (a)-10 | 58 | 49 | Dispersion liquid of magnetic substance II-4 | 30 | Resin (a2)-3 | 8 |
| Toner II-11 | Binder resin (a)-11 | 56 | 51 | Dispersion liquid of magnetic substance II-6 | 30 | Resin (a2)-2 | 8 |
| Toner II-12 | Binder resin (a)-12 | 56 | 47 | Dispersion liquid of magnetic substance II-1 | 30 | Resin (a2)-3 | 8 |
| Toner II-13 | Binder resin (a)-13 | 56 | 47 | Dispersion liquid of magnetic substance II-7 | 30 | Resin (a2)-3 | 8 |
| Toner II-14 | Binder resin (a)-14 | 56 | 47 | Dispersion liquid of magnetic substance II-7 | 30 | Resin (a2)-3 | 8 |
| Toner II-15 | Binder resin (a)-15 | 56 | 47 | Dispersion liquid of magnetic substance II-1 | 30 | Resin (a2)-3 | 8 |
| Toner II-16 | Binder resin (a)-16 | 56 | 48 | Dispersion liquid of magnetic substance II-1 | 30 | Resin (a2)-3 | 8 |

| | Toner base particle (A) | | | | Surface layer (B) Resin fine particles | | |
|---|---|---|---|---|---|---|---|
| | Wax | | Wax dispersant | | | | |
| | Kind | Addition amount (parts by mass) | Addition amount (parts by mass) | Tg (a) (° C.) | Kind | Addition amount (parts by mass) | Tg (b) (° C.) |
| Toner II-1 | Dispersion liquid of wax II-1 | 8 | — | 48 | Resin fine particles-6 | 4 | 68 |
| Toner II-2 | Dispersion liquid of wax II-3 | 8 | 2.0 | 47 | Resin fine particles-6 | 4 | 68 |
| Toner II-3 | Dispersion liquid of wax II-3 | 8 | 2.0 | 48 | Resin fine particles-3 | 5 | 69 |
| Toner II-4 | Dispersion liquid of wax II-1 | 10 | — | 51 | Resin fine particles-1 | 4 | 62 |
| Toner II-5 | Dispersion liquid of wax II-1 | 8 | — | 47 | Resin fine particles-2 | 3 | 68 |
| Toner II-6 | Dispersion liquid of wax II-1 | 10 | — | 61 | Resin fine particles-4 | 4 | 60 |
| Toner II-7 | Dispersion liquid of wax II-1 | 8 | — | 49 | — | — | — |
| Toner II-8 | Dispersion liquid of wax II-1 | 8 | — | 48 | Resin fine particles-6 | 4 | 68 |
| Toner II-9 | Dispersion liquid of wax II-2 | 10 | 2.5 | 50 | Resin fine particles-4 | 4 | 60 |

TABLE 12-continued

| | | | | | | | |
|---|---|---|---|---|---|---|---|
| Toner II-10 | Dispersion liquid of wax II-2 | 5 | 1.3 | 50 | Resin fine particles-5 | 4 | 73 |
| Toner II-11 | Dispersion liquid of wax II-1 | 8 | — | 52 | Resin fine particles-5 | 1 | 73 |
| Toner II-12 | Dispersion liquid of wax II-1 | 8 | — | 49 | Resin fine particles-6 | 18 | 68 |
| Toner II-13 | Dispersion liquid of wax II-1 | 8 | — | 48 | Resin fine particles-1 | 4 | 62 |
| Toner II-14 | Dispersion liquid of wax II-1 | 8 | — | 48 | Resin fine particles-5 | 4 | 73 |
| Toner II-15 | Dispersion liquid of wax II-1 | 8 | — | 48 | Resin fine particles-7 | 4 | 51 |
| Toner II-16 | Dispersion liquid of wax II-1 | 8 | — | 49 | Resin fine particles-8 | 5 | 89 |

TABLE 13

| | | Magnetization ($Am^2/kg$) | Tt (° C.) | G't (120) (Pa) | G"t (Tt + 5)/ G"t (Tt + 25) | Average circularity | THF-insoluble matter excluding magnetic substance (mass %) | Charge quantity (mC/kg) |
|---|---|---|---|---|---|---|---|---|
| Example II-1 | Toner II-1 | 20.4 | 55 | $5.4 \times 10^3$ | 88 | 0.978 | 6 | −24 |
| Comparative Example II-1 | Toner II-2 | 20.3 | 58 | $1.3 \times 10^3$ | 33 | 0.980 | 7 | −18 |
| Comparative Example II-2 | Toner II-3 | 22.8 | 56 | $2.1 \times 10^3$ | 37 | 0.981 | 3 | −16 |
| Comparative Example II-3 | Toner II-4 | 11.6 | 55 | $8.6 \times 10^2$ | 25 | 0.978 | 6 | −19 |
| Comparative Example II-4 | Toner II-5 | 33.2 | 56 | $3.3 \times 10^3$ | 22 | 0.979 | 5 | −13 |
| Comparative Example II-5 | Toner II-6 | 20.5 | 65 | $9.8 \times 10^3$ | 19 | 0.979 | 9 | −21 |
| Comparative Example II-6 | Toner II-7 | 18.1 | 52 | $2.2 \times 10^3$ | 34 | 0.982 | 9 | −9 |
| Example II-2 | Toner II-8 | 20.1 | 56 | $3.2 \times 10^3$ | 45 | 0.976 | 8 | −19 |
| Example II-3 | Toner II-9 | 21.9 | 53 | $5.9 \times 10^3$ | 63 | 0.981 | 2 | −20 |
| Example II-4 | Toner II-10 | 21.8 | 55 | $4.4 \times 10^3$ | 51 | 0.979 | 12 | −20 |
| Example II-5 | Toner II-11 | 20.3 | 56 | $2.8 \times 10^3$ | 60 | 0.983 | 6 | −19 |
| Example II-6 | Toner II-12 | 20.4 | 59 | $8.6 \times 10^3$ | 71 | 0.973 | 5 | −21 |
| Example II-7 | Toner II-13 | 20.9 | 55 | $5.8 \times 10^3$ | 77 | 0.981 | 6 | −23 |
| Example II-8 | Toner II-14 | 20.1 | 55 | $5.9 \times 10^3$ | 81 | 0.982 | 6 | −22 |
| Example II-9 | Toner II-15 | 20.2 | 53 | $4.7 \times 10^3$ | 69 | 0.969 | 6 | −21 |
| Example II-10 | Toner II-16 | 20.3 | 56 | $6.1 \times 10^3$ | 42 | 0.979 | 6 | −31 |

| | Heat-resistant storage stability | Fixation starting temperature | Peeling temperature | Offset resistance | Fine-line reproducibility | Blank fogging | Durable stability |
|---|---|---|---|---|---|---|---|
| Example II-1 | A | A | A | A | A | A | A |
| Comparative Example II-1 | A | A | A | A | A | A | D |
| Comparative Example II-2 | A | B | A | A | A | D | A |
| Comparative Example II-3 | B | A | A | A | D | D | A |
| Comparative Example II-4 | A | D | C | A | B | A | A |
| Comparative Example II-5 | A | D | C | A | A | A | A |
| Comparative Example II-6 | D | A | B | B | B | B | C |
| Example II-2 | A | A | A | B | A | A | A |
| Example II-3 | A | A | A | B | A | A | A |
| Example II-4 | A | B | A | A | A | A | A |
| Example II-5 | B | A | A | A | A | A | A |
| Example II-6 | A | B | A | A | A | A | A |
| Example II-7 | A | A | A | A | A | A | B |
| Example II-8 | A | A | A | A | A | A | A |
| Example II-9 | A | A | A | A | A | A | A |
| Example II-10 | A | A | A | A | B | B | A |

[Production of Dispersion Liquid of Resin Fine Particles III-I]

| | |
|---|---|
| Polyester diol having the number average molecular weight of about 2,000 obtained from a mixture containing propylene glycol, ethylene glycol, and butane diol at the ratio of 40:50:10 (molar ratio), and a mixture containing terephthalic acid and isophthalic acid at the ratio of 50:50 (molar ratio) | 120 parts by mass |
| Dimethylol propanoic acid | 94 parts by mass |
| 3-(2,3-dihydroxypropoxy)-1-propane sulfonic acid | 8 parts by mass |
| Isophorone diisocyanate | 120 parts by mass |

The above-mentioned raw materials were dissolved into 60 parts by mass of acetone, followed by a reaction at 67° C. for 1 hour.

Next, 271 parts by mass of isophorone diisocyanate were added to the mixture. The obtained mixture was further subjected to a reaction at 67° C. for 30 minutes, and then cooled. After 100 parts by mass of acetone were additionally added to the obtained reaction product, 80 parts by mass of triethyl amine were charged into the reaction product, followed by stirring.

The thus obtained acetone solution was dropped to 1,000 parts by mass of ion-exchanged water while stirring at 500 rpm, whereby a dispersion liquid of fine particles was prepared.

Next, a solution in which 50 parts by mass of triethyl amine were dissolved into 100 parts by mass of a 10% ammonia water was charged into the dispersion liquid of fine particles. The obtained mixture was subjected to an extension reaction by a reaction at 50° C. for 8 hours. Further, ion-exchanged water was added until the solid content became 20 mass %, whereby a dispersion liquid of resin fine particles III-1 was obtained. Table 14 shows physical properties thereof.

[Production of Dispersion Liquid of Resin Fine Particles III-2]

The followings were loaded into an autoclave equipped with a temperature gauge and a stirring machine.

| | |
|---|---|
| Dimethyl terephthalate | 116 parts by mass |
| Dimethyl isophthalate | 66 parts by mass |
| 5-sodium sulfoisophthalate methyl ester | 3 parts by mass |
| Trimellitic anhydride | 5 parts by mass |
| Propylene glycol | 150 parts by mass |
| Tetrabutoxy titanate | 0.1 part by mass |

The whole was heated at 200° C. for 120 minutes to carry out an ester exchange reaction. Next, the temperature of the reaction system was increased to 220° C. and the pressure of the system was set to 1 to 10 mmHg, and the reaction was continued for 60 minutes. Thus, a polyester resin was obtained. 40 parts by mass of the polyester resin were dissolved into 15 parts by mass of methyl ethyl ketone and 10 parts by mass of tetrahydrofuran at 80° C. Then, while 60 parts by mass of water at 80° C. were added with stirring, a solvent medium was removed under reduced pressure. Further, ion-exchanged water was added to the resultant, whereby a dispersion liquid of resin fine particles III-2 having a solid content ratio of 20 mass % was obtained. Table 14 shows physical properties thereof.

[Production of Dispersion Liquid of Resin Fine Particles III-3]

The followings were charged into a reactor equipped with a cooling pipe, a nitrogen introducing pipe, and a stirring machine.

| | |
|---|---|
| Styrene | 330 parts by mass |
| n-butyl acrylate | 110 parts by mass |
| Acrylic acid | 10 parts by mass |
| 2-butanone (solvent) | 50 parts by mass |

8 parts by mass of 2,2'-azobis(2,4-dimethylvaleronitrile) as a polymerization initiator were dissolved into the above-mentioned raw materials, whereby a polymerizable monomer composition was prepared. After the polymerizable monomer composition was subjected to a polymerization reaction at 60° C. for 8 hours, the temperature of the resultant was increased to 150° C., followed by desolvation under reduced pressure. Thus, the reaction product was removed from the reactor. The reaction product was cooled to room temperature, and then pulverized into particles, whereby a binder resin as a linear vinyl resin was obtained. 100 parts by mass of the obtained resin and 400 parts by mass of toluene were mixed and the mixture was heated to 80° C. to melt the resin.

Next, 360 parts by mass of ion-exchanged water and 40 parts by mass of a 48.5% aqueous solution of dodecyldiphenyl ether sodium disulfonate ("ELEMINOL MON-7" manufactured by Sanyo Chemical industries) were mixed, and the resin dissolved liquid was added to the mixture, followed by mixing and stirring, whereby an opal liquid was obtained. The toluene was removed under reduced pressure and ion-exchanged water was added to the mixture, whereby a dispersion liquid of resin fine particles III-3 having a solid content ratio of 20 mass % was obtained. Table 14 shows physical properties thereof.

[Production of Dispersion Liquid of Resin Fine Particles III-4]

| | |
|---|---|
| Polyester diol having the number average molecular weight of about 2,000 obtained from a mixture containing propylene glycol, ethylene glycol, and butane diol at the ratio of 40:50:10 (molar ratio), and a mixture containing terephthalic acid and isophthalic acid at the ratio of 50:50 (molar ratio) | 100 parts by mass |
| Propylene glycol | 16 parts by mass |
| Dimethylol propanoic acid | 94 parts by mass |
| Sodium N,N-bis(2-hydroxyethyl)-2-aminoethane sulfonate | 8 parts by mass |
| Tolylene diisocyanate | 30 parts by mass |

The above-mentioned raw materials were dissolved into 60 parts by mass of acetone, followed by a reaction at 67° C. for 1 hour.

Further, 271 parts by mass (1.2 mol) of isophoronediisocyanate were added to the mixture. The obtained mixture was further subjected to a reaction at 67° C. for 30 minutes, and then cooled.

After 100 parts by mass of acetone were additionally added to the obtained reaction product, 80 parts by mass (0.8 mol) of triethyl amine were charged into the reaction product, followed by stirring.

The thus obtained acetone solution was dropped to 1,000 parts by mass of ion-exchanged water while stirring at 500 rpm, whereby a dispersion liquid of fine particles was prepared.

Next, a solution in which 50 parts by mass of triethyl amine were dissolved into 100 parts by mass of a 10% ammonia water was charged into the resultant. The obtained mixture was subjected to an extension reaction by a reaction at 50° C. for 8 hours. Further, ion-exchanged water was added until the solid content became 20 mass %, whereby a dispersion liquid of resin fine particles III-4 was obtained. Table 14 shows physical properties thereof.

[Production of Dispersion Liquid of Resin Fine Particles III-5]

| | |
|---|---|
| Polyester diol having the number average molecular weight of about 2,000 obtained from a mixture containing propylene glycol, ethylene glycol, and butane diol at the ratio of 40:50:10 (molar ratio), and a mixture containing terephthalic acid and isophthalic acid at the ratio of 50:50 (molar ratio) | 120 parts by mass |
| Propylene glycol | 8 parts by mass |
| Dimethylol propanoic acid | 94 parts by mass |
| 3-(2,3-dihydroxypropoxy)-1-propane sulfonic acid | 8 parts by mass |
| Isophorone diisocyanate | 39 parts by mass |

The above-mentioned raw materials were dissolved into 60 parts by mass of acetone, followed by a reaction at 67° C. for 1 hour.

Next, 271 parts by mass of isophorone diisocyanate were added to the mixture. The obtained mixture was further subjected to a reaction at 67° C. for 30 minutes, and then cooled.

The thus obtained acetone solution was dropped to 1,000 parts by mass of ion-exchanged water while stirring at 500 rpm, whereby a dispersion liquid of fine particles was prepared.

After 100 parts by mass of acetone were additionally added to the obtained reaction product, 80 parts by mass of triethyl amine were charged into the reaction product, followed by stirring.

Next, a solution in which 50 parts by mass of triethyl amine were dissolved into 100 parts by mass of a 10% ammonia water was charged into the resultant. The obtained mixture was subjected to an extension reaction by a reaction at 50° C. for 8 hours. Further, ion-exchanged water was added until the solid content became 20 mass %, whereby a dispersion liquid of resin fine particles III-5 was obtained. Table 14 shows physical properties thereof.

[Production of Dispersion Liquid of Resin Fine Particles III-6]

| | |
|---|---|
| Polyester diol having the number average molecular weight of about 2,000 obtained from a mixture containing propylene glycol, ethylene glycol, and butane diol at the ratio of 40:50:10 (molar ratio), and a mixture containing terephthalic acid and isophthalic acid at the ratio of 50:50 (molar ratio) | 120 parts by mass |
| Propylene glycol | 8 parts by mass |
| Dimethylol propanoic acid | 94 parts by mass |
| 3-(2,3-dihydroxypropoxy)-1-propane sulfonic acid | 8 parts by mass |
| Isophorone diisocyanate | 39 parts by mass |

The above-mentioned raw materials were dissolved into 60 parts by mass of acetone, followed by a reaction at 67° C. for 1 hour.

Next, 150 parts by mass of isophorone diisocyanate were added to the mixture. The obtained mixture was further subjected to a reaction at 65° C. for 20 minutes, and then cooled.

The thus obtained acetone solution was dropped to 1,000 parts by mass of ion-exchanged water while stirring at 500 rpm, whereby a dispersion liquid of fine particles was prepared.

After 100 parts by mass of acetone were additionally added to the obtained reaction product, 80 parts by mass of triethyl amine were charged into the reaction product, followed by stirring.

Next, a solution in which 50 parts by mass of triethyl amine were dissolved into 100 parts by mass of a 10% ammonia water was charged into the resultant. The obtained mixture was subjected to an extension reaction by a reaction at 50° C. for 8 hours. Further, ion-exchanged water was added until the solid content became 20 mass %, whereby a dispersion liquid of resin fine particles III-6 was obtained. Table 14 shows physical properties thereof.

TABLE 14

| | Resin fine particles | Tg (° C.) | Tm (° C.) | Sulfonic group value (mgKOH/g) | Particle diameter in dispersion liquid (nm) |
|---|---|---|---|---|---|
| Dispersion liquid of resin fine particles III-1 | Urethane 3-1 | 78 | 148 | 3 | 50 |
| Dispersion liquid of resin fine particles III-2 | Polyester 3-1 | 62 | 105 | 20 | 80 |
| Dispersion liquid of resin fine particles III-3 | Styrene acryl 3-1 | 65 | 123 | 18 | 60 |
| Dispersion liquid of resin fine particles III-4 | Urethane 3-2 | 75 | 140 | 0 | 55 |
| Dispersion liquid of resin fine particles III-5 | Urethane 3-3 | 63 | 108 | 3 | 40 |
| Dispersion liquid of resin fine particles III-6 | Urethane 3-4 | 40 | 128 | 3 | 60 |

<Preparation of Polyester III-1 and Polyester Resin Solution III-1>

The followings were charged into a reactor equipped with a cooling pipe, a nitrogen introducing pipe, and a stirring machine.

| | |
|---|---|
| 1,4-butanediol | 928 parts by mass |
| Dimethyl terephthalate | 776 parts by mass |
| 1,6-hexanedioic acid | 292 parts by mass |
| Tetrabutoxy titanate (condensation catalyst) | 3 parts by mass |

The whole was subjected to a reaction at 160° C. for 8 hours in a stream of nitrogen while generated methanol was distilled off. Next, the temperature of the resultant was increased gradually to 210° C., the resultant was subjected to a reaction for 4 hours in a stream of nitrogen, while generated propylene glycol and water were distilled off. The obtained resultant was further subjected to a reaction for 1 hour under a reduced pressure of 20 mmHg and then cooled to 160° C. 173 parts by mass of trimellitic anhydride and 125 parts by mass of 1,3-propanedioic acid were added to the resultant, and the obtained mixture was subjected to a reaction for 2 hours under sealing at normal pressure, followed by a reaction at 200° C. and normal pressure. The resultant was removed at the point when the softening point of the resultant became 170° C.

After cooled to room temperature, the removed resin was pulverized into particles, whereby a polyester III-1 as a non-linear polyester resin was obtained. Table 15 shows Tg and an acid value of the polyester III-1.

Next, ethyl acetate was charged into a closed container equipped with a stirring blade. While the ethyl acetate was stirred at 100 rpm, the polyester III-1 formed into powders was added so as to be 50 mass % with respect to the charged ethyl acetate, and the mixture was stirred at room temperature for 3 days. Thus, a polyester resin solution III-1 was prepared.

<Preparation of polyester III-2 and polyester resin solution III-2>

| | |
|---|---|
| Polyoxypropylene(2.2)-2,2-bis(4-hydroxyphenyl)propane | 30 parts by mass |
| Polyoxyethylene(2.2)-2,2-bis(4-hydroxyphenyl)propane | 33 parts by mass |
| Terephthalic acid | 21 parts by mass |
| Trimellitic anhydride | 1 part by mass |
| Fumaric acid | 3 parts by mass |
| Dodecenyl succinic acid | 12 parts by mass |
| Dibutyltin oxide | 0.1 part by mass |

The whole was added to a four-necked 4-L flask made of glass, and a temperature gauge, a stirring bar, a condenser, and a nitrogen introducing pipe were provided to the flask and the flask was put in a mantle heater. Under a nitrogen atmosphere, the whole was subjected to a reaction at 215° C. for 5 hours, whereby a polyester III-2 was obtained. Table 15 shows Tg and an acid value of the polyester III-2.

Next, ethyl acetate was charged into a closed container equipped with a stirring blade. While the ethyl acetate was stirred at 100 rpm, the polyester III-2 formed into powders was added so as to be 50 mass % with respect to the charged ethyl acetate, and the mixture was stirred at room temperature for 3 days. Thus, a polyester resin solution III-2 was prepared.

<Preparation of Polyester III-3 and Polyester Resin Solution III-3>

The followings were charged into a reactor equipped with a cooling pipe, a nitrogen introducing pipe, and a stirring machine.

| | |
|---|---|
| 1,2-propanediol | 799 parts by mass |
| Dimethyl terephthalate | 815 parts by mass |
| 1,5-pentanedioic acid | 238 parts by mass |
| Tetrabutoxy titanate (condensation catalyst) | 3 parts by mass |

The whole was subjected to a reaction at 180° C. for 8 hours in a stream of nitrogen while generated methanol was distilled off. Next, the temperature of the resultant was increased gradually to 230° C., the resultant was subjected to a reaction for 4 hours in a stream of nitrogen, while generated propylene glycol and water were distilled off. The obtained resultant was further subjected to a reaction for 1 hour under a reduced pressure of 20 mmHg and then cooled to 180° C. 173 parts by mass of trimellitic anhydride were added to the resultant, and the obtained mixture was subjected to a reaction for 2 hours under sealing at normal pressure, followed by a reaction at 220° C. and normal pressure. The obtained resultant was removed at the point when the softening point of the resultant became 180° C. After cooled to-room temperature, the removed resin was pulverized into particles, whereby a polyester III-3 as a non-linear polyester resin was obtained. Table 15 shows Tg and an acid value of the polyester III-3.

Next, ethyl acetate was charged into a closed container equipped with a stirring blade. While the ethyl acetate was stirred at 100 rpm, the polyester III-3 formed into powders was added so as to be 50 mass % with respect to the charged ethyl acetate, and the mixture was stirred at room temperature for 3 days. Thus, a polyester resin solution III-3 was prepared.

<Preparation of Polyester III-4 and Polyester Resin Solution III-4>

The followings were charged into a reactor equipped with a cooling pipe, a nitrogen introducing pipe, and a stirring machine.

| | |
|---|---|
| 1,3-butanediol | 1,036 parts by mass |
| Dimethyl terephthalate | 892 parts by mass |
| 1,6-hexanedioic acid | 205 parts by mass |
| Tetrabutoxy titanate (condensation catalyst) | 3 parts by mass |

The whole was subjected to a reaction at 180° C. for 8 hours in a stream of nitrogen while generated methanol was distilled off. Next, the temperature of the resultant was increased gradually to 230° C., the resultant was subjected to a reaction for 4 hours in a stream of nitrogen, while generated propylene glycol and water were distilled off. The obtained resultant was further subjected to a reaction under a reduced pressure of 20 mmHg. The resultant was removed at the point when the softening point of the resultant became 150° C. After cooled to room temperature, the removed resin was pulverized into particles, whereby a polyester III-4 as a linear polyester resin was obtained. Table 15 shows Tg and an acid value of the polyester III-4.

Next, ethyl acetate was charged into a closed container equipped with a stirring blade. While the ethyl acetate was stirred at 100 rpm, the polyester III-4 formed into powders was added so as to be 50 mass % with respect to the charged ethyl acetate, and the mixture was stirred at room temperature for 3 days. Thus, a polyester resin solution III-4 was prepared.

<Preparation of Polyester III-5 and Polyester Resin Solution III-5>

The followings were charged into a reactor equipped with a cooling pipe, a nitrogen introducing pipe, and a stirring machine.

| | |
|---|---|
| 1,2-propanediol | 858 parts by mass |
| Dimethyl terephthalate | 873 parts by mass |
| 1,6-hexanedioic acid | 219 parts by mass |
| Tetrabutoxy titanate (condensation catalyst) | 3 parts by mass |

The whole was subjected to a reaction at 180° C. for 8 hours in a stream of nitrogen while generated methanol was distilled off. Next, the temperature of the resultant was increased gradually to 230° C., the resultant was subjected to a reaction for 4 hours in a stream of nitrogen, while generated propylene glycol and water were distilled off. The obtained resultant was further subjected to a reaction under a reduced pressure of 20 mmHg. The obtained resultant was removed at the point when the softening point of the resultant became 150° C. After cooled to room temperature, the removed resin was pulverized into particles, whereby a polyester III-5 as a linear polyester resin was obtained. Table 15 shows Tg and an acid value of the polyester III-5.

Next, ethyl acetate was charged into a closed container equipped with a stirring blade. While the ethyl acetate was stirred at 100 rpm, the polyester III-5 formed into powders was added so as to be 50 mass % with respect to the charged ethyl acetate, and the mixture was stirred at room temperature for 3 days. Thus, a polyester resin solution III-5 was prepared.

[Production of Styrene Acryl III-1 and Styrene Acrylic Resin Solution III-1]

The followings were charged into a reactor equipped with a cooling pipe, a nitrogen introducing pipe, and a stirring machine.

| | |
|---|---|
| Styrene | 320 parts by mass |
| n-butyl acrylate | 110 parts by mass |
| Acrylic acid | 10 parts by mass |
| 2-butanone (solvent) | 50 parts by mass |

8 parts by mass of 2,2'-azobis(2,4-dimethylvaleronitrile) as a polymerization initiator were dissolved into the above-mentioned raw materials, whereby a polymerizable monomer composition was prepared. After the polymerizable monomer composition was subjected to a polymerization reaction at 60° C. for 8 hours, the temperature of the resultant was increased to 160° C., followed by desolvation under reduced pressure. Thus, the reaction product was removed from the reactor. The reaction product was cooled to room temperature, and then pulverized into particles, whereby styrene acryl III-1 as a linear vinyl resin was obtained. Table 15 shows Tg and an acid value of styrene acryl III-1.

Next, ethyl acetate was charged into a closed container equipped with a stirring blade. While the ethyl acetate was stirred at 100 rpm, the styrene acryl III-1 formed into powders was added so as to be 50 mass % with respect to the charged ethyl acetate, and the mixture was stirred at room temperature for 3 days. Thus, a styrene acrylic resin solution III-1 was prepared.

TABLE 15

| | Tg (° C.) | Acid value (mgKOH/g) |
|---|---|---|
| Polyester III-1 | 52 | 4 |
| Polyester III-2 | 60 | 6 |
| Polyester III-3 | 61 | 2 |
| Polyester III-4 | 40 | 14 |
| Polyester III-5 | 42 | 12 |
| Styrene acryl III-1 | 60 | 17 |

[Preparation of Dispersion Liquid of Wax III-1]

| | |
|---|---|
| Copolymer resin (I) [Nitrile group-containing styrene acryl resin (styrene/n-butyl acrylate/acrylonitrile = 65/35/10 (molar ratio), peak molecular weight 8,500] | 90 parts by mass |
| Polyethylene (I) (maximum endothermic peak temperature: 107° C.) | 10 parts by mass |

The polyethylene (I) was grafted with the copolymer resin (I) in the above-mentioned blending ratio, whereby a. dispersion liquid of wax (I) was obtained.

The following compounds were then loaded into a glass beaker equipped with a stirring blade (manufactured by IWAKI CO., LTD.), and wax dispersion medium (I) and carnauba wax were dissolved into ethyl acetate by heating the system to 70° C.

| | |
|---|---|
| Wax dispersion medium (I) | 8 parts by mass |
| Carnauba wax (temperature of maximum endothermic peak: 81° C.) | 16 parts by mass |
| Ethyl acetate | 76 parts by mass |

Further, the inside of the system was cooled gradually with stirring at 50 rpm to thereby be cooled to 25° C. over 3 hours, whereby an opal liquid was obtained.

The obtained solution and 20 parts by mass of 1-mm glass beads were loaded into a heat-resistant container, and dispersed with a paint shaker (manufactured by Toyo Seiki. Seisaku-sho, Ltd.) for 3 hours, whereby a dispersion liquid of wax III-1 was obtained.

The wax particle diameter in the dispersion liquid of wax III-1 was measured with Microtrack grain size distribution measurement apparatus HRA (X-100) (manufactured by NIKKISO CO., LTD.). Table 16 shows physical properties thereof.

<Preparation of Dispersion Liquid of Wax III-2>

| | |
|---|---|
| Wax dispersion medium (I) | 8 parts by mass |
| Stearyl stearate (temperature of maximum endothermic peak: 67° C.) | 16 parts by mass |
| Ethyl acetate | 76 parts by mass |

The above substances were loaded into a glass beaker equipped with a stirring blade (manufactured by IWAKI CO., LTD.). By heating the inside of the system to 65° C., stearyl stearate (ester III-1) was dissolved into ethyl acetate.

Next, a dispersion liquid of wax III-2 was obtained with the same operation as in the dispersion liquid of wax III-1. The dispersed-particle diameter of the wax particle in the dispersion liquid of wax III-2 was measured with Microtrack grain size distribution measurement apparatus HRA (X-100) (manufactured by NIKKISO CO., LTD.). Table 16 shows physical properties thereof.

<Preparation of Dispersion Liquid of Wax III-3>

| | |
|---|---|
| Trimethylolpropane tribehenate (temperature of maximum endothermic peak: 58° C.) | 20 parts by mass |
| Ethyl acetate | 80 parts by mass |

The above substances were loaded into a glass beaker equipped with a stirring blade (manufactured by IWAKI CO., LTD.). By heating the inside of the system to 60° C., trimethylolpropane tribehenate (ester III-2) was dissolved into ethyl acetate.

Next, a dispersion liquid of wax III-3 was obtained with the same operation as in the dispersion liquid of wax III-1. The dispersed-particle diameter of the wax particle in the dispersion liquid of wax III-3 was measured with Microtrack grain size distribution measurement apparatus HRA (X-100) (manufactured by NIKKISO CO., LTD.). Table 16 shows physical properties thereof.

<Preparation of Dispersion Liquid of Wax III-4>

| | |
|---|---|
| Wax dispersion medium (I) | 8 parts by mass |
| Paraffin wax (temperature of maximum endothermic peak: 74° C.) | 16 parts by mass |
| Ethyl acetate | 76 parts by mass |

The above substances were loaded into a glass beaker equipped with a stirring blade (manufactured by IWAKI CO., LTD.). By heating the inside of the system to 70° C., paraffin wax (paraffin ITT-1) was dissolved into ethyl acetate. Next, a dispersion liquid of wax III-4 was obtained with the same operation as in the dispersion liquid of wax III-1. The dispersed-particle diameter of the wax particle in the dispersion liquid of wax ITT-4 was measured with Microtrack grain size distribution measurement apparatus HRA (X-100) (manufactured by NIKKISO CO., LTD.). Table 16 shows physical properties thereof.

<Preparation of Dispersion Liquid of Wax III-5>

| | |
|---|---|
| Carnauba wax (temperature of maximum endothermic peak: 81° C.) | 20 parts by mass |
| Ethyl acetate | 80 parts by mass |

The above-mentioned compounds were loaded into a glass beaker equipped with a stirring blade (manufactured by IWAKI CO., LTD.), and the carnauba wax (carnauba III-1) was dissolved into the ethyl acetate by heating the system to 70° C.

Next, the inside of the system was cooled gradually with stirring at 50 rpm to thereby be cooled to 25° C. over 3 hours, whereby an opal liquid was obtained.

The obtained solution and 20 parts by mass of 1-mm glass beads were loaded into a heat-resistant container, and dispersed with a paint shaker (manufactured by Toyo Seiki Seisaku-sho, Ltd.) for hours, whereby a dispersion liquid of wax III-5 was obtained.

The dispersed-particle diameter of the wax particle in the dispersion liquid of wax III-5 was measured with Microtrack grain size distribution measurement apparatus HRA (X-100) (manufactured by NIKKISO CO., LTD.) Table 16 shows physical properties thereof.

TABLE 16

| | Wax | DSC endothermic peak temperature (° C.) | Wax dispersion medium | Dispersed-particle diameter (μm) |
|---|---|---|---|---|
| Dispersion liquid of wax III-1 | Carnauba III-1 | 81 | Presence | 0.14 |
| Dispersion liquid of wax III-2 | Ester III-1 | 67 | Presence | 0.12 |
| Dispersion liquid of wax III-3 | Ester III-2 | 58 | Absence | 0.15 |
| Dispersion liquid of wax III-4 | Paraffin III-1 | 74 | Presence | 0.13 |
| Dispersion liquid of wax III-5 | Carnauba III-1 | 81 | Absence | 0.16 |

In addition, Table 17 shows physical properties of magnetites III-1 to III-5

TABLE 17

| | Shape | Magnetization ($Am^2/kg$) | Residual magnetization ($Am^2/kg$) | Number average particle diameter (μm) | Variation coefficient (%) |
|---|---|---|---|---|---|
| Magnetite III-1 | Spheroid | 68.4 | 5.1 | 0.21 | 44 |
| Magnetite III-2 | Octahedron | 69.3 | 8.1 | 0.15 | 48 |
| Magnetite III-3 | Octahedron | 69.8 | 9.2 | 0.20 | 52 |
| Magnetite III-4 | Spheroid | 67.8 | 5.3 | 0.22 | 48 |
| Magnetite III-5 | Spheroid | 67.5 | 4.8 | 0.24 | 47 |

<Preparation of Dispersion Liquid of Magnetic Substance III-1>

| | |
|---|---|
| Ethyl acetate | 100 parts by mass |
| Polyester III-1 | 50 parts by mass |
| Magnetite III-1 | 100 parts by mass |
| Glass beads (1 mm) | 100 parts by mass |

The above-mentioned substances were loaded into a heat-resistant glass container, and dispersed with a paint shaker (manufactured by Toyo Seiki Seisaku-sho, Ltd.) for 5 hours. The glass beads were removed with a nylon mesh, whereby a dispersion liquid of magnetic substance III-1 was obtained.

<Preparation of Dispersion Liquid of Magnetic Substance III-2>

| | |
|---|---|
| Polyester III-2 | 50 parts by mass |
| Magnetite III-2 | 100 parts by mass |

(Kneading Step)

The above-mentioned raw materials were loaded into a kneader-type mixer, and the temperature of the mixture was increased under no pressing while the whole was mixed. The temperature was increased to 130° C. and the mixture was heated and melt-kneaded for about 10 minutes, whereby the magnetite was dispersed in the resin. After that, the kneading was continued with cooling, and the resultant was cooled to 80° C. 50 parts by mass of ethyl acetate were gradually added to the resultant. After ethyl acetate was added, the temperature of the system was fixed to 75° C. and the mixture was kneaded for 30 minutes. After the step was completed, the mixture was cooled, and a kneaded product was taken out.

Next, after the kneaded product was pulverized into coarse particles with a hammer, ethyl acetate was mixed into the coarse particles so that a solid concentration became 60 mass %. After that, the mixture was stirred at 8,000 rpm for 10 minutes using DISPER (manufactured by Tokushu Kika Kogyo), whereby a dispersion liquid of magnetic substance III-2 was obtained.

<Preparation of Dispersion Liquid of Magnetic Substance III-3>

| | |
|---|---|
| Magnetite III-3 | 250 parts by mass |
| Ethyl acetate | 250 parts by mass |
| Glass beads (1 mm) | 300 parts by mass |

The above-mentioned substances were loaded into a heat-resistant glass container, and dispersed with a paint shaker (manufactured by Toyo Seiki Seisaku-sho, Ltd.) for 5 hours. The glass beads were removed with a nylon mesh, whereby a dispersion liquid of magnetic substance III-3 was obtained.

[Preparation of Dispersion Liquid of Magnetic Substance-4]

| | |
|---|---|
| Polyester III-4 | 50 parts by mass |
| Magnetite III-4 | 100 parts by mass |

The above raw materials were charged into a kneader-type mixer, and the temperature of the mixture was increased with stirring under no pressing. The temperature was increased to 130° C. and the mixture was melt-kneaded by heating for about 60 minutes and thus the magnetite was dispersed in the resin. After termination of the step, the resultant was cooled and a kneaded product was taken out.

Next, the kneaded product was pulverized into coarse particles with a hammer. The obtained resultant was mixed with ethyl acetate so as to have a solid concentration of 60 mass %. Then, the mixture was stirred at 8,000 rpm for 10 minutes using DISPER (manufactured by Tokushu Kika Kogyo), whereby a dispersion liquid of magnetic substance III-4 was obtained.

[Preparation of Dispersion Liquid of Magnetic Substance III-5]

| | |
|---|---|
| Polyester III-5 | 50 parts by mass |
| Magnetite III-5 | 100 parts by mass |

The above raw materials were charged into a kneader-type mixer, and the temperature of the mixture was increased with stirring under no pressing. The temperature was increased to 130° C. and the mixture was melt-kneaded by heating for about 60 minutes and thus the magnetite was dispersed in the resin. After termination of the step, the resultant was cooled and a kneaded product was taken out.

Next, the kneaded product was pulverized into coarse particles with a hammer to use in the following step.

| | |
|---|---|
| The above-mentioned coarsely pulverized product | 150 parts by mass |
| Ethyl acetate | 100 parts by mass |
| Glass beads (1 mm) | 100 parts by mass |

The above-mentioned substances were loaded into a heat-resistant glass container, and dispersed with a paint shaker (manufactured by Toyo Seiki Seisaku-sho, Ltd.) for 5 hours. The glass beads were removed with a nylon mesh, whereby a dispersion liquid of magnetic substance III-5 was obtained.

EXAMPLE III-1

(Preparation of Oil Phase)

| | |
|---|---|
| Dispersion liquid of wax III-1 | 62.5 parts by mass |
| Dispersion liquid of magnetic substance III-1 | 75 parts by mass |
| Polyester resin solution III-1 | 80 parts by mass |
| Triethyl amine | 0.5 part by mass |
| Ethyl acetate | 34.5 parts by mass |

The above-mentioned solutions were loaded into a container, and stirred and dispersed at 1,500 rpm for 10 minutes with HOMO DISPER (manufactured by Tokushu Kika Kogyo). Further, 100 parts by mass of glass beads were added to the solution and dispersed with a paint shaker (manufactured by Toyo Seiki Seisaku-sho, Ltd.) for 1 hour. The glass beads were removed with a nylon mesh, whereby an oil phase III-1 was prepared.

(Preparation of Aqueous Phase)

The followings were loaded into a container and stirred at 5,000 rpm for 1 minute with TK-homomixer (manufactured by Tokushu Kika Kogyo), whereby an aqueous phase was prepared.

| | |
|---|---|
| Ion-exchanged water | 245 parts by mass |
| Dispersion liquid of resin fine particle III-l (5.0 parts by mass of resin fine particles were loaded with respect to 100 parts by mass of toner base particle) | 25 parts by mass |
| 50% aqueous solution of dodecyl diphenyl ether sodium disulfonate (ELEMINOL MON-7 manufactured by Sanyo Chemical Industries, Ltd.) | 25 parts by mass |
| Ethyl acetate | 30 parts by mass |

(Emulsifying and Desolvating Steps)

250 parts by mass of the oil phase was loaded into 335 parts by mass of the aqueous phase, and the resultant was stirred continuously for 3 minutes with TK-homomixer in such a condition that the number of revolutions was up to 8,000 rpm, whereby the oil phase III-1 was suspended.

Next, a stirring blade was set to the container, the system was subjected to desolvation over 4 hours in the state where the temperature inside the system was increased to 40° C. while stirred at 200 rpm. After that, the temperature of the inside of the system was returned to normal temperature, and emulsified droplets were aged while stirring for 4 hours to performed sufficient desolvation, whereby water dispersion liquid of toner particles III-1 was obtained.

(Washing to Drying Steps)

The above water dispersion liquid of toner particles III-1 was filtrated, and the filtrate was charged into 500 parts by mass of ion-exchanged water so that reslurry was prepared. After that, while the inside of the system was stirred, hydrochloric acid was added to the system until the pH of the system reached 4. Then, the mixture was stirred for 5 minutes.

The above slurry was filtrated again, 200 parts by mass of ion-exchanged water were added to the filtrate, and the mixture was stirred for 5 minutes; the operation was repeated three times. As a result, triethylamine remaining in the system was removed, whereby a filtrated cake of the toner particles III-1 was obtained.

The above filtrated cake was dried with a warm air at 45° C. for 3 days and sieved with a mesh having an aperture of 75 μm, whereby toner particles III-1 were obtained.

(Preparation of Toner)

Next, with respect to 100 parts by mass of the toner particles III-1, 0.7 part by mass of hydrophobic silica having the number average diameter of 20 nm and 3.0 parts by mass of strontium titanate having the number average diameter of 120 nm were mixed with a Henschel mixer, FM-10B (manufactured by MITSUI MIIKE MACHINERY Co., Ltd.). Thus, a toner III-1 was obtained. Table 18 shows the formulation of the toner III-1 and Table 19 shows physical properties thereof.

<Image Evaluation>

An evaluation method for the obtained toner is described. For the image evaluation, a commercially available monochrome printer manufactured by Canon Inc. (trade name: IR3570) was used. Table 20 shows the results of the image evaluation for toner.

A test machine for the image evaluation was left to stand in the environment of 23° C. and 5% RH overnight. The mode was set in such a manner, when printing a horizontal line pattern on a sheet having the print percentage of 3% was defined as one job, the test machine stopped once between a job and a job and the next job then started. A durability test was performed with output of 50,000 sheets using A4 normal paper (75 g/cm$^2$).

<Fogging>

Evaluation for fogging was performed as follows: during the durability test, at the termination of 1,000-th sheet output, two solid white sheets were printed while amplitude of alternating components of the developing bias was set to 1.8 kV. Then, fogging of the second paper was measured by the following method.

Each of transfer material before and after the formation of an image was measured with a reflection densitometer (REFLECTOMETER MODEL TC-6DS manufactured by Tokyo Denshoku CO., LTD.). A worst value for the reflection density after the formation of the image was defined Ds. An average reflection density before the formation of image was defined Dr. Ds-Dr was obtained by subtracting Dr from Ds. The Ds-Dr was evaluated for fogging amount. With smaller value, the fogging is demonstrated to be small. Evaluation criteria of the fogging are shown below.

A: Less than 1.0

B: 1.0 or more and less than 2.0

C: 2.0 or more and less than 3.5

D: 3.5 or more

<Evaluation for Fine-line Reproducibility>

An evaluation for fine-line reproducibility was performed during the durability test at the termination of 1,000-th and 10,000-th sheet output. First, laser was exposed so that the line width of a latent image became 85 μm, whereby the fixed image printed on a thick paper (105 g/m$^2$) was used as a sample for measurement. As a measurement apparatus, a 450-particle analyzer, LUZEX (Nireco Corporation) was used. The line width was measured using a indicator from an enlarged monitor image. In this time, for the measurement position, because there were irregularities in the width direction of the fine-line image of the toner, an average line width of the irregularities was used as a measurement value. The fine-line reproducibility was evaluated by calculation of the ratio (image line width/latent image width) of the image line width to the latent image line width (85 μm). Evaluation criteria of the fine-line reproducibility are shown below.

A: Less than 1.08

B: 1.08 or more and less than 1.12

C: 1.12 or more and less than 1.18

D: 1.18 or more

<Transfer Efficiency>

Transfer efficiency following the fine-line reproducibility was measured after 1,000-th sheet output. A solid image was output in the setting conditions in which the fine-line reproducibility was measured. An image density transferred on a transfer sheet and an image density of residue of the transfer on a photosensitive member were measured with a densitometer (X-rite 500 Series: X-rite). A laid-on level was calculated from the image density and the transfer efficiency on a transfer sheet was determined.

A: Transfer efficiency of toner is 95% or more.

B: Transfer efficiency of toner is 93% or more.

C: Transfer efficiency of toner is 90% or more.

D: Transfer efficiency of toner is less than 90%.

<Image Density>

Image density was evaluated by the following procedures: an image after fixing was prepared using the above-mentioned test machine under normal-temperature, normal-humidity environment (23° C./60% RH) on Canon recycle paper EN-100 (Canon Inc.) while the toner laid-on level of a solid image was adjusted to 0.35 mg/cm$^2$.

The image was evaluated using a reflection desitometer, 500 Series Spectrodensitemeter manufactured by X-rite. Evaluation criteria of the image density are shown below.

Under the above environment, a decrease ratio of the image density after durability test of 5,000 sheets to the image density after durability test of 100 sheets was calculated. Further, a solid black image was output after 5,000-th sheet, and the image was evaluated by visual observation. Note that the decrease ratio of the image density was determined using the following formula.

{(image density after durability test of 100 sheets)−(image density after durability test of 5,000 sheets)}×100/(reflection density after durability test of 100 sheets)

A: The decrease ratio is less than 2%.

B: The decrease ratio is 2% or more and less than 3%.

C: The decrease ratio is 3% or more and less than 5%, or there is density unevenness after 5,000-th sheet output.

D: The decrease ratio is 5% or more or density unevenness is remarkable after 5,000-th sheet output.

<Evaluation for Charging Performance>

First, a predetermined carrier (a standard carrier defined by The Imaging Society of Japan: a spherical carrier the surface of which is treated with a ferrite core, N-01) and toner are put in a plastic bottle with a lid and shaken with a shaker (YS-LD, manufactured by YAYOI CHEMICAL INDUSTRY, CO., LTD.) for 1 minute at a speed of 4 reciprocations per 1 second, whereby a developer formed of the toner and the carrier is charged. Next, with an apparatus for measuring triboelectric charge quantity shown in FIG. 3, the triboelectric charge quantity is measured. In FIG. 3, about 0.5 to 1.5 g of the developer is charged into a measurement container made of metal 2 containing a 500-mesh screen 3 on the bottom and a lid made of metal 4 is out on the container. The weight of the entire measurement container 2 in this time is weighed and defined as W1 (*g*). Next, in an aspirator 1 (a portion in contact with the measurement container 2 is formed of at least an insulator), the air in the measurement container is aspirated from an aspiration port 7 and a air flow-controlling valve 6 is adjusted, whereby the pressure of a vacuum gauge 5 is set to 250 mmAq. In this state, aspiration is performed for 2 minutes and the toner is removed by aspiration. In this time, voltage shown in an electrometer 9 is defined as V (volt). Here, a volume of a condenser 8 is defined as C (mF). In addition, the weight of the entire measurement container after the aspiration is weighed to define as W2 (*g*). The triboelectric charge quantity (mC/kg) of the sample is calculated by the following formula.

Triboelectric charge quantity (mC/kg) of the sample$=C\times V/(W1-W2)$

In the present invention, a triboelectric charge quantity (Q1) at the initial and a triboelectric charge quantity (Q2) after being left standing for 1 week under a normal-temperature, normal-humidity environment (23° C./60% RH) were measured. Then, charge stability was evaluated with the change ratio of Q2 and Q1. Standard criteria are as follows.

A: The change ratio of Q1 to Q2 is 5% or less.

B: The change ratio of Q1 to Q2 is more than 5% and 10% or less.

C: The change ratio of Q1 to Q2 is more than 10% and 15% or less.

D: The change ratio of Q1 to Q2 is more than 15%.

Low-Temperature Fixability

By using the above-mentioned test machine, a solid unfixed image having the end blank of 5 mm, the width of 100 mm, and the length of 280 mm was prepared, under normal-temperature, normal-humidity environment (23° C./60% RH) while the developing contrast was adjusted so that the toner laid-on level on paper was 0.35 mg/cm$^2$. As paper, an A4 thick paper ("PROVER BOND" 105 g/m$^2$ manufactured by FOX RIVER PAPER) was used. A fixing unit of the test machine was modified so that a fixing temperature of the fixing unit could be set by manual. In this state, a fixing test was performed between the range of 80° C. to 200° C. in the increment of 10° C. under a normal-temperature, normal-humidity environment (23° C./60% RH).

An image region of the obtained fixed image was rubbed with soft, thin paper (such as a trade name "Dasper" manufactured by OZU CORPORATION) for five reciprocations while a load of 4.9 kPa was applied to the image. The image densities of the image before and after the rubbing were measured, and the percentage ΔD (%) by which the image density after the rubbing reduced as compared to the image density before the rubbing was calculated on the basis of the following equation. The temperature at which ΔD (%) described above was less than 10% was defined as a fixation starting temperature serving as the criterion for the low-temperature fixability.

It should be noted that the image density was measured with a color reflection densitometer manufactured by X-Rite (Color reflection densitometer X-Rite 404A).

$$\Delta D(\%)=(\text{image density before rubbing}-\text{image density after rubbing})\times 100/\text{image density before rubbing}$$

A: Fixation starting temperature is 120° C. or lower.

B: Fixation starting temperature is higher than 120° C. and 140° C. or lower.

C: Fixation starting temperature is higher than 140° C. and 160° C. or lower.

D: Fixation starting temperature is higher than 160° C.

<Evaluation for Heat-Resistant Storage Stability of Toner>

About 3 g of toner were added in a 100-ml polycup and left to stand in a thermostat at 50° C. (±0.5° C. or less) for 3 days. The toner was then evaluated for its heat-resistant storage stability by visual observation and tactual observation by fingers.

A: There is no change.

B: Flowability slightly decreases.

C: Aggregation generates.

D: Aggregation can be grasped and does not easily collapse.

COMPARATIVE EXAMPLE III-1

A toner III-2 was obtained in the same manner as in Example III-1 except that, in the preparation of the oil phase, an oil phase III-2 was prepared by changing the polyester resin solution III-1 to a styrene acrylic resin solution III-1 and changing the polyester III-1 used in the dispersion liquid of magnetic substance III-1 to a styrene acryl III-1. Table 18 shows the formulation of the toner III-2 and Table 19 shows physical properties of the toner. In addition, Table 20 shows the results of the image evaluation.

COMPARATIVE EXAMPLE III-2

A toner III-3 was obtained in the same manner as in Example III-1 except that, in the preparation of the aqueous phase, dispersion liquid of resin fine particles III-6 was used instead of dispersion liquid of resin fine particles III-1. Table 18 shows the formulation of the toner III-3 and Table 19 shows physical properties of the toner. In addition, Table 20 shows the results of the image evaluation.

COMPARATIVE EXAMPLE III-3

A toner III-4 was obtained in the same manner as in Example III-1 except that the following aqueous phase was used. Table 1.8 shows the formulation of the toner III-4 and Table 19 shows physical properties of the toner. In addition, Table 20 shows the results of the image evaluation.

(Preparation of Inorganic-Based Aqueous Dispersion Substance)

451. parts by mass of a 0.1 mol/L aqueous solution of $Na_3PO_4$ were charged into 709 parts by mass of ion-exchanged water. After heated to 60° C., the mixture was stirred at 12,000 rpm with TK-homomixer (manufactured by Tokushu Kika Kogyo). 67.7 parts by mass of a 1.0 mol/L aqueous solution of $CaCl_2$ were gradually added, whereby an inorganic-based aqueous dispersion substance containing $Ca_3(PO_4)_2$ was obtained.

(Preparation of Aqueous Phase)

| | |
|---|---|
| The above-mentioned inorganic-based aqueous dispersion substance | 200 parts by mass |
| 50% aqueous solution of dodecyldiphenyl ether sodium disulfonate (ELEMINOL MON-7, manufactured by Sanyo Chemical Industries, Ltd.) | 4 parts by mass |
| Ethyl acetate | 16 parts by mass |

The whole was charged into a beaker, and stirred at 5,000 rpm for 1 minute with TK-homomixer. Thus, an aqueous phase was prepared.

COMPARATIVE EXAMPLE III-4

A toner III-5 was obtained in the same manner as in Example III-1 except that, in the preparation of the oil phase, an oil phase III-3 was prepared by changing the amount of the polyester resin solution III-1 from 80 parts by mass to 122 parts by mass and the amount of the dispersion liquid of magnetic substance III-1 from 75 parts by mass to 40 parts by mass. Table 18 shows the formulation of the toner III-5 and Table 19 shows physical properties of the toner. In addition, Table 20 shows the results of the image evaluation.

COMPARATIVE EXAMPLE III-5

A toner III-6 was obtained in the same manner as in Example III-1 except that, in the preparation of the oil phase, an oil phase III-4 was prepared by changing the amount of the polyester resin solution III-1 from 80 parts by mass to 38 parts by mass and the amount of the dispersion liquid of magnetic substance III-1 from 75 parts by mass to 110 parts by mass. Table 18 shows the formulation of the toner III-6 and Table 19 shows physical properties of the toner. In addition, Table 20 shows the results of the image evaluation.

EXAMPLE III-2

A toner III-7 was obtained in the same manner as in Example III-1 except that, in the preparation of the aqueous phase, dispersion liquid of resin fine particles III-2 was used instead of dispersion liquid of resin fine particles III-1. Table 18 shows the formulation of the toner III-7 and Table 19 shows physical properties of the toner. In addition, Table 20 shows the results of the image evaluation.

EXAMPLE III-3

A toner III-8 was obtained in the same manner as in Example III-1 except that, in the preparation of the aqueous phase, dispersion liquid of resin fine particles III-3 was used instead of dispersion liquid of resin fine particles III-1. Table 18 shows the formulation of the toner III-8 and Table 19 shows physical properties of the toner. In addition, Table 20 shows the results of the image evaluation.

EXAMPLE III-4

A toner III-9 was obtained in the same manner as in Example III-1 except that, in the preparation of the oil phase, an oil phase III-5 was prepared by using 38 parts by mass of the polyester resin solution III-2 instead of the polyester resin solution III-1 and changing 75 parts by mass of the dispersion liquid of magnetic substance III-1 to 110 parts by mass of the dispersion liquid of magnetic substance III-2. Table 18 shows the formulation of the toner III-9 and Table 19 shows physical properties of the toner. In addition, Table 20 shows the results of the image evaluation.

EXAMPLE III-5

A toner III-10 was obtained in the same manner as in Example III-1 except that, in the preparation of the oil phase, an oil phase III-6 was prepared by using 130 parts by mass of the polyester resin solution III-3 instead of the polyester resin solution III-1 and changing 75 parts by mass of the dispersion liquid of magnetic substance III-1 to 40 parts by mass of the dispersion liquid of magnetic substance III-3, and in the preparation of the aqueous phase, the amount of the dispersion liquid of resin fine particles III-1 was changed from 25 parts by mass to 15 parts by mass (3.0 parts by mass of the resin fine particles were loaded with respect to 100 parts by mass of toner base particle). Table 18 shows the formulation of the toner III-10 and Table 19 shows physical properties of the toner. In addition, Table 20 shows the results of the image evaluation.

EXAMPLE III-6

A toner III-11 was obtained in the same manner as in Example III-1 except that, in the preparation of the oil phase, an oil phase III-7 was prepared by using 90 parts by mass of the polyester resin solution III-1 instead of the polyester resin solution III-1 and changing 62.5 parts by mass of the dispersion liquid of wax III-1 to 50.0 parts by mass of the dispersion liquid of wax III-3, and in the preparation of the aqueous phase, the amount of the dispersion liquid of resin fine particles III-1 was changed from 25 parts by mass to 35 parts by mass (7.0 parts by mass of the resin fine particles were loaded with respect to 100 parts by mass of toner base particle). Table 18 shows the formulation of the toner III-11 and Table 19 shows physical properties of the toner. In addition, Table 20 shows the results of the image evaluation.

EXAMPLE III-7

A toner III-12 was obtained in the same manner as in Example III-1 except that, in the preparation of the oil phase, an oil. phase III-8 was prepared by using 90 parts by mass of the polyester resin solution III-5 instead. of the polyester resin solution III-1, changing 62.5 parts by mass of the dispersion liquid of wax III-1 to 50.0 parts by mass of the dispersion liquid of wax III-5, and 75 parts by mass of the dispersion liquid of magnetic substance III-1 was changed to the dispersion liquid of magnetic substance III-5. Table 18 shows the formulation of the toner III-12 and Table 19 shows physical properties of the toner. In addition, Table 20 shows the results of the image evaluation.

EXAMPLE III-8

A toner III-13 was obtained in the same manner as in Example III-1 except that, in the preparation of the oil phase, an oil phase III-9 was prepared by using the polyester resin solution III-4 instead of the polyester resin solution II-1 and changing the dispersion liquid of magnetic substance III-1 to the dispersion liquid of magnetic substance III-4, and in the preparation of the aqueous phase, the dispersion liquid of resin fine particles III-4 was used instead of the dispersion liquid of resin fine particles III-1. Table 18 shows the formulation of the toner III-13 and Table 19 shows physical properties of the toner. In addition, Table 20 shows the results of the image evaluation.

EXAMPLE III-9

A toner III-14 was obtained in the same manner as in Example III-1 except that, in the preparation of the oil phase, an oil phase III-10 was prepared by changing 80 parts by mass of the polyester resin solution III-1 to 95 parts by mass of the polyester resin solution III-5, changing the amount of the dispersion liquid of wax III-1 from 62.5 parts by mass to 31.3 parts by mass, and changing dispersion liquid of wax III-1 to the dispersion liquid of magnetic substance III-5, and in the preparation of the aqueous phase, 65 parts by mass of the dispersion liquid of resin fine particles III-5 were used instead of the dispersion liquid of resin fine particles III-1. Table 18 shows the formulation of the toner III-14 and Table 19 shows physical properties of the toner. In addition, Table 20 shows the results of the image evaluation.

EXAMPLE III-10

A toner III-15 was obtained in the same manner as in Example III-1 except that, in the preparation of the oil phase, an oil phase III-11 was prepared by changing the dispersion liquid of wax III-1 to the dispersion liquid of wax III-2. Table 18 shows the formulation of the toner III-15 and Table 19 shows physical properties of the toner. In addition, Table 20 shows the results of the image evaluation.

EXAMPLE III-11

A toner III-16 was obtained in the same manner as in Example III-1 except that, in the preparation of the oil phase, an oil phase III-12 was prepared by changing the dispersion liquid of wax III-1 to the dispersion liquid of wax III-4. Table 18 shows the formulation of the toner III-16 and Table 19 shows physical properties of the toner. In addition, Table 20 shows the results of the image evaluation.

TABLE 18

| | Toner base particle (A) | | | | | | |
|---|---|---|---|---|---|---|---|
| | Binder resin (a) | | Wax | | Dispersant | Magnetic substance | |
| | Kind | Addition amount (parts by mass) | Kind | Addition amount (parts by mass) | Addition amount (parts by mass) | Kind | Addition amount (parts by mass) |
| Toner III-1 | Polyester III-1 | 40 | Carnauba III-1 | 10 | 5 | Magnetite III-1 | 30 |
| Toner III-2 | Styrene acryl III-1 | 40 | Carnauba III-1 | 10 | 5 | Magnetite III-1 | 30 |
| Toner III-3 | Polyester III-1 | 40 | Carnauba III-1 | 10 | 5 | Magnetite III-1 | 30 |
| Toner III-4 | Polyester III-1 | 40 | Carnauba III-1 | 10 | 5 | Magnetite III-1 | 30 |
| Toner III-5 | Polyester III-1 | 61 | Carnauba III-1 | 10 | 5 | Magnetite III-1 | 16 |
| Toner III-6 | Polyester III-1 | 19 | Carnauba III-1 | 10 | 5 | Magnetite III-1 | 44 |
| Toner III-7 | Polyester III-1 | 40 | Carnauba III-1 | 10 | 5 | Magnetite III-1 | 30 |
| Toner III-8 | Polyester III-1 | 40 | Carnauba III-1 | 10 | 5 | Magnetite III-1 | 30 |
| Toner III-9 | Polyester III-2 | 19 | Carnauba III-1 | 10 | 5 | Magnetite III-2 | 44 |
| Toner III-10 | Polyester III-3 | 65 | Carnauba III-1 | 10 | 5 | Magnetite III-3 | 20 |
| Toner III-11 | Polyester III-1 | 45 | Ester III-2 | 10 | — | Magnetite III-1 | 30 |
| Toner III-12 | Polyester III-5 | 45 | Carnauba III-1 | 10 | — | Magnetite III-5 | 30 |
| Toner III-13 | Polyester III-4 | 40 | Carnauba III-1 | 10 | 5 | Magnetite III-4 | 30 |
| Toner III-14 | Polyester III-5 | 47.5 | Carnauba III-1 | 5 | 2.5 | Magnetite III-5 | 30 |
| Toner III-15 | Polyester III-1 | 40 | Ester III-1 | 10 | 5 | Magnetite III-1 | 30 |
| Toner III-16 | Polyester III-1 | 40 | Paraffin III-1 | 10 | 5 | Magnetite III-1 | 30 |

| | Toner base particle (A) Resin for dispersing magnetic substance | | Surface layer (B) Resin (b) | |
|---|---|---|---|---|
| | Kind | Addition amount (parts by mass) | Kind | Addition amount (parts by mass) |
| Toner III-1 | Polyester III-1 | 15 | Urethane 3-1 | 5 |
| Toner III-2 | Styrene acryl III-1 | 15 | Urethane 3-1 | 5 |
| Toner III-3 | Polyester III-1 | 15 | Urethane 3-4 | 5 |
| Toner III-4 | Polyester III-1 | 15 | — | — |
| Toner III-5 | Polyester III-1 | 8 | Urethane 3-1 | 5 |
| Toner III-6 | Polyester III-1 | 22 | Urethane 3-1 | 5 |
| Toner III-7 | Polyester III-1 | 15 | Polyester 3-1 | 5 |
| Toner III-8 | Polyester III-1 | 15 | Styrene acryl 3-1 | 5 |
| Toner III-9 | Polyester III-2 | 22 | Urethane 3-1 | 5 |
| Toner III-10 | — | — | Urethane 3-1 | 3 |
| Toner III-11 | Polyester III-1 | 15 | Urethane 3-1 | 7 |
| Toner III-12 | Polyester III-5 | 15 | Urethane 3-1 | 5 |
| Toner III-13 | Polyester III-4 | 15 | Urethane 3-2 | 5 |
| Toner III-14 | Polyester III-5 | 15 | Urethane 3-3 | 13 |
| Toner III-15 | Polyester III-1 | 15 | Urethane 3-1 | 5 |
| Toner III-16 | Polyester III-1 | 15 | Urethane 3-1 | 5 |

TABLE 19

| | | Tg(a) (° C.) | Tg(b) (° C.) | Magnetization ($Am^2/kg$) | Average adhesive force (nN) | Surface roughness Ra (nm) | Average circularity | D4 (μm) | D4/D1 |
|---|---|---|---|---|---|---|---|---|---|
| Example III-1 | Toner III-1 | 52 | 78 | 19.6 | 8 | 2.1 | 0.981 | 5.6 | 1.19 |
| Comparative Example III-1 | Toner III-2 | 60 | 78 | 19.6 | 25 | 4.5 | 0.976 | 5.6 | 1.21 |
| Comparative Example III-2 | Toner III-3 | 52 | 40 | 19.6 | 11 | 3.6 | 0.980 | 5.6 | 1.17 |
| Comparative Example III-3 | Toner III-4 | 52 | — | 19.6 | 21 | 4.7 | 0.971 | 5.6 | 1.20 |
| Comparative Example III-4 | Toner III-5 | 52 | 78 | 11.5 | 12 | 3.8 | 0.979 | 5.6 | 1.19 |
| Comparative Example III-5 | Toner III-6 | 52 | 78 | 33.1 | 14 | 3.1 | 0.969 | 5.6 | 1.18 |
| Example III-2 | Toner III-7 | 52 | 62 | 19.6 | 12 | 2.8 | 0.977 | 5.5 | 1.19 |

TABLE 19-continued

| | | Tg(a) (° C.) | Tg(b) (° C.) | Magnetization ($Am^2/kg$) | Average adhesive force (nN) | Surface roughness Ra (nm) | Average circularity | D4 (μm) | D4/D1 |
|---|---|---|---|---|---|---|---|---|---|
| Example III-3 | Toner III-8 | 52 | 65 | 19.6 | 16 | 3.1 | 0.977 | 5.5 | 1.18 |
| Example III-4 | Toner III-9 | 60 | 78 | 28.9 | 10 | 4.7 | 0.968 | 5.6 | 1.21 |
| Example III-5 | Toner III-10 | 61 | 78 | 12.3 | 22 | 3.4 | 0.981 | 5.5 | 1.23 |
| Example III-6 | Toner III-11 | 40 | 78 | 19.6 | 46 | 6.2 | 0.982 | 5.5 | 1.19 |
| Example III-7 | Toner III-12 | 42 | 78 | 19.6 | 42 | 3.2 | 0.955 | 5.5 | 1.18 |
| Example III-8 | Toner III-13 | 52 | 75 | 16.5 | 16 | 3.1 | 0.971 | 5.5 | 1.31 |
| Example III-9 | Toner III-14 | 52 | 63 | 14.2 | 12 | 2.5 | 0.978 | 5.6 | 1.16 |
| Example III-10 | Toner III-15 | 52 | 78 | 19.6 | 14 | 2.8 | 0.979 | 5.6 | 1.17 |
| Example III-11 | Toner III-16 | 52 | 78 | 19.6 | 13 | 2.8 | 0.977 | 5.6 | 1.17 |

TABLE 20

| | | Image density | | | Charging performance | | | Fine-line reproducibility | | | |
|---|---|---|---|---|---|---|---|---|---|---|---|
| | Heat-resistant storage stability | 100 sheets/ 5,000 sheets | Evaluation for concentration variation | Fogging | Q1 (mC/kg) | Q2 (mC/kg) | Charging stability | 1,000 Sheets | 10,000 sheets | Transfer efficiency | Low-temperature fixability |
| Example III-1 | A | 1.38/1.37 | A | A | −26 | −25 | A | A | A | B | A |
| Comparative Example III-1 | A | 1.08/1.04 | C | B | −13 | −10 | D | B | B | B | A |
| Comparative Example III-2 | B | 1.42/1.37 | C | A | −24 | −22 | B | B | C | A | A |
| Comparative Example III-3 | D | 1.34/1.30 | B | B | −26 | −24 | B | A | B | B | A |
| Comparative Example III-4 | A | 1.37/1.28 | D | C | −15 | −11 | D | B | D | C | A |
| Comparative Example III-5 | A | 1.34/1.27 | D | B | −15 | −13 | C | B | D | A | A |
| Example III-2 | A | 1.40/1.38 | A | A | −17 | −16 | B | A | B | B | A |
| Example III-3 | A | 1.36/1.34 | A | A | −16 | −15 | B | B | B | B | A |
| Example III-4 | A | 1.31/1.26 | B | B | −12 | −12 | A | B | B | A | A |
| Example III-5 | A | 1.34/1.30 | B | B | −26 | −25 | A | A | A | B | A |
| Example III-6 | A | 1.40/1.36 | A | A | −29 | −27 | B | B | B | B | A |
| Example III-7 | A | 1.42/1.41 | A | A | −24 | −22 | B | B | B | A | A |
| Example III-8 | A | 1.30/1.29 | A | A | −19 | −18 | B | B | B | B | A |
| Example III-9 | A | 1.35/1.33 | A | A | −27 | −26 | A | B | B | B | A |
| Example III-10 | A | 1.31/1.31 | A | B | −26 | −25 | A | A | A | A | A |
| Example III-11 | A | 1.38/1.37 | A | B | −24 | −23 | A | B | B | B | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-267662, filed Oct. 15, 2007, which is hereby incorporated by reference herein in its entirety.

What is claimed is:

1. A magnetic toner comprising: capsule type toner particles each having a toner base particle (A) and a surface layer (B) on a surface of the toner base particle (A), wherein the toner base particle (A) comprises at least a binder resin (a) mainly formed of a polyester, a magnetic substance, and a wax, the surface layer (B) comprises a resin (b), and the resin (b) comprises a resin selected from the group consisting of a vinyl resin (b2), and a urethane resin (b3);

a glass transition temperature Tg(a) of the binder resin (a) and a glass transition temperature Tg(b) of the resin (b) satisfy a relationship represented by the following formula (1), $$Tg(a)<Tg(b) \quad (1);$$

a magnetization (στ) in an external magnetic field of 79.6 kA/m of the magnetic toner is 12 $Am^2/kg$ or more and 30 $Am^2/kg$ or less; and an average circularity of the magnetic toner is 0.960 or more and 1.000 or less.

2. A magnetic toner according to claim 1, wherein a volume resistivity Rt (Ω·cm) of the magnetic toner and the magnetization $\sigma\tau$ ($Am^2/kg$) of the toner satisfy a relationship represented by the following formula (2), $$\mathrm{Log}Rt>14-\sigma\tau/25 \quad (2)$$

3. A magnetic toner according to claim 1, wherein a dielectric loss (tan δ) represented by [a dielectric loss index ∈"]/[a dielectric constant ∈'] of the magnetic toner at a frequency of $10^5$ Hz is 0.015 or less.

4. A magnetic toner according to claim 1, wherein:

a weight average particle diameter (D4) of the magnetic toner is 4.0 μm or more and 9.0 μm or less; and particles of the magnetic toner each having a diameter of 0.6 μm or more and 2.0 μm or less account for 5.0 number % or less.

5. A magnetic toner according to claim 1, wherein the particles of the magnetic toner each having the diameter of 0.6 μm or more and 2.0 μm or less after an ultrasonication account for 5.0 number % or less.

6. A magnetic toner according to claim 1, wherein a content of the surface layer (B) is 2.0 parts by mass or more and 15.0 parts by mass or less with respect to 100 parts by mass of the toner base particle (A).

7. A magnetic toner according to claim 1, wherein a number average dispersed-particle diameter of the magnetic substance in a sectional enlarged photograph of the toner particles is 0.10 μm or more and 0.50 μm or less.

8. A magnetic toner according to claim 1, wherein:

the resin (b) has a sulfonic group; and the resin (b) has a sulfonic group value of 1 mgKOH/g or more and 25 mgKOH/g or less.

9. A magnetic toner according to claim 1, wherein the resin (b) comprises the urethane resin (b3).

10. A magnetic toner according to claim 1, wherein the surface layer (B) is formed of resin fine particles comprising the resin (b) and having a number average particle diameter of 30 nm or more and 100 nm or less.

11. A magnetic toner according to claim 1, wherein the toner particles are obtained by dispersing a dissolved product or a dispersed product in an aqueous medium in which the resin fine particles comprising the resin (b) are dispersed, and then removing an organic medium from the obtained dispersed solution, and drying the resultant, wherein the dissolved product or the dispersed product each is obtained by dissolving or dispersing at least the binder resin (a), the magnetic substance, and the wax in the organic medium.

12. A magnetic toner according to claim 11, wherein the magnetic substance is dispersed together with a part of the binder resin (a) in the organic medium beforehand, and thereafter, the remainder of the binder resin (a) and the wax are mixed to prepare the dissolved product or the dispersed product.

13. A magnetic toner according to claim 1, wherein:

when a temperature showing a maximum value of a loss elastic modulus of the magnetic toner is represented by Tt (° C.), Tt satisfies the following formula:

$$40° C. \leqq Tt \leqq 60° C.; \text{ and}$$

when loss elastic moduli at temperatures of (Tt+5) (° C.) and (Tt+25) (° C.) are represented by G"t(Tt+5) and G"t (Tt+25), respectively, G"t(Tt+5)/G"t(Tt+25) is larger than 40.

14. A magnetic toner according to claim 13, wherein:

the binder resin (a) comprises at least a resin (a1) and a resin (a2) having different softening points from each other;

the softening point of the resin (a1) is 100° C. or lower; and the softening point of the resin (a2) is 120° C. or higher.

15. A magnetic toner according to claim 14, wherein:

a weight average molecular weight of the resin (a1) is 2,000 or more and 20,000 or less in a molecular weight distribution of tetrahydrofuran (THF)-soluble matter of the resin (a1) measured by gel permeation chromatography (GPC); and a weight average molecular weight of the resin (a2) is 30,000 or more and 150,000 or less in a molecular distribution of tetrahydrofuran(THF)-soluble matter of the resin (a2) measured by gel permeation chromatography (GPC).

16. A magnetic toner according to claim 14, wherein a ratio of the weight average molecular weight (Mw) to a number average molecular weight (Mn) of the resin (a1) (Mw/Mn) is 1.0 or more and 8.0 or less in the molecular distribution of tetrahydrofuran (THF)-soluble matter of the resin (a1) measured by gel permeation chromatography (GPC).

17. A magnetic toner according to claim 14, wherein the resin (a1) accounts for 50 mass % or more and 90 mass % or less of the binder resin (a).

18. A magnetic toner according to claim 13, wherein:

when a temperature showing a maximum value of a loss elastic modulus of the resin (b) is represented by Tb (° C.), (Tb-Tt) is 5° C. or more and 20° C. or less; and when loss elastic moduli of the resin (b) at temperatures of (Tb+5) (° C.) and (Tb+25) (° C.) are G"b(Tb+5) and G"b(Tb+25), respectively, G"b(Tb+5)/G"b(Tb+25) is larger than 10.

19. A magnetic toner according to claim 13, wherein the magnetic toner has a storage elastic modulus at 120° C. (G't (120)) of $5.0\times10^2$ Pa or more and $5.0\times10^4$ Pa or less.

20. A magnetic toner according to claim 13, wherein the toner particles comprise 3% to 10% by mass of a tetrahydrofuran (THF)-insoluble matter excluding the magnetic substance.

21. A magnetic toner according to claim 1, wherein an average adhesive force (F50) of the magnetic toner measured by a centrifugal adhesion measurement apparatus is 50 (nN) or less.

22. A magnetic toner according to claim 21, wherein a mean roughness (Ra) of a surface of the toner particles is 1.0 mm or more and 5.0 mm or less.

* * * * *